US008671654B2

(12) United States Patent
Langen

(10) Patent No.: US 8,671,654 B2
(45) Date of Patent: Mar. 18, 2014

(54) METHOD AND SYSTEM FOR FORMING CONTAINERS WITH CORRUGATED MATERIAL

(76) Inventor: H. J. Paul Langen, Brampton (CA)

( * ) Notice: Subject to any disclaimer, the term of this patent is extended or adjusted under 35 U.S.C. 154(b) by 386 days.

(21) Appl. No.: 12/633,412

(22) Filed: Dec. 8, 2009

(65) Prior Publication Data

US 2010/0263333 A1 Oct. 21, 2010

Related U.S. Application Data

(63) Continuation-in-part of application No. PCT/CA2009/001249, filed on Sep. 11, 2009.

(60) Provisional application No. 61/136,542, filed on Sep. 12, 2008.

(51) Int. Cl.
*B65B 5/02* (2006.01)

(52) U.S. Cl.
USPC ..... 53/456; 53/563; 493/122; 493/175

(58) Field of Classification Search
USPC ..... 53/456, 563; 493/122, 124, 126, 175
See application file for complete search history.

(56) References Cited

U.S. PATENT DOCUMENTS

| | | | | |
|---|---|---|---|---|
| 1,643,564 A | | 9/1927 | Seiler | |
| 2,997,830 A | * | 8/1961 | Nelson | 53/495 |
| 3,196,761 A | * | 7/1965 | Ullman | 493/122 |
| 3,280,531 A | * | 10/1966 | Meyer-Jagenberg | 53/458 |
| 3,461,642 A | | 8/1969 | Langen et al. | |
| 3,543,469 A | * | 12/1970 | Ullman | 53/456 |
| 3,590,700 A | | 7/1971 | Paxton | |
| 3,611,885 A | | 10/1971 | Paxton | |
| 3,854,651 A | * | 12/1974 | Osborne | 229/160 |

(Continued)

FOREIGN PATENT DOCUMENTS

| | | |
|---|---|---|
| CA | 1242422 | 9/1988 |
| FR | 2775658 A1 | 9/1999 |
| JP | S54143385 A | 11/1979 |

OTHER PUBLICATIONS

International Search Report for PCT International Application No. PCT/CA2009/001249, filed Sep. 11, 2009.

(Continued)

*Primary Examiner* — Hemant M Desai
(74) *Attorney, Agent, or Firm* — Smart & Biggar

(57) ABSTRACT

A case is disclosed that is made from a corrugated material and has a generally flat transversely extending base panel and first and second transversely extending, generally parallel, side wall panels upstanding from, and being oriented generally orthogonal to, the base panel. First and third end wall panels meet at a first vertically extending seam extending upwards from one end of the base panel and second and fourth end wall panels meet at a second vertically extending seam extending upwards from an opposite end of the base panel. A blank for forming such a case is also disclosed. A method comprises forming a sheet of corrugated fiberboard; operating a die cutting apparatus to form a generally flat case blank from the sheet of corrugated fiberboard at a first location; transporting the flat case blank to a second location; operating a case forming apparatus at the second location to fold the case blank to form the case; after the case has been formed by the case forming apparatus, operating a loading apparatus to load at least one item into the case; and sealing opposed top panels.

34 Claims, 43 Drawing Sheets

(56) References Cited

U.S. PATENT DOCUMENTS

| | | | | |
|---|---|---|---|---|
| 3,866,391 | A * | 2/1975 | Puskarz et al. | 53/537 |
| 3,941,037 | A * | 3/1976 | Reichert | 493/167 |
| 3,986,319 | A * | 10/1976 | Puskarz et al. | 53/447 |
| 3,990,210 | A * | 11/1976 | McDonough et al. | 53/456 |
| 4,164,171 | A | 8/1979 | Meyers et al. | |
| 4,932,930 | A | 6/1990 | Coalier et al. | |
| 5,154,041 | A * | 10/1992 | Schneider | 53/456 |
| 5,593,375 | A | 1/1997 | Franci | |
| 5,876,319 | A | 3/1999 | Holton | |
| 7,678,036 | B1 * | 3/2010 | Malitas et al. | 493/59 |
| 7,935,041 | B2 | 5/2011 | Graham et al. | |
| 8,323,165 | B2 | 12/2012 | Atoui | |
| 2002/0033351 | A1 * | 3/2002 | Usui et al. | 206/521 |
| 2007/0037682 | A1 | 2/2007 | Scholtes et al. | |
| 2008/0110967 | A1 | 5/2008 | Walling | |
| 2011/0065559 | A1 * | 3/2011 | Atoui | 493/175 |
| 2011/0166007 | A1 | 7/2011 | Langen | |

OTHER PUBLICATIONS

International Search Report for PCT International Application No. PCT/CA2010/001948, filed Dec. 8, 2010.

Written Opinion for PCT International Application No. PCT/CA2010/001948, filed Dec. 8, 2010.

Desai, Hemant, USPTO Communication, dated Jan. 11, 2013, in related U.S. Appl. No. 12/998,047, filed Mar. 11, 2011.

Desai, Hemant, USPTO Communication, dated Aug. 29, 2013, in related U.S. Appl. No. 12/998,047, filed Mar. 11, 2011.

Extended European Search Report for EP 09812568.5 dated Jan. 17, 2014.

* cited by examiner

METHOD AND SYSTEM FOR FORMING CONTAINERS WITH CORRUGATED MATERIAL

RELATED APPLICATIONS

This application is a continuation-in-part of international application PCT/CA2009/001249, filed Sep. 11, 2009, which claims the benefit of and priority from U.S. provisional patent application No. 61/136,542, filed on Sep. 12, 2008, the entire contents of both of which are incorporated herein by reference.

FIELD OF THE INVENTION

The present invention relates generally to methods and systems for forming containers made from corrugated material, including corrugated fibreboard.

BACKGROUND OF THE INVENTION

Containers are used to package many different kinds of items. One form of container used in the packaging industry is a case that is used for shipping items/products. In the present application, the term "case" is used to refer to such containers. Cases come in many different configurations and are made from a wide variety of materials. However, many cases are foldable and are formed from a flattened state (commonly called a case blank). Cases may be made from an assortment of foldable materials, including cardboard, paperboard, plastic materials, composite materials, and the like and possibly even combinations thereof.

One particular type of case that is in widespread use in packaging a wide variety of items is a case made from a corrugated material, such as corrugated fibreboard. The use of corrugated fibreboard generally enhances the strength of the case. Of those cases made from corrugated fibreboard, the most common type is known as "Regular Slotted Container" case or "RSC" case and it is particularly well suited for packaging all types of items such as by way of example only, glass and plastic bottles, packaged goods, or other smaller cases or cartons.

The process for making an RSC begins with the formation of a piece of plain corrugated sheet material that can be formed by a corrugator machine. An example of a corrugator machine is the BHS Corrugator machine made by BHS Corrugated Maschinen- und Anlagenbau GmbH. The corrugator machine may produce a length of corrugated material of a given width that can be used immediately or stored in a roll until it is ready to be utilized.

The next step in forming an RSC is to take a roll or sheet of such corrugated material that may have an approximate width that may be the same as the width of the desired blank that may be used to form the RSC. The roll or sheet is also cut transversely such as to create sections of cardboard generally rectangular in shape. The corrugated material is then fed through what is known as a flexo-folder gluer machine. In passing through such a machine, the corrugated sheet passes through a printer, which prints words or pictures on one or both sides of the sheet. Next, the material is creased both across and along the sheet material such that when the RSC is folded/erected it may easily bend along the crease lines to form the desired shape.

The creased and printed sheet is then "slotted" with a slotting device which cuts thin transversely oriented "slots" in the board in intervals along the top and bottom. These slots create the panels that may be folded over the top and bottom openings of the RSC when it is erected. Finally, the sheet material goes through a rotary die cutter to remove excess corrugated material along one end of the board and crush down a portoin along a fold line, to create a thin "hinge". The purpose of the hinge is to later allow the board to be doubled back on itself (i.e. glue one end of the board to the other to create a tube) and glued.

The result of the flexo-folder gluer up to this point is to create a flat RSC blank such as, by way of example only, the blank 900 shown in FIG. 27. Thereafter the flexo-folder gluer may apply glue to the hinge portion of the blank. The panels on either end of the blank are then folded over by a folding mechanism such that one end of the blank is now glued to the other in a flattened tube-shaped orientation to create a flat "knock down" RSC.

After the knock down RSC has been created, it is typically grouped with other RSCs and shipped to the factory of the customer where the knock-down RSCs are to be erected and packed.

When it is desired to fill an RSC with a product, a two step operation is required. First, the RSC must be erected from its knock-down configuration, either by hand or using a "case erector" machine such as is disclosed in U.S. Pat. No. 7,510,517, the contents of which are hereby incorporated by reference. An example of a commercially available RSC case erector is the WF 20 model distributed by Wexxar Packaging.

The second step is placing of the product into the formed case, either by hand or using a "case packer" machine as in U.S. Pat. No. 4,644,734. An example of a commercial case packer is the VCP-25 Vertical Case Packer by Schneider Packaging.

There are a number of systems that are available that perform both the case erection and the case packing functions in a single apparatus.

There are however significant drawbacks to the process of forming and packing the RSCs. For example, the pre-folded and pre-glued blanks are not well adapted to shipping in bulk from the location where the knock-downs are formed to the premises where the knock-downs are erected and packed, due to their asymmetric shape—being three layers thick on the glued seam area and only two layers thick elsewhere. Unstable stacking characteristic of such blanks requires the use of secondary containers and also reduces the number of blanks that can be shipped per unit volume. These factors result in a significant increase in shipping costs compared to blanks that can be shipped in a completely flat arrangement.

Other problems associated with the formation of a RSC relate to the creation of the knock-down RSC. The alignment and gluing that is done to form the "knock-down" is often not very accurately performed and so the RSC that is eventually formed may not be properly and accurately constructed. This may cause problems in the erection of the case and in the loading and storage of items in the RSC.

Despite the foregoing drawbacks, the use of the RSC is widespread in the packaging of items. There may be several reasons for the continued prevalence of the RSC compared to cases formed from flat, die cut blanks (i.e. cases in alternative arrangements that are not folded over and glued into a "knock down" state prior to shipment to the place where the case is to be erected and/or packed). These reasons include the following: (1) RSC cases can be easily set up and sealed by hand without a machine. So in situations where case erecting and packing is done by hand, the RSC case is preferred. RSC cases may be preferred because hand packing can be easily done if problems with machinery arise; (2) The machinery traditionally used to form and pack die cut cases from flat, die cut blanks has been more expensive, complex, and inflexible when compared to RSC erectors and packers. Thus, at a location where the packing of the items into a case is accomplished, it is desirable to have relatively technically straightforward and inexpensive equipment. (3) The standard equipment and process for forming and loading an RSC has been established for many years. Businesses that have invested in RSC-type machinery have not see the need to invest the time and money to move to an alternate system based on a flat die cut blank, in the absence of significant cost savings and a viable alternate system for forming and packing such a case.

However it would be desirable to create a new type of blank and associated case that performs like an RSC and looks like an RSC, if some of the drawbacks of the existing RSC can be overcome. It should be noted that even a slight reduction in wastage of corrugated fibreboard material in creating the blank, would be immensely beneficial. However, it would also be desirable to have methods and apparatuses to form such RSC replacement cases from blanks that could be readily and efficiently employed at customer premises.

SUMMARY OF THE INVENTION

Accordingly, a new blank design, designated by the applicant as a dual side seam-regular slotted container blank (the "DSS-RSC" (TradeMark) blank) has been devised along with new forming processes and systems suited to forming cases from DSS-RSC blanks. The DSS-RSC blank that has been conceived can be formed into a DSS-RSC case that is functionally equivalent to an RSC case, but may be both cheaper to manufacture than an RSC, and may provide equivalent or better strength than an RSC.

According to an aspect of the invention there is provided a case made from a corrugated material, the case comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both said first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel.

According to an aspect of the invention there is provided a case comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both the first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel, and wherein the first and third end wall panels overlap to form the first vertically extending seam and the second and fourth end wall panels overlap to form the second vertically extending seam.

According to an aspect of the invention there is provided a case made from a corrugated material, the case comprising: i. a generally flat transversely extending base panel; ii. first and second transversely extending, generally parallel, side wall panels upstanding from, and being oriented generally orthogonal to, the base panel, each of the first and second side wall panels joined with and extending from the base panel; iii. first and second upstanding end panels positioned at opposed ends of the first side wall panel and oriented generally orthogonal to both the first side wall panel and the base panel, each the first and second ends panel joined with and extending from the first side wall panel; iv. third and fourth upstanding end panels positioned at opposed ends of second side wall panel and oriented generally orthogonal to the second side wall panel and the base panel, each of the third and fourth end panels joined with and extending from the second side wall panel; wherein the first and third end wall panels meet at a first vertically extending seam extending upwards from one end of the base panel and the second and fourth end wall panels meet at a second vertically extending seam extending upwards from an opposite end of the base panel.

According to an aspect of the invention there is provided a single piece blank for forming a case, the blank comprising a continuous piece of generally flat corrugated material comprising: i. a base panel; ii. first and second side wall panels meeting either side of the base panel meeting either side of the base panel along respective opposite fold lines; iii. first and second end panels meeting at opposed ends of the first side wall panel along respective opposite fold lines; iv. third and fourth side end panels meeting at opposed ends of second side wall panel along respective opposite fold lines. A width of aid base and a length of the first and third side end wall panels being selected such that when blank is erected to form the case, the first and third side end walls will meet at a first vertically extending seam at one end of the base panel and the second and fourth side end wall panels meet at a second vertically extending seam at an opposite end of the base panel.

According to an aspect of the invention there is provided a method of forming and loading a case, the case made from a corrugated material and comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both the first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel; the method comprising: i. forming a sheet of corrugated fiberboard; ii. operating a die cutting apparatus to form a generally flat case blank from the sheet of corrugated fiberboard at a first location; iii. transporting the flat case blank to a second location; iv. operating a case forming apparatus at the second location to fold the case blank to form the case, v. after the case has been formed by the case forming apparatus, operating a loading apparatus to load at least one item into the case; vi. sealing the opposed top panels of the case with the at least one item held in the case.

According to an aspect of the invention there is provided a system for forming and loading a case, the case made from corrugated fibreboard, the case comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both the first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel; and wherein the system comprises: i. a corrugator for forming a sheet of corrugated fiberboard; ii. a die cutting apparatus located at a first location operable to form a generally flat case blank from the sheet of corrugated fiberboard at a first location; iii. a case forming apparatus located at a second location to fold the generally flat case blank to form the case, iv. a loading apparatus to load at least one item into the case; v. a sealing apparatus for sealing the opposed top panels of the case with the at least one item held in the case.

According to an aspect of the invention there is provided a method for forming a case from a case blank, the case blank comprising: i. a base panel; ii. first and second side wall panels meeting either side of the base panel meeting either side of the base panel along respective opposite fold lines; iii. first and second end panels meeting at opposed ends of the first side wall panel along respective opposite fold lines; iv. third and fourth side end panels meeting at opposed ends of second side wall panel along respective opposite fold lines; a width of aid base and a length of the first and third side end wall panels being selected such that when blank is erected to form the case, the first and third side end walls will meet at a first vertically extending seam at one end of the base panel and the second and fourth side end wall panels meet at a second vertically extending seam at an opposite end of the base panel; the method comprising: (a) orienting a case blank in a generally flat first orientation; (b) rotating a first portion of the blank from the first orientation to a second orientation that is generally orthogonal to a second portion of the case blank.

According to an aspect of the invention there is provided a method of forming a case from a case blank, the case blank comprising: i. a base panel; ii. first and second side wall panels meeting either side of the base panel meeting either side of the base panel along respective opposite fold lines; iii. first and second end panels meeting at opposed ends of the first side wall panel along respective opposite fold lines; iv. third and fourth side end panels meeting at opposed ends of second side wall panel along respective opposite fold lines. A width of the base and a length of the first and third side end wall panels being selected such that when blank is erected to form the case, the first and third side end walls will meet at a first vertically extending seam at one end of the base panel and the second and fourth side end wall panels meet at a second vertically extending seam at an opposite end of the base panel; the method comprising: (a) providing a case blank in a first generally flat orientation, the case blank having first and second portions, the first portion of blank being generally adjacent and parallel to a first portion of a mandrel; (b) rotating the second portion of the case blank about the mandrel so the second portion is positioned at a second orientation that is generally orthogonal to the first portion.

According to an aspect of the invention there is provided a method of forming a plurality of case blanks from a single sheet of corrugated material, each of the plurality of blanks comprising: i. a base panel; ii. first and second side wall panels meeting either side of the base panel meeting either side of the base panel along respective opposite fold lines; iii. first and second end panels meeting at opposed ends of the first side wall panel along respective opposite fold lines; iv. third and fourth side end panels meeting at opposed ends of second side wall panel along respective opposite fold lines. A width of the base and a length of the first and third side end wall panels being selected such that when blank is erected to form the case, the first and third side end walls will meet at a first vertically extending seam at one end of the base panel and the second and fourth side end wall panels meet at a second vertically extending seam at an opposite end of the base panel; the method comprising: i. forming a sheet of corrugated fiberboard; ii. cutting a plurality of the blanks from the sheet such that a plurality of blanks are cut both laterally and longitudinally from the sheet of corrugated fiberboard.

According to an aspect of the invention there is provided a plurality of blanks made from a single continuous sheet of generally flat corrugated material, a plurality of blanks being cut from a single sheet in both a lateral and longitudinal direction, each the blank comprising: i. a base panel; ii. first and second side wall panels meeting either side of the base panel meeting either side of the base panel along respective opposite fold lines; iii. first and second end panels meeting at opposed ends of the first side wall panel along respective opposite fold lines; iv. third and fourth side end panels meeting at opposed ends of second side wall panel along respective opposite fold lines. A width of the base and a length of the first and third side end wall panels being selected such that when blank is erected to form the case, the first and third side end walls will meet at a first vertically extending seam at one end of the base panel and the second and fourth side end wall panels meet at a second vertically extending seam at an opposite end of the base panel.

According to an aspect of the invention there is provided a method of forming and loading a plurality of cases, each of the plurality of case made from a corrugated material and comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both the first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel; the method comprising: i. forming a sheet of corrugated fiberboard; ii. operating a die cutting apparatus to cut a plurality of generally flat case blank from the sheet of corrugated fiberboard in both a longitudinal and transverse direction on the sheet, the die cutting apparatus located at a first location; iii. transporting the plurality of flat case blanks to a second location; iv. operating a case forming apparatus at the second location to fold the plurality of case blanks to form the case, v. after the plurality of cases has been formed by the case forming apparatus, operating a loading apparatus to load at least one item into each of the plurality of cases; vi. sealing the opposed top panels of the case with the at least one item held in the case.

According to an aspect of the invention there is provided a system for forming a case, the case made from a case blank made from a corrugated material, the case comprising: i. a generally flat transversely extending base panel; ii. first and second transversely extending, generally parallel, side wall panels upstanding from, and being oriented generally orthogonal to, the base panel, each of the first and second side wall panels having respective first transverse edges extending along and joined with respective opposite transverse edges of the base panel; iii. first and second upstanding end panels positioned at opposed ends of the first side wall panel and oriented generally orthogonal to both the first side wall panel and the base panel, each the first and second ends panel having edges joined with and extending from opposed end edges of the first side wall panel; iv. third and fourth upstanding end panels positioned at opposed ends of second side wall panel and oriented generally orthogonal to the second side wall panel and the base panel, each of the third and fourth end panels joined with and extending from opposed end edges of the second side wall panel; wherein the first and third end wall panels meet at a first vertically extending seam extending upwards from one end of the base panel and the second and fourth end wall panels meet at a second vertically extending seam extending upwards from an opposite end of the base panel; and wherein the system comprises a case forming apparatus to fold and glue the generally flat case blank to form the case, and wherein the case forming apparatus comprises: (a) a mandrel, and wherein the case blank has a first portion that can be positioned proximate a first surface of the mandrel; (b) a folding and guide apparatus; (c) a movement apparatus operable for moving the mandrel towards and through the folding and guide apparatus while the first portion of the case blank is positioned proximate the first surface of the mandrel; (d) an adhesive applicator positioned to apply an amount of adhesive to at least one portion of the case blank; the system operable such that while the mandrel is moved towards and through the folding and guide apparatus by the moving apparatus, the adhesive applicator applies adhesive to the at least one portion of the blank.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 28:
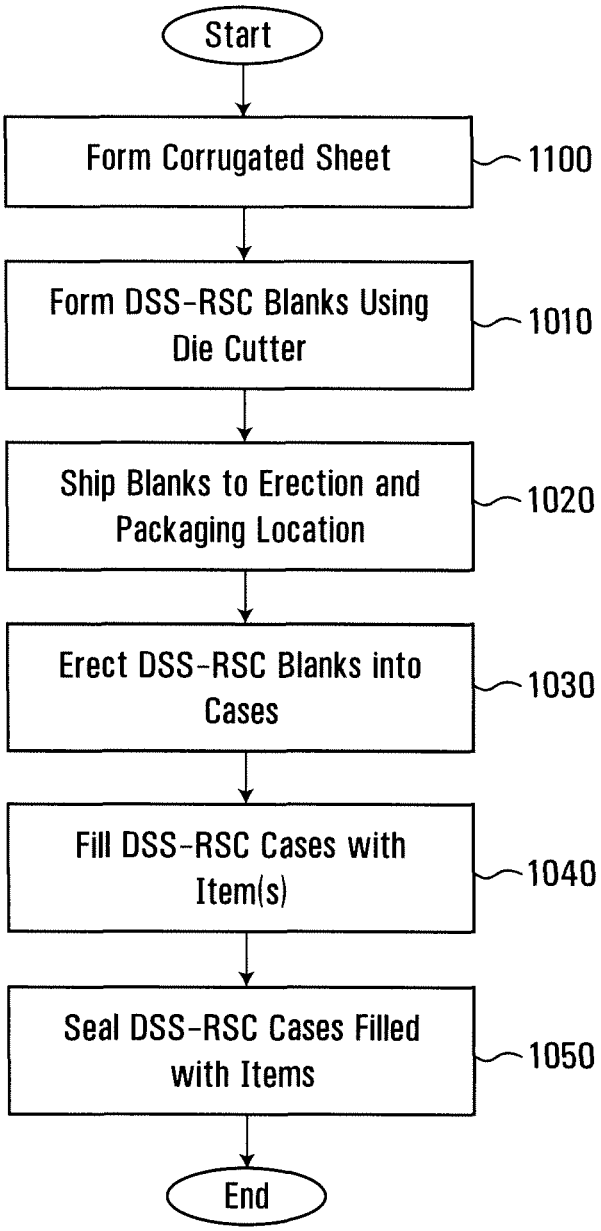
FIG. 28 is a schematic flow chart of a method of forming a case in accordance with an embodiment of the present invention.
Figure 30:
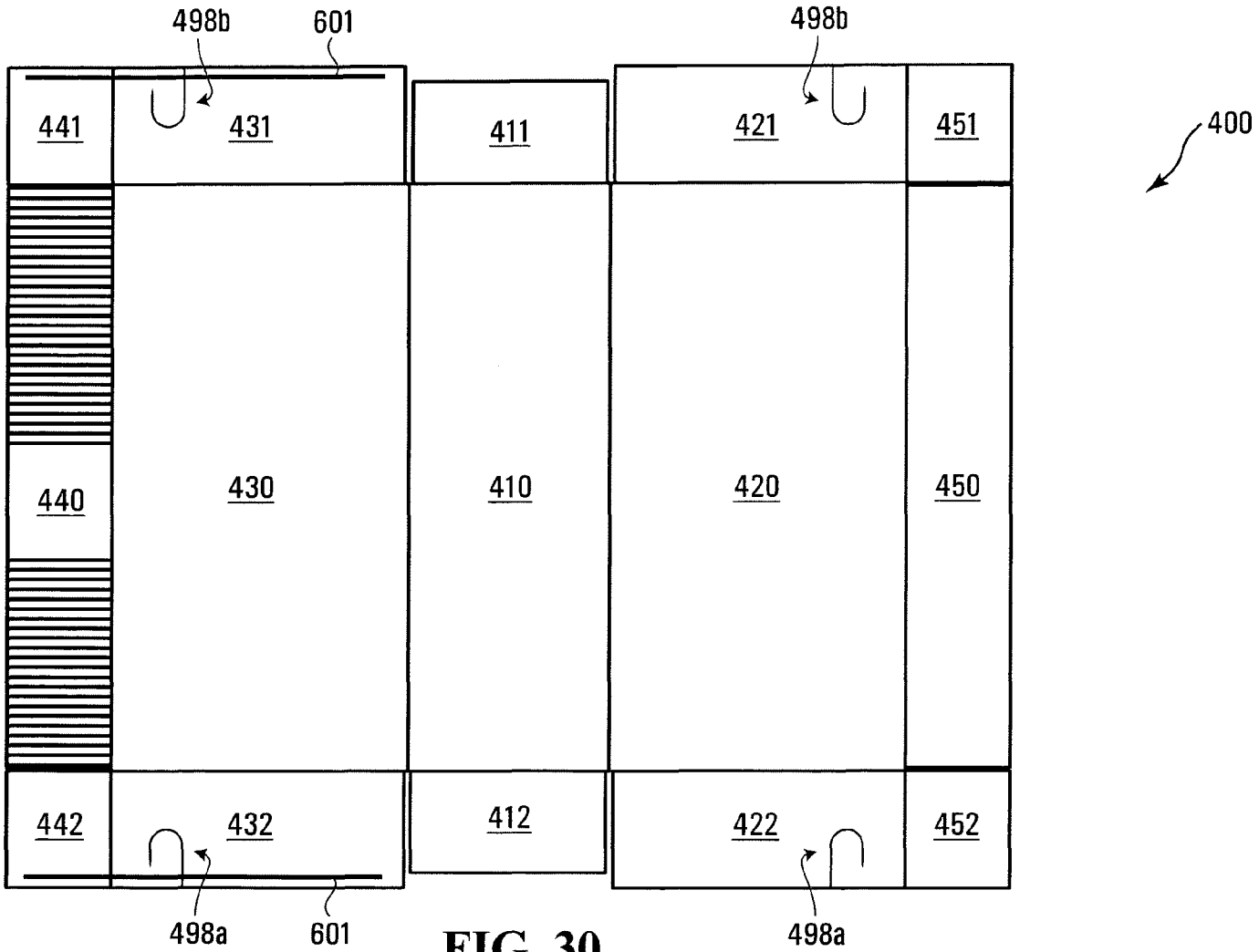
FIG. 30 is a plan view of an example of a blank for a DSS-RSC case in accordance with an embodiment of the present invention.

With reference initially to FIG. 28, a process for forming and packing a DSS-RSC case with items is illustrated schematically. The first step 1000 is the formation of a corrugated sheet of material (that may be formed into a roll of material) from which the DSS-RSC blank will be made. The roll or sheet of corrugated material does not have to be of the specific width or length of the desired width and length of the DSS-RSC blank such as blank 400 as illustrated in FIG. 30. The corrugated roll or sheet of fibreboard can be formed using a known type of corrugator machine such as the BHS Corrugator machine made by BHS Corrugated Maschinen- and Anlagenbau GmbH. An example of the type of corrugated sheet of material that may be produced is described in U.S. Pat. No. 150,588 the entire contents of which are hereby incorporated herein by reference. Step 1000 will typically take place in a plant location that is dedicated to manufacturing sheets/rolls of corrugated materials.

Once the sheet has been formed, the next step 1010 is the formation of the DSS-RSC blanks. This step 1010 may or may not take place at the same general geographic location and the same physical building as step 1000. However, in many situations the DSS-RSC blanks will be formed at the same location as where the corrugated material is formed in step 1000. The DSS-RSC blank (such as by way of example only blank 400 in FIG. 30) may be formed from the sheet or rolled sheet of corrugated material (eg. corrugated fibreboard) by using a die cutting machine. A die cutting machine may comprise a preliminary printing portion such that when the corrugated sheet is fed into the machine, appropriate text and/or images can be printed onto one or possibly both sides of the corrugated sheet in appropriate positions. Thus, when the DSS-RSC case is eventually erected, the printed material may be appropriately displayed.

Figure 29:
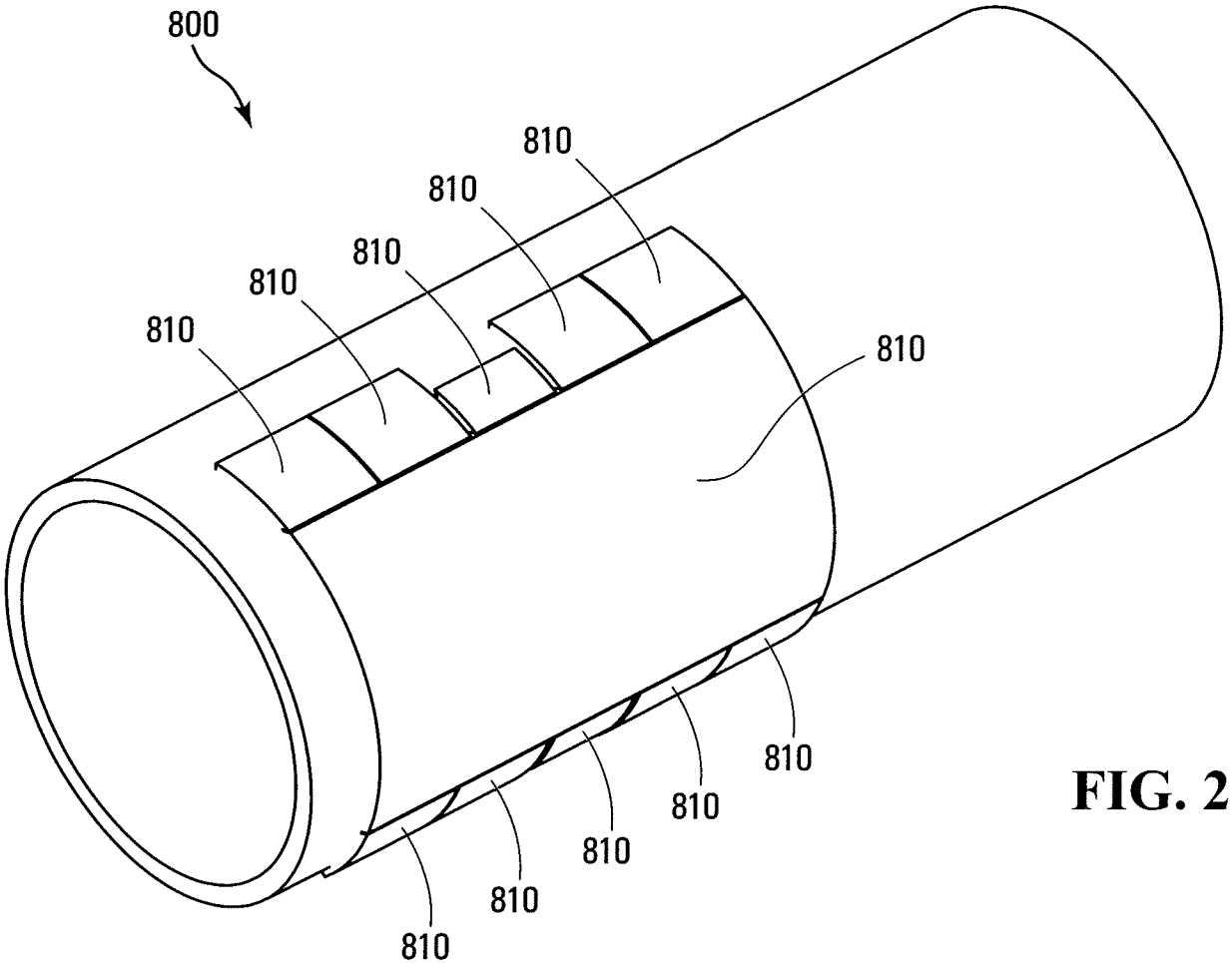
FIG. 29 is a perspective view of part of a typical press and cutting die portion of a die cutting apparatus to form part of a system for forming a DSS-RSC case (as hereinafter defined and described) in accordance with an embodiment of the invention.

Once it has been passed through the printing portion of the die cutting machine, the corrugated sheet can then be fed to the actual die cutting portion of the machine where one or more blanks are cut from the sheet of corrugated material. Typically this process involves the sheet being fed through and between a press and rotating cutting die. An example of a press and die cutting machine that might be adapted to form a suitable DSS-RSC blank is illustrated in U.S. Pat. No. 4,466,320. An example of a part of a typical press and cutting die portion 800 of such a machine is also illustrated schematically in FIG. 29. Cutting die 800 may have raised portions 810 that have outer cutting edges having a perimeter shape that corresponds with the shape of the desired blank. When the sheet of corrugated material is fed through the press and die cutting portion of the machine, the press and die cutting portion can thus cut out shapes, make perforations or creases, and may even cut the sheet into smaller parts to create a desired shaped blank. A series of gears forces the die to rotate at the same speed as the rest of the press, ensuring that any cuts the die makes line up with the printed material that has been placed on the corrugated sheet. The die cutting apparatus may be appropriately configured to cut out a single DSS-RSC blank at a time from the sheet of material, such as the blank 400 illustrated in FIG. 30 or the blank 500 in FIG. 36.

Figure 31:
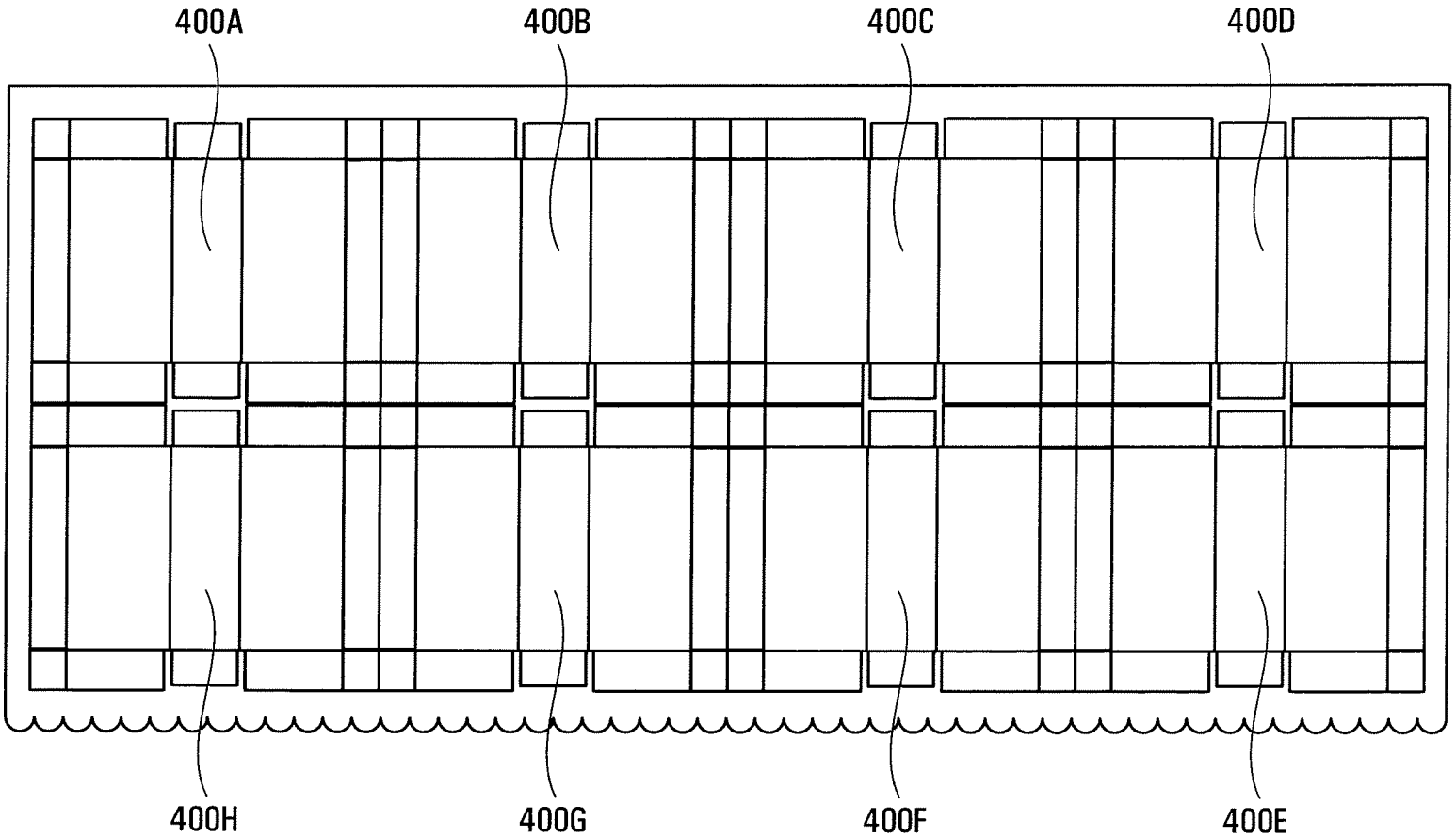
FIG. 31 is a plan view of a sheet of corrugated material from which can produce a plurality of the blanks of the type shown in FIG. 30.

Depending on the size of the blank and the configuration of the die cutting machine, multiple blanks such as blanks 400 or blanks 500 can be cut across the width of the sheet of material simultaneously. Examples of sheets of corrugated material showing the outlines of where the die cutting apparatus can cut from the sheet a plurality of blanks is illustrated in FIG. 31 with blanks **400*a*-400*h*, and in FIG. 37 with a plurality of blanks 500*a*-500*h***.

In overview, very long rolls or sheets of corrugated material may be provided with a width that may be approximately the same as the die cutting device. In the rotary die cutting of the sheet or roll fibreboard material, a cookie cutter like action, cuts and scores the material to generate blanks such as the DSS-RSC blank 400 shown in FIG. 30. Depending on the size of the blank and the size of the particular die, multiple blanks can be cut across the die simultaneously. FIG. 31 shows how several DSS-RSC blanks can be cut from a sheet of corrugated fibreboard using a rotary die cutter. Reference is also made to FIG. 37, which shows how several of DSS-RSC blanks 500 of FIG. 36 can be cut from a sheet of corrugated fibreboard using a rotary die cutter.

Once a plurality of blanks such as blanks 400 or blanks 500 have been formed they may be placed into stacks of blanks that may be conveniently loaded onto pallets. Once loaded onto pallets, as indicated in step 1020 of FIG. 28, the blanks can be shipped to a location where the DSS-RSC blanks 400 or 500 may be erected and filled with product(s) pursuant to steps 1030 and 1040. The shipping can occur by any known type of transportation such as by way of example only, truck, and/or plane, and/or train and/or by ship.

The location where steps 1030 and 1040 occurs may conveniently be at the customer premises, where for example a manufacturer of a product wishes to load the product it has manufactured into a case. By way of example only, a manufacturer of soft drinks may produce bottles of soft drinks that need to be loaded into cardboard cases for shipping to their customer. Instead of employing an RSC and the equipment normally used to erect and fill such cases, the manufacturer can instead employ a case former apparatus. By way of example only, the case formers illustrated in FIGS. 1 to 26 can be utilized to transform the generally flat configured DSS-RSC blanks into DSS-RSC open-topped cases in step 1030. The dimensions of such DSS-RSC cases may be substantially identical to the RSC case, and may meet or exceed the desired functional qualities of the typical prior art RSC case.

The final steps 1040 and 1050 illustrated in FIG. 28 are the loading/filling of each DSS-RSC case with one or more products/items and then the sealing of the case to fully enclose the products/items. This step 1050 may typically take place, at the same location, or proximate to, the location where step 1040 takes place. Examples of known machines that can be employed to fill and seal such cases include the DPI Drop Packer by Combi Packaging Systems LLC.

It should be noted that in some embodiments, the erection of the DSS-RSC blanks into cases and the subsequent loading and sealing of the cases may take place on a single apparatus.

Figure 43:
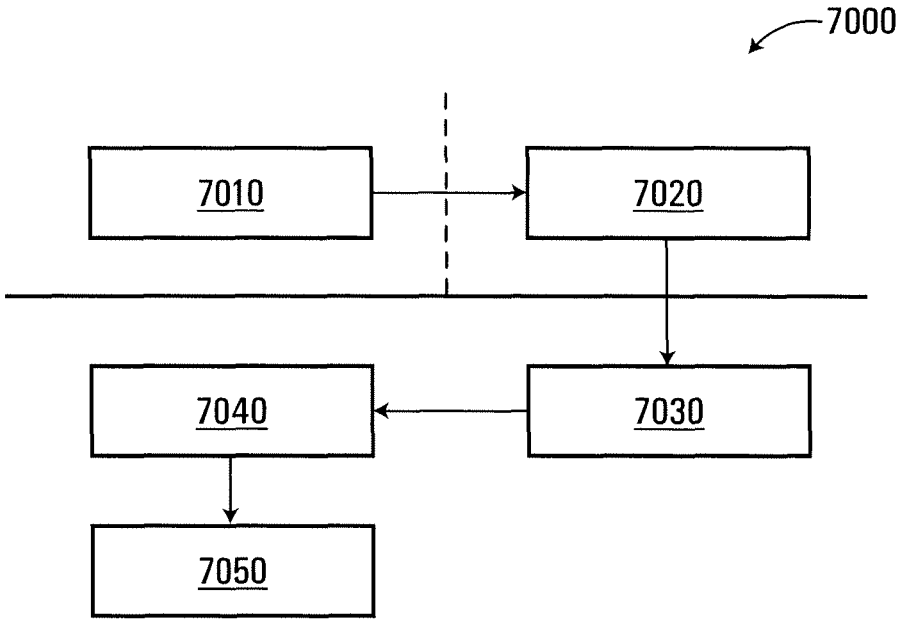
FIG. 43 is a schematic view of a system for forming, erecting and packing a DSS-RSC case.

A schematic view of a system 7000 for forming, erecting and packing a DSS-RSC case with one or more items is illustrated in FIG. 43. System 7000 may include a corrugator machine (as referenced above) 7010, and a die cutting machine 7020 (also as referenced above). Corrugator machine 7010 and die cutting machine 7020 may in some applications be co-located at the same plant and building or be otherwise located near to each other in close geographic proximity. Corrugator machine 7010 and die cutting machine 7020 may in other applications be remotely located from each other.

System 7000 may also include a case forming apparatus 7030 which may be located remotely from corrugator 7010 and die cutting machine 7020. Case forming apparatus 7030 may be located at the premises of a manufacturer of products that need to be packed into a case. System 7000 may also include a case filling apparatus 7040 and a case sealing apparatus 7050 and these may be co-located with the case forming apparatus 7030.

Figure 33:
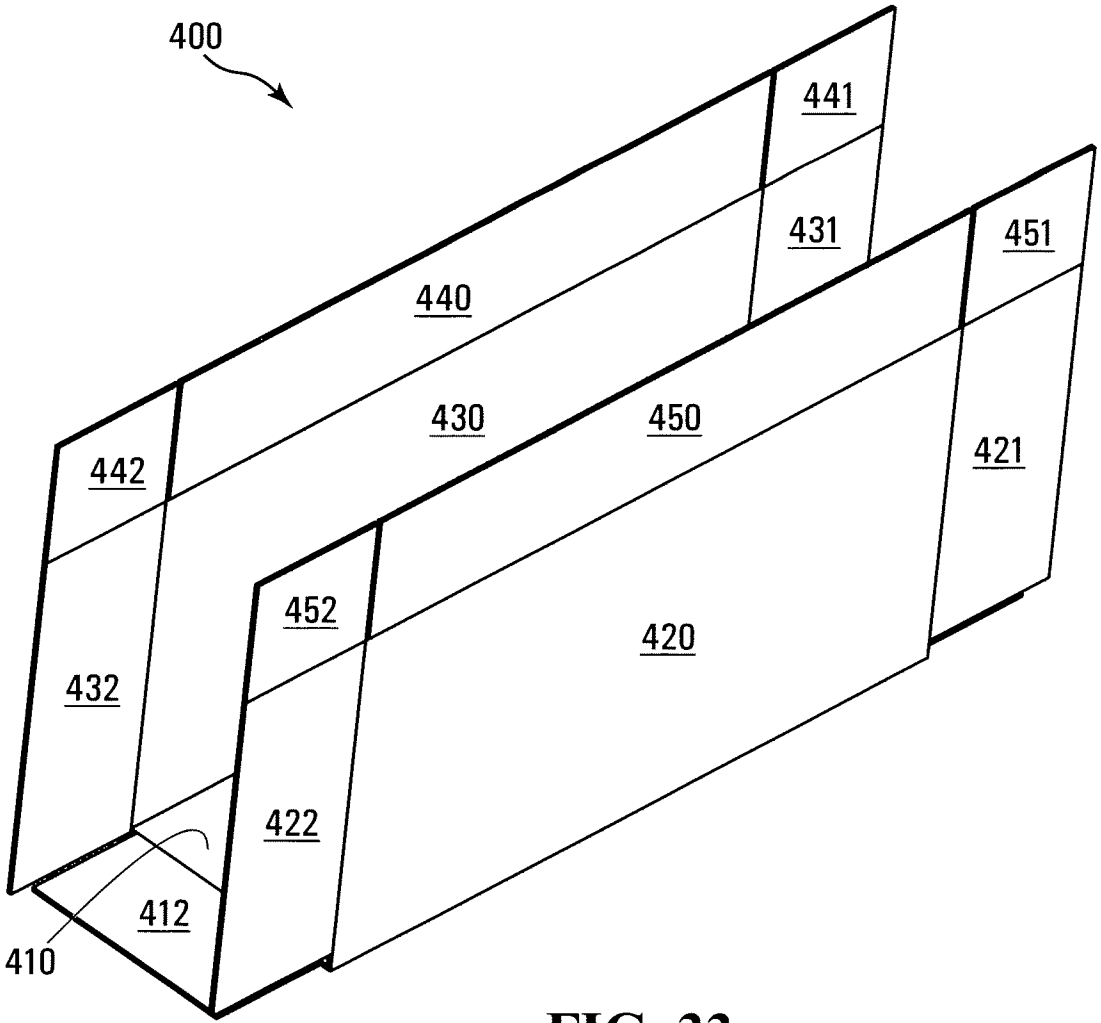
FIGS. 33 to 35 are a series of perspective views of a DSS-RSC blank such as a blank in FIG. 30 shown in isolation as it progresses through the process of FIG. 32.
Figure 34:
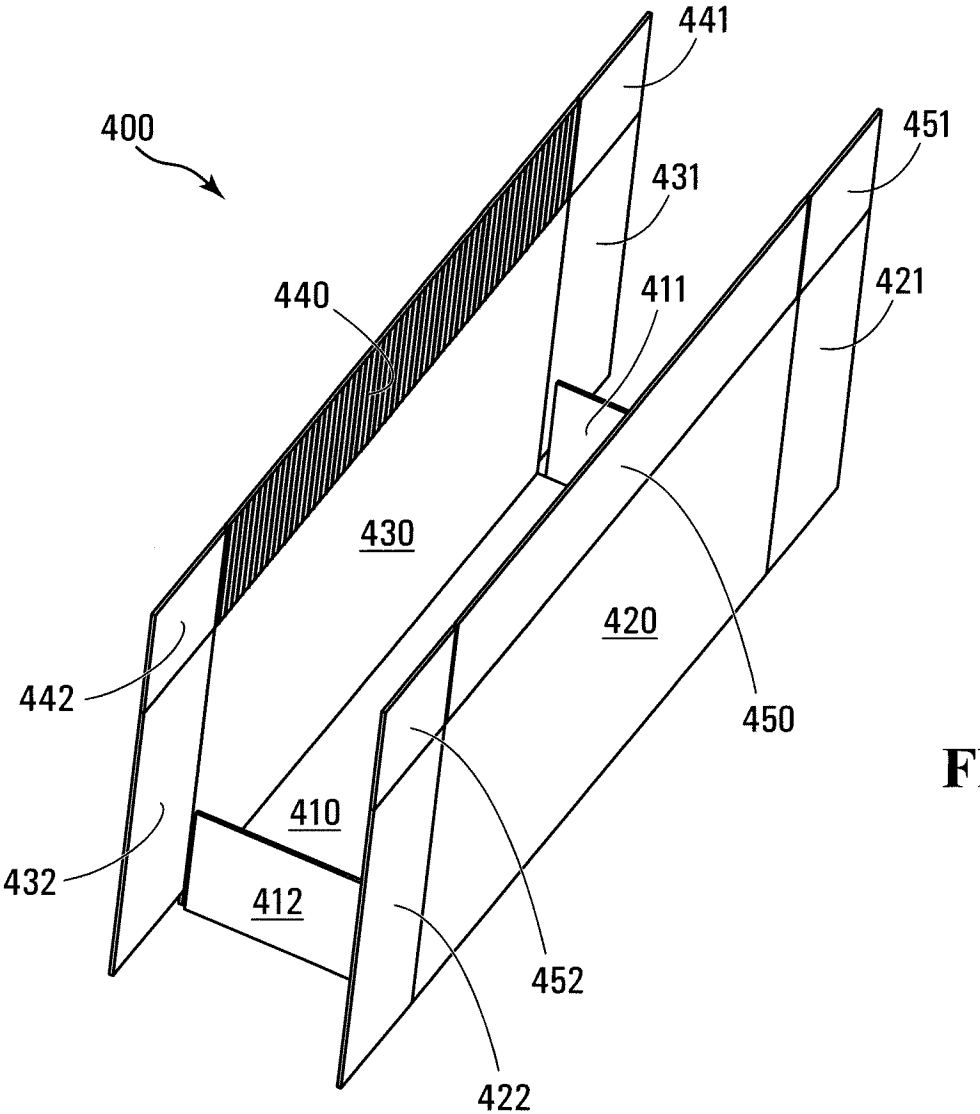
Figure 35:
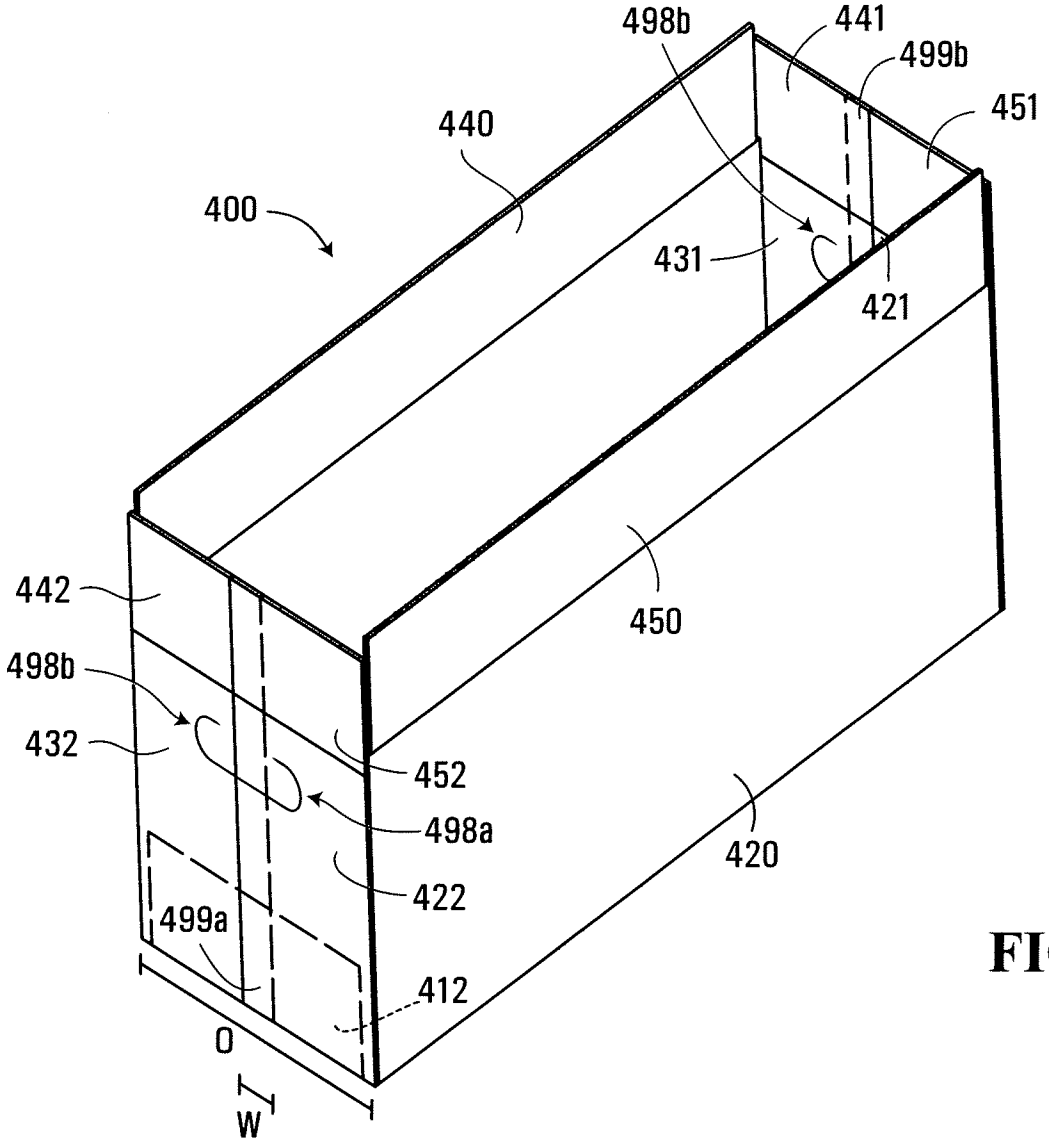

With reference now to FIGS. 30 to 35, illustrated is an example DSS-RSC blank 400 in various stages of configuration progressing from the generally flat blank 400 in FIG. 30 to the erected DSS-RSC in FIG. 35. By way of example only, a typical formed DSS-RSC case used to hold smaller cartons of various consumer products would have dimensions of 24 inches in length, 12 inches in width and 18 inches in height. Referring to blank 400, panels 410, 420, 430, 440 and 450 may thus have a common length of 24 inches. Panels 430, 431, 432, 420, 421, and 422 may have a common height of 18 inches. Panels 410, 411, and 412 may have a common width of 12 inches. In order to create an overlapping side seam, panels 421, 422, 431, 432, 441, 442, 451, and 452 may extend out approximately 7 inches from panels 410, 420, and 430. Panels 440, 441, 442, 450, 451, and 452 may extend out approximately 6 inches or less from panels 430, 431, 432, 420, 421, and 422 to create the top flaps of the case. Finally panels 411 and 412 may extend out from panel 410 to a distance of approximately 6 inches. Blank 400 may be made of creased corrugated fibreboard that may have been produced by the steps 1000 and 1010 as described above using known types of machines. The direction of corrugation within the fibreboard may be as is shown in the broken out portion of panel 440 in FIGS. 30 and 34 and may run continuously, along the length of the blank to panel 450. Corrugated fiberboard is a paper-based material consisting of two or three paper layers glued or otherwise fused together: a fluted corrugated sheet and one or two flat linerboards. The fluted material is bent in wave-like orientation and is glued to a single flat linerboard or sandwiched between two flat linerboards. Blank 400 may be scored and cut to form a bottom panel 410, side wall panels 420 and 430, and major top cover panels 440 and 450. Panels 440, 430, 410, 420 and 450 are arranged in series along the direction of corrugation. Panels 440, 430, 410, 420 and 450 have transverse edges that are oriented generally orthogonally to the direction of corrugation. Where the edge of one panel is joined to another panel at adjacent transverse edges (eg. the right edge of panel 440 is joined to the left edge of panel 430) there are fold lines about which the panels may be folded/rotated relative to each other. It will be noted that each panel 440, 430, 410, 420, and 450 also extends transversely (in the case of blank 400, this is also orthogonal to the direction of corrugation).

Each of the bottom and side wall panels 410, 420 and 430 is provided with a side end panel extending from each longitudinal side edge of the bottom and side wall panels (see panels 411, 412, 421, 422, 431 and 432). Each of these end panels is foldable about a longitudinal fold line where it is joined to the side edge of the bottom/side wall panels. It will be noted that there are gaps between side end wall panel 411 and side wall end panels 431, 421. There are also gaps between side end wall panel 412 and side end wall panels 432, 422. The side end panels 421, 422, 431 and 432 may be configured to extend out from each side wall 420 and 430 respectively to a distance that is equal to slightly more than ½ of the width of the bottom panel 410. This may create an overlap of dimension O in FIG. 35 to provide vertical seams 499*a*, 499*b*, (see FIG. 35) such that the ends of the DSS-RSC can be sealed. An overlap of side panels 422 and 432 and of side panels 421 and 431 at the ends of the DSS-RSC is not necessary but is beneficial. Indeed, there may be an overlap of size O in the range for example of ½ to 3 inches. It will be appreciated from FIG. 35 that the direction of corrugation in panels 432 and 422, 431 and 421 will be vertically oriented. This combination of features (the overlapping side seams and the vertical orientation of corrugation in the main end panels), both individually and particularly in combination provide a co-operative effect to enhance the overall vertical support strength of the DSS-RSC case and thus may provide an enhanced stacking load capacity when DSS-RSC cases filled with products are stacked on top of each other.

If there is no overlap at the seam, it is desirable that the side panels are in proximate abutment with each other or that any vertical gap between them at the seam, if any, should be quite small (eg. less than an inch in most if not all applications). However, providing an overlap may provide advantages including enhancing the strength of the DSS-RSC case.

The bottom panels 411 and 412 may also extend out from the bottom panel 410 such that when the DSS-RSC is erected, these bottom panels 411, 412 will reinforce their respective end walls and the seams 499*a*, 499*b*, at the bottom of the ends. Each of the side panel panels 421, 422, 431 and 432 have a minor top panel extending from the top of the respective side panel. These minor top panel panels are numbered 441, 442, 451, and 452 in FIGS. 30-35. Gaps are also provided as follows: between panel 450 and minor panels 451 and 452; and between panel 440 and minor panels 441 and 442, all as shown in FIG. 30. Minor top minor panels 441, 442, 451, 452 may be used to assist top panels 440, 450 in closing the opening to the case. Thus top minor panels may be positioned underneath or on top of top panels 440, 450 and may be joined to the top panels such as by adhesive or by packing tape to close the opening.

In order to maximize the overall strength, and in particular the stacking strength of the DSS-RSC design, the blank 400 may, as discussed above, be oriented on the fibreboard such that the internal columns in the corrugation run vertically up the side wall panels 430 and 420 of the case.

Figure 32:
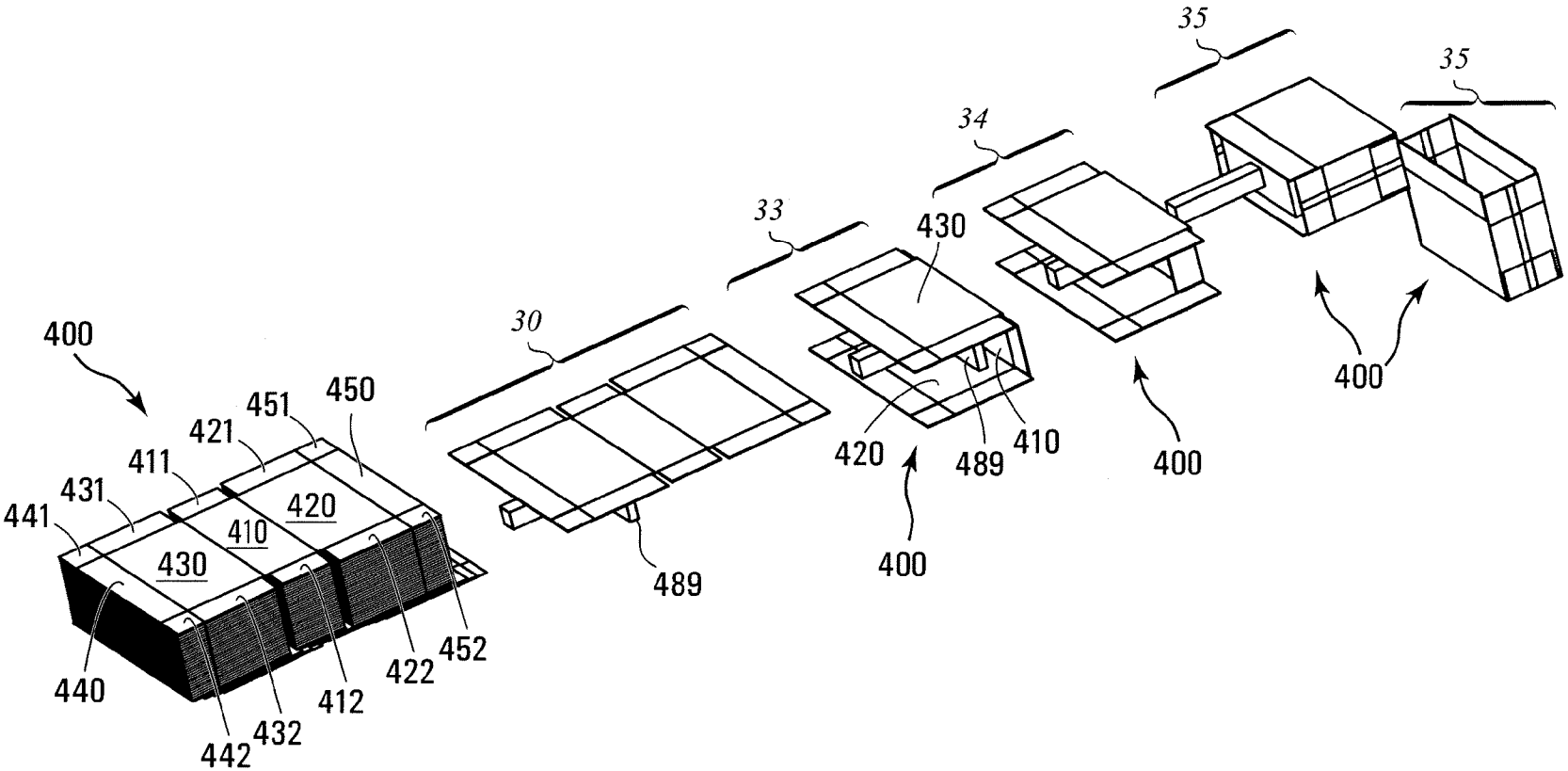
FIG. 32 is a schematic perspective view illustrating an example process by which a DSS-RSC blank such as the blank in FIG. 30 can be erected into DSS-RSC case.

With reference now to FIG. 32, the progressive folding of a DSS-RSC blank 400 is shown schematically. The blank 400 progresses from the flat configuration referenced as "30" (referring to FIG. 30) to a folded position referenced as "33" (referring to FIG. 33) to a further folded position "34" (referring to FIG. 34) to an erected configuration referenced as "35" (referring to FIG. 35).

FIGS. 32-35 illustrate the process by which the DSS-RSC case in FIG. 30 can be erected. The DSS-RSC case may be erected by formation around a mandrel such as by way of example a mandrel 489. Referring to FIG. 32, the DSS-RSC blank is placed against a mandrel and commences a process by which the panels of the DSS-RSC blank are folded around the mandrel to form an erected case. The sequence shown here by which the panels are folded and affixed to one another is merely illustrative and of course various other iterations may be chosen to get an identical or similar end result.

Referring to FIG. 33 and reference 33 in FIG. 32, panel 410 may be rotated/folded—for example by approximately ninety (90) degrees—about a pre-determined fold line between panels 410 and 430. Thus panel 410 (and attached panels 411, 412, 420, 421, 422, 450, 451 and 452) may be rotated/folded relative to panels 430, 431, 432, 440, 441 and 442 from a generally flat orientation to a generally angled orientation, thus forming a generally L-shaped configuration. Next, either subsequent to or simultaneous with the folding of panel 410 relative to panel 430, panel 420 can be rotated/folded—for example by approximately ninety (90) degrees—about a predetermined fold line between panels 420 and 410. Thus panel 420 (and attached panels 421, 422, 450, 451 and 452) is rotated from a generally flat orientation to a generally angled orientation relative to panel 410 such that the panels 410, 420 and 430 will form a generally U-shaped configuration.

FIG. 34 and reference 34 in FIG. 32 illustrate the next step of the process. Bottom panels 411 and 412 may be rotated—for example by approximately ninety (90) degrees—about a pre-determined fold line between panels 411 and 410, and 412 and 410, respectively. Thus bottom panels 411 and 412 may be rotated relative to panel 410 from a generally flat orientation to a generally angled orientation, thus each forming a generally L-shaped configuration with panel 410. The panels 410, 411 and 412 will thus form a generally U-shaped configuration. All four of panels 411, 412, 420 and 430 are to be rotated in the same general direction vis-á-vis panel 410 such that the panels 411, 412, 420 and 430 thus begin to form opposing side walls of a four-sided container. The folding of each of panels 411 and 412 may be either simultaneous to one another or with one panel being folded after the other.

Prior to the further progressive folding of panels of the DSS-RSC blank 400 to the configuration shown in FIG. 35, a suitable type of adhesive (such as hot melt adhesive) may be applied to the outward facing surface of panels 411, 412. Glue may also or alternatively be applied to the inward facing surface of panel 422 and the outward facing surface of panel 432 in the region of the seam overlap 499*a* shown in FIG. 35. Likewise at the opposite end of the DSS-RSC, glue may also or alternatively be applied to the inward facing surface of panel 421 and the outward facing surface of panel 431 in the region of the seam overlap 499*b* shown in FIG. 35.

With reference to FIG. 35 and reference 35 in FIG. 32, side end panels 431 and 432 may be rotated—for example by about approximately ninety (90) degrees—about a pre-determined fold line between panels 431 and 430, and 432 and 430 respectively. Thus side end panels 431 and 432 can be rotated relative to panel 430 from a generally flat orientation to a generally angled orientation, thus each forming a generally L-shaped configuration with panel 430. The folding of each of panels 431 and 432 may be either simultaneous to one another or with one panel being folded subsequently to the other.

Next, either simultaneously with, prior to, or subsequent to the folding of side end panels 431 and 432, side end panels 421 and 422 may be rotated/folded—preferably approximately ninety (90) degrees—about a pre-determined fold line between panels 421 and 420, and 422 and 420 respectively. Thus side panels 421 and 422 are rotated/folded relative to panel 420 from a generally flat orientation to a generally angled orientation, thus each forming a generally L-shaped configuration with panel 420. The folding of each of panels 421 and 422 may be either simultaneous to one another or with one panel being folded subsequently to the other.

As side panels 431 and 432 are folded, they may be compressed in such a manner that the inside surface portions ("inside" referring to the direction oriented towards the inside of the case) of side panels 431 and 432 engage outer surfaces portions of bottom panel 411 and 412 respectively. Thus, with the assistance of adhesive positioned between the respective surfaces, side panels 431 and 432 may be attached to the outside surface portions of bottom panels 411 and 412 respectively. Likewise, with the assistance of appropriately positioned adhesive, as side panels 421 and 422 are folded, they may be compressed in such a manner that the inside portions of side panels 421 and 422 engage the outer surfaces of bottom panels 411 and 412 respectively. Thus, with the assistance of adhesive positioned between the respective surfaces, side panels 421 and 422 may also be attached to the outside of bottom panels 411 and 412 respectively. Also with the assistance of appropriately positioned adhesive, side panels 421 and 422 may be also compressed in such a manner that the inside surfaces of side panels 421 and 422 may also engage portions of the outer surfaces of side panels 431 and 432 respectively. With the assistance of adhesive positioned between the respective surfaces, side panels 421 and 422 may thus be attached to portions of the outside of side panels 431 and 432 respectively. Alternatively, side panels 421, 422, 431 and 432 might be folded and compressed in such a sequence that side panels 421 and 422 might be attached to the inside of side panels 431 and 432 respectively. Other folding sequences of the foregoing panels are also possible. For example, panels 431, 432, 421, 422 may all be folded upwards and may also be glued prior to folding upwards opposite panels 411 and 412 so that panels 411 and 412 are on the outside of the case. However, in this latter configuration, panels 411, 412 may be more readily susceptible to being dislodged during use. Any suitable type of adhesive may be employed in bonding together panels in the construction of the DSS-RSC case, such as Cool-Lok adhesive made by Nacan Products Limited. This "hot-melt"-type glue is typically applied in a "bead" along a particular first panel. This bead may be applied at a temperature appreciably higher than the ambient room temperature. As a second panel is folded over the first panel with the glue and pressure applied to the joint, the glue is spread out over the surfaces of the two panels. As the glue is spread out, it cools down, forming an instant adhesive bond between the panels.

FIG. 35 and reference 35 in FIG. 32 show the DSS-RSC case 400 with the top open after it has been erected, ready to be loaded with product. Minor top panels 441 and 451 overlap and form one end cover panel of the case. Similarly, minor top panels 442 and 452 overlap to form the other end cover panel. After product is loaded into the DSS-RSC from the top, the two end cover panels may be folded over at each end. Finally, the two major cover panels 440 and 450 may be folded over and secured to the end cover panels.

An additional feature that may be incorporated into the DSS-RSC box design is a "punch out" handle to allow persons to more easily carry the case from one location to another. Referring to FIG. 30 and FIG. 35, blank 400 may include lines 498*a*, 498*b* that may either be pre-cut lines or perforation lines that provide a modified type of DSS-RSC case such that when the case is formed and sealed with product (eg. Beer bottles), persons seeking to carry the case can push through and in the portion of the case partially encircled by lines 498*a* and 498*b* to create an opening in the case at either end in which a hand can be inserted to create a handle. Referring more specifically to FIG. 30 lines 498*a* and 498*b* can be cut or perforated into the corrugated fiberboard at the same time the case is being cut from a larger sheet of fiberboard as described herein. The DSS-RSC case, modified to include the handles, may be formed in the same way as the case without this additional feature. The positioning of the handles over the seam created by the overlap of panels 421 and 431, and panels 422 and 432 may also provide additional strength to the handle that would otherwise not exist had the handle been placed on a portion of the case that did not have overlapping panels.

An alternative to the DSS-RSC blank 400 of FIGS. 30-35 is illustrated in FIGS. 36-41. In this alternative embodiment, blank bottom panels 511 and 512 of blank 500 that extend from the bottom of the case are cut into a triangular-shaped "wedge" instead of remaining in a rectangular shape as in FIG. 30. Side flaps 531 and 532 have a rectangular portion cut out (a "notch") extending from the bottom of the flap up a distance at least equal to the length that the bottom flaps 511 and 512 extend from the bottom panel 510.

Figure 36:
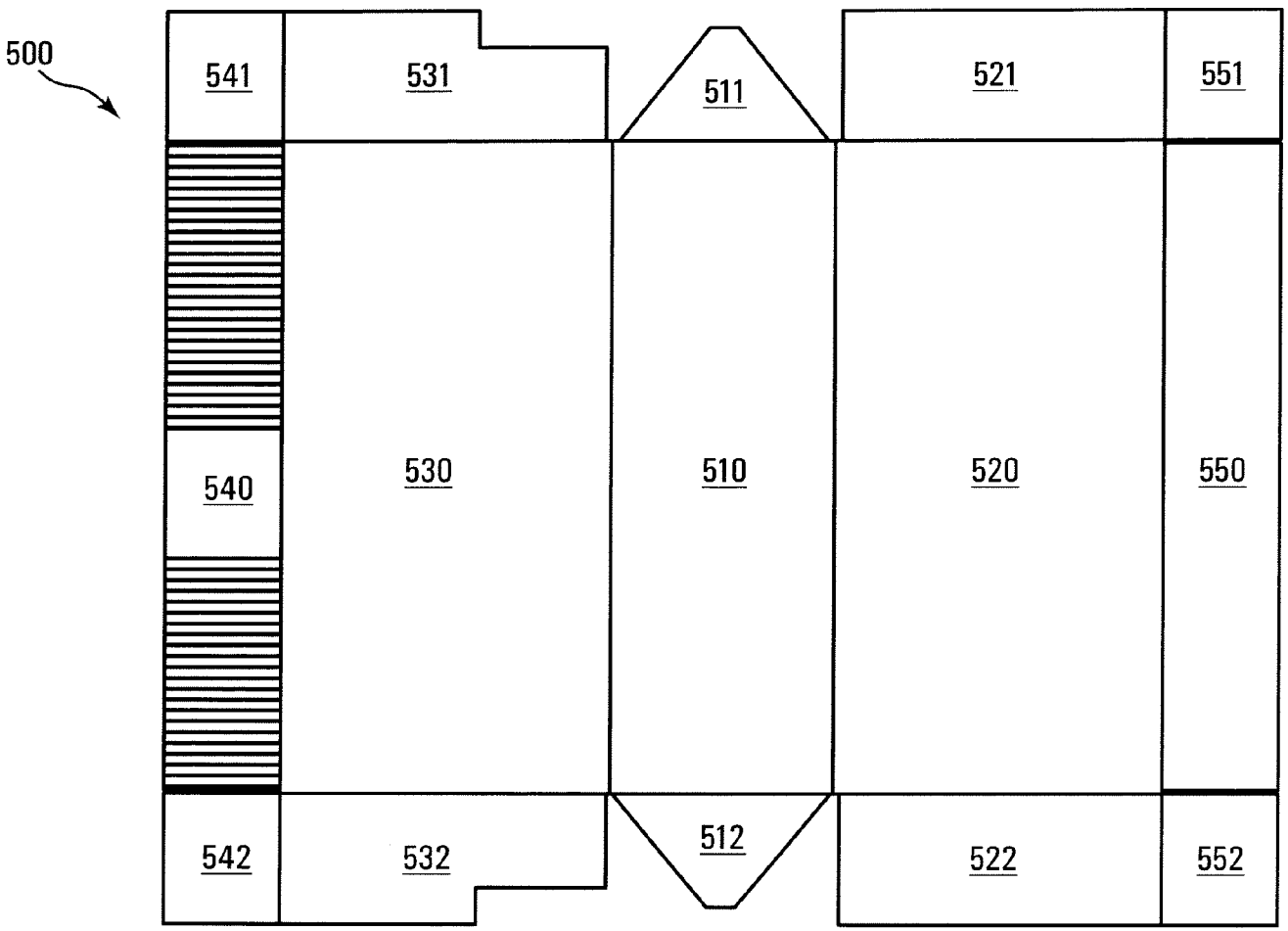
FIG. 36 is a plan view of a blank for a DSS-RSC case in accordance with an alternate embodiment of the present invention.
Figure 37:
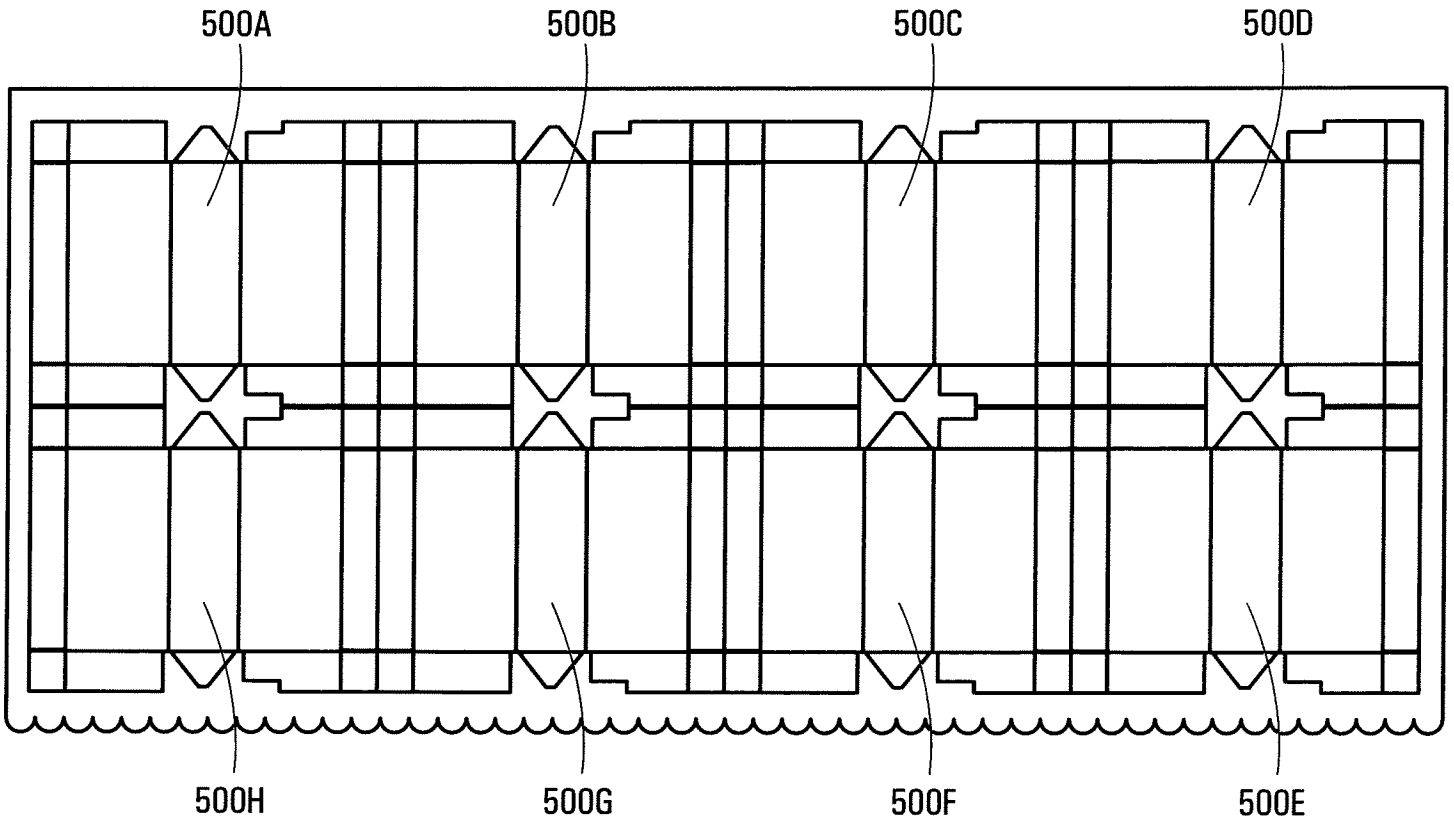
FIG. 37 is a plan view of a sheet of corrugated material that can be used to produce a plurality of the blanks such as the blanks of FIG. 36.
Figure 38:
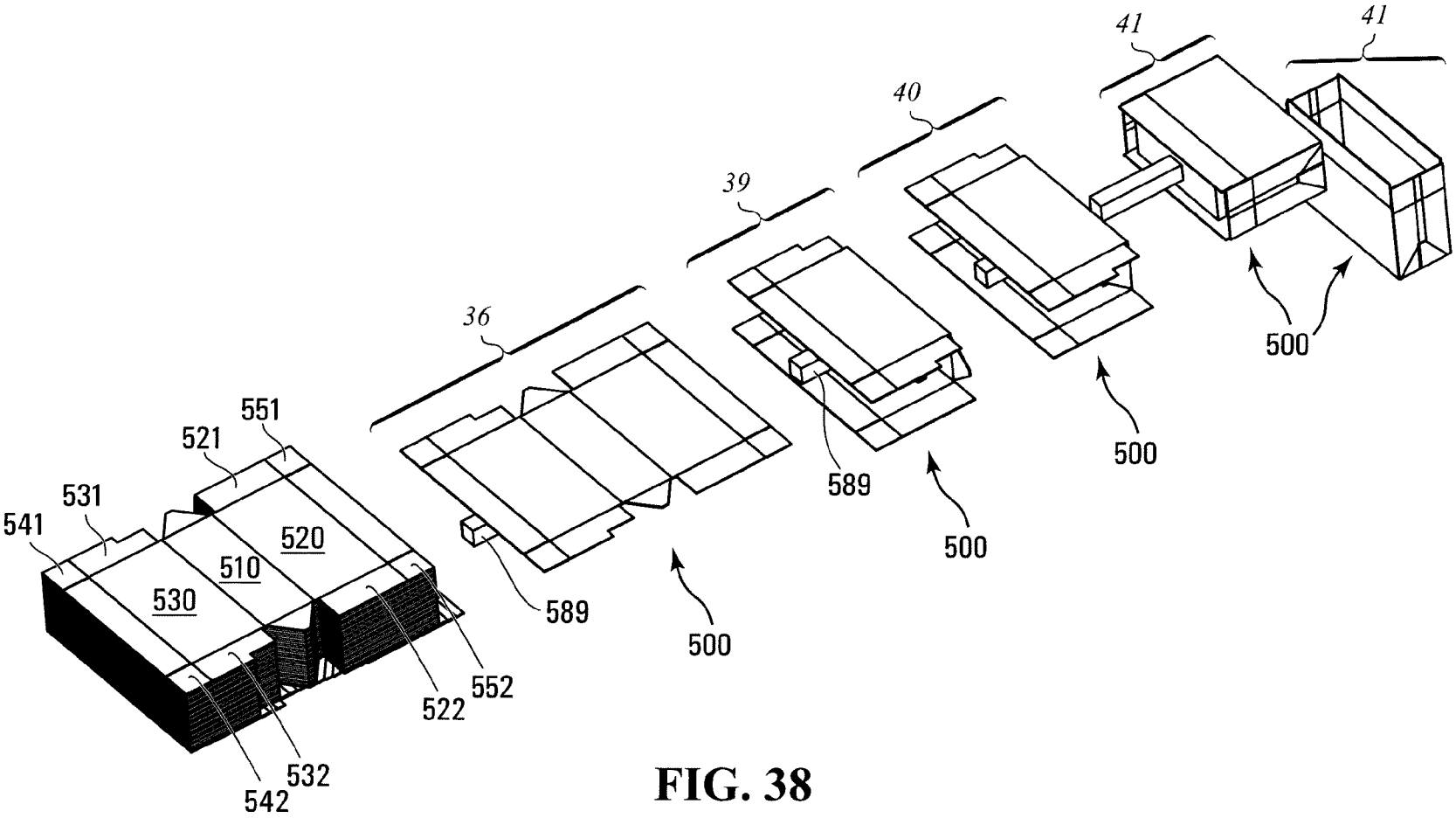
FIG. 38 is a schematic perspective view illustrating an example process by which a DSS-RSC blank such as the blank in FIG. 36 can be erected into a case.
Figure 39:
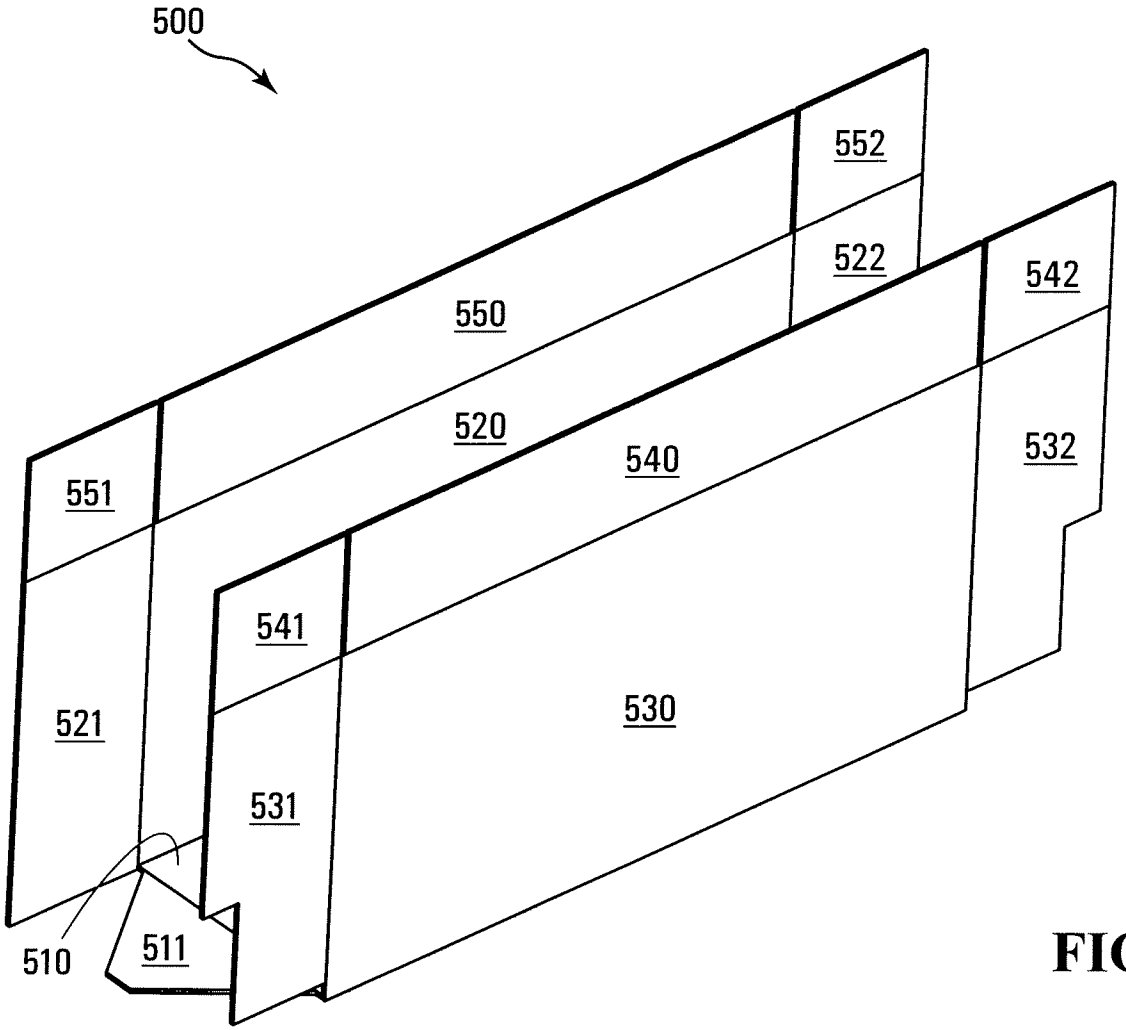
FIGS. 39 to 42 are a series of perspective views of a blank such as a blank in FIG. 36 as it progresses through the process of FIG. 38.
Figure 40:
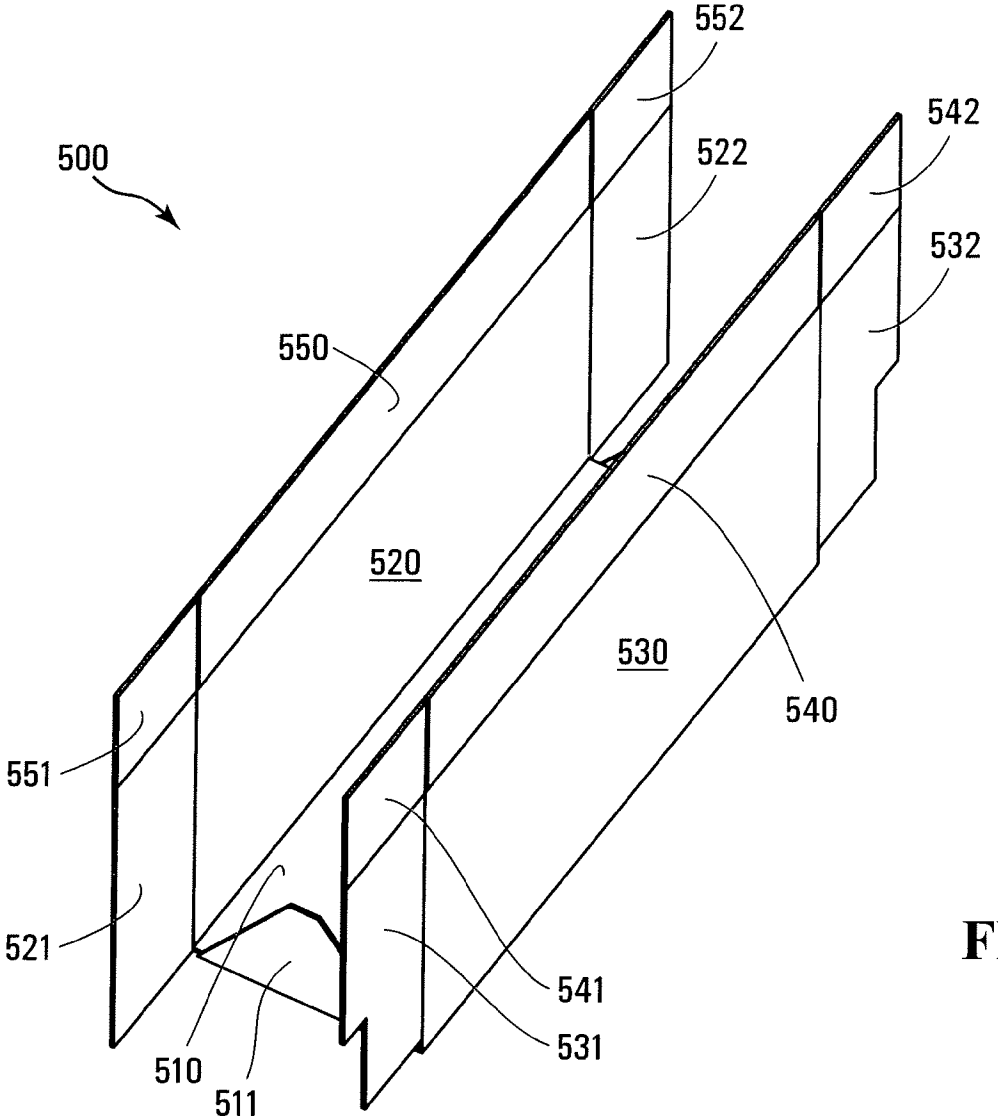
Figure 41:
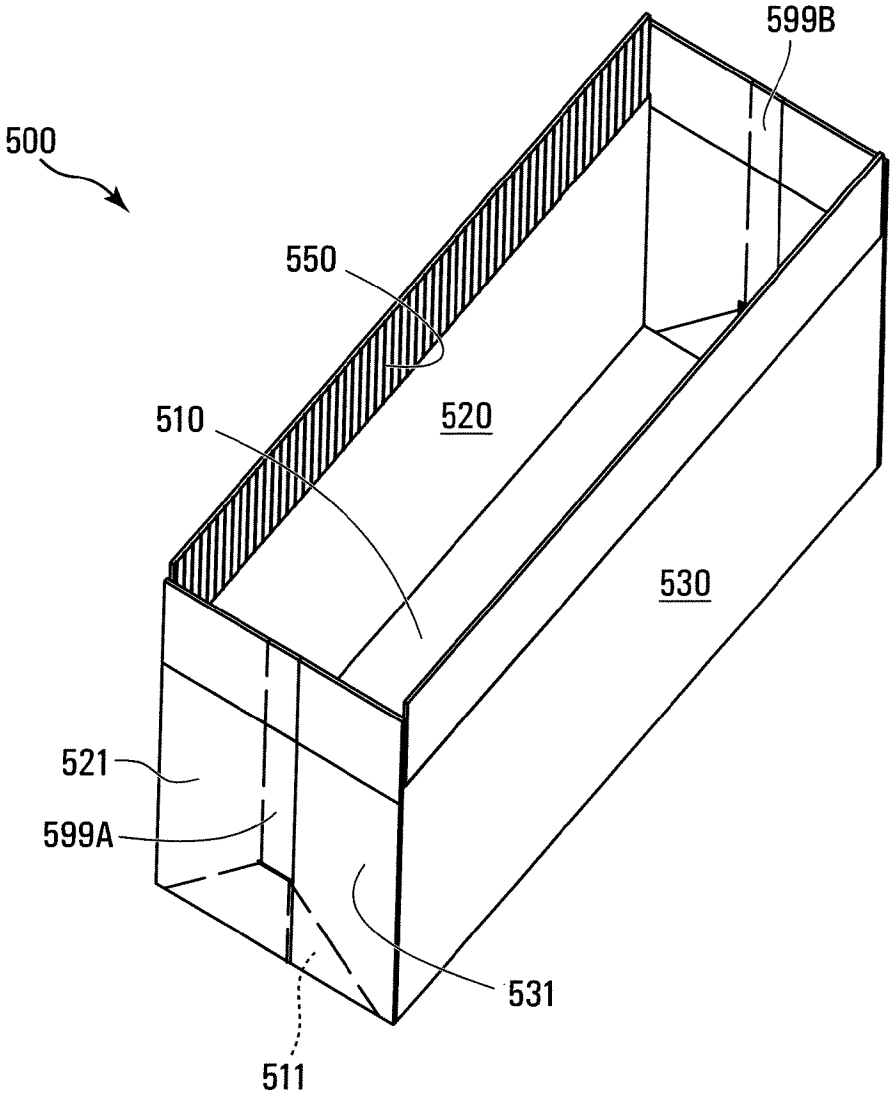

Referring to FIG. 41, the process is the same in forming the alternative embodiment of FIG. 36. With reference now to FIG. 38, the progressive folding of a DSS-RSC blank 500 is shown schematically. The blank 500 progresses from the flat configuration referenced as "36" (referring to FIG. 36) to a folded position referenced as "39" (referring to FIG. 39) to a further folded position "40" (referring to FIG. 40) to a erected configuration referenced as "41" (referring to FIG. 41).

Figure 42:
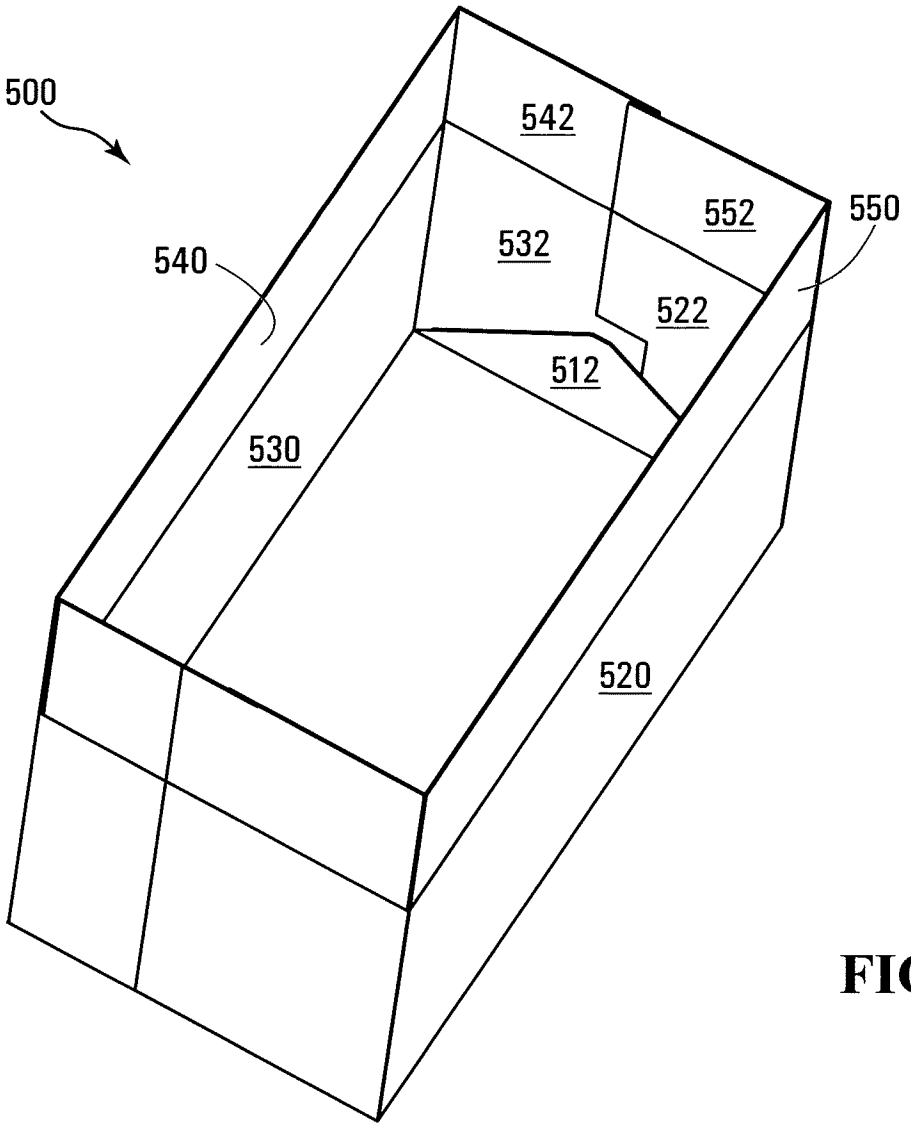

It will however be noted from FIG. 41 in particular, that panels 511, 521 and 531 are to be folded and compressed in such a sequence that the outer facing surface of bottom flap 511 is folded and glued to the inside of both side flaps 521 and 531. Similarly, panels 512, 522 and 532 are may be folded and compressed in such a sequence that bottom flap 512 is folded and glued to the inside of both side flaps 522 and 532. Furthermore, side flaps 521 and 531 may be folded and compressed in such a sequence that side flap 531 is attached to the inside of side flap 521. Similarly, side flaps 522, and 532 are to be folded and compressed in such a sequence that side flap 532 is attached to the inside of side flap 522. The "notch" cut out of panels 531 and 532 and the "wedge" shape of panels 511 and 512 act in such a way that when the case is erected, the tips of the bottom flaps 511 and 512 fit against the outer end flaps 521 and 522 rather than on the inner end flaps 531 and 532. It may be appreciated that the effect of adhesive on the inner surface of flap 521 and/or glue on panel 511, will be to pull and hold panel 511 outwards towards and against outer panel 521 thus drawing the tip of panel 511 into flush relationship with the inner surface of panel 531. Likewise, the effect of adhesive on the inner surface of flap 522 and/or glue on panel 512, will be to pull and hold panel 512 outwards towards and against outer panel 521 thus drawing the tip of panel 512 into flush relationship with inner surface of panel 522. As a result, the tips of panels 511 and 512 have inside surfaces that are generally flush with the inside surfaces of flaps 531 and 532. This makes it easier for product to be inserted inside the case flush with the end walls of the case (i.e. it acts to inhibit product being loaded into the case 500 from being caught on the edge of the bottom flaps 511 and 512). The inside of the case 500 showing the notch and wedge feature can be seen in FIG. 42

Figure 1:
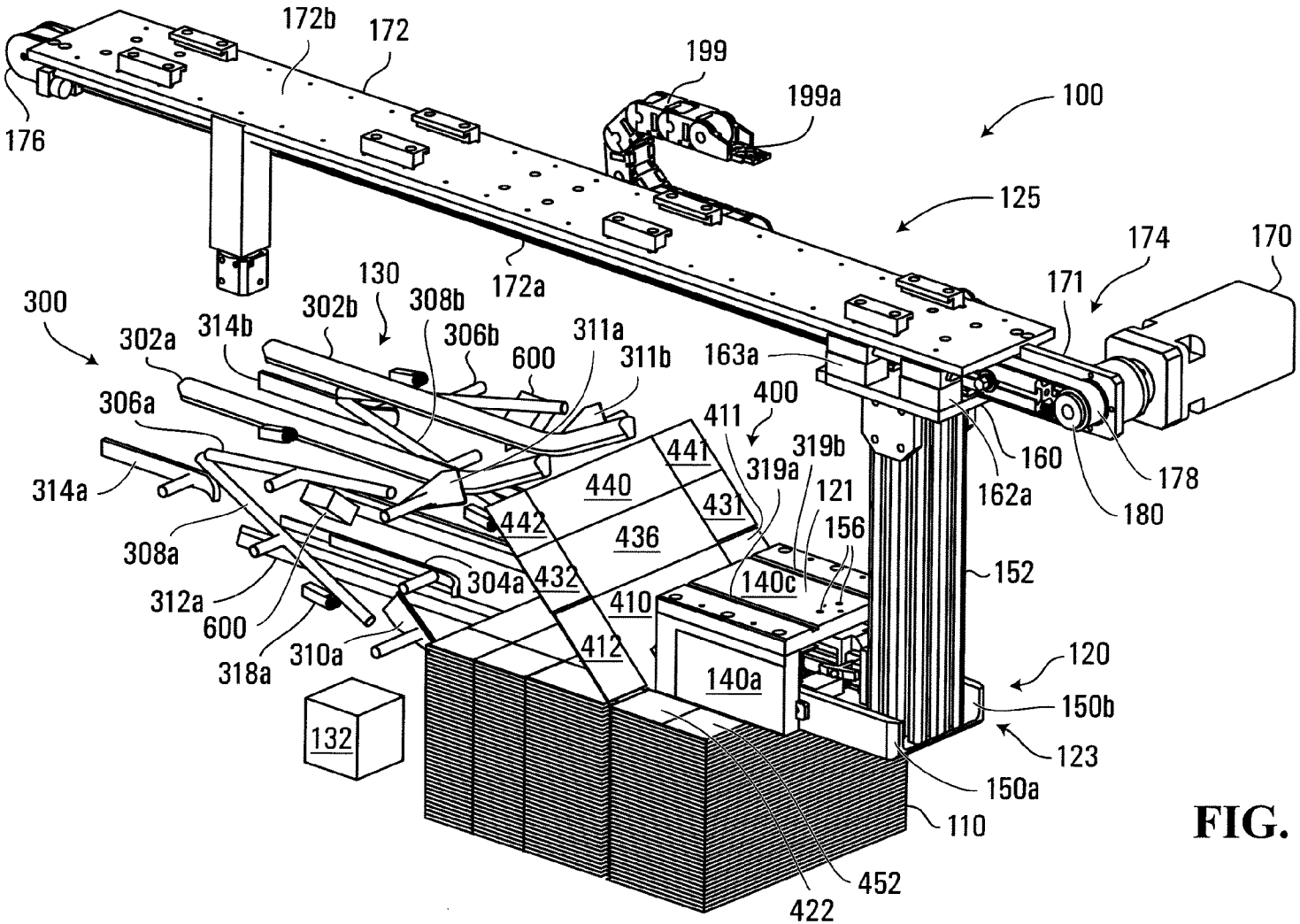
FIG. 1 is a top, left front perspective view of a case forming system in accordance with an example embodiment of the present invention.
Figure 2:
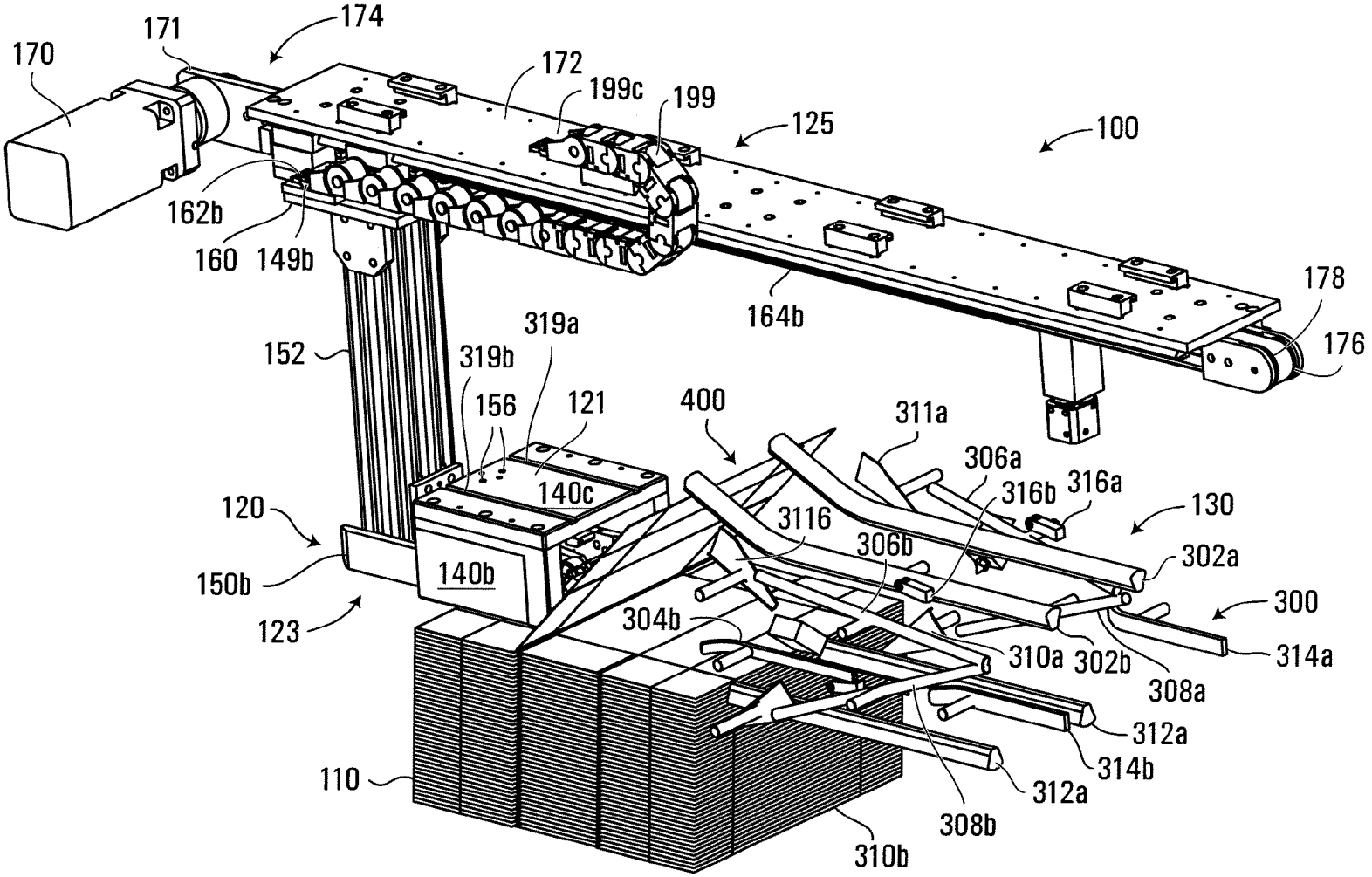
FIG. 2 is a top, right rear side perspective view of the system of FIG. 1.
Figure 3:
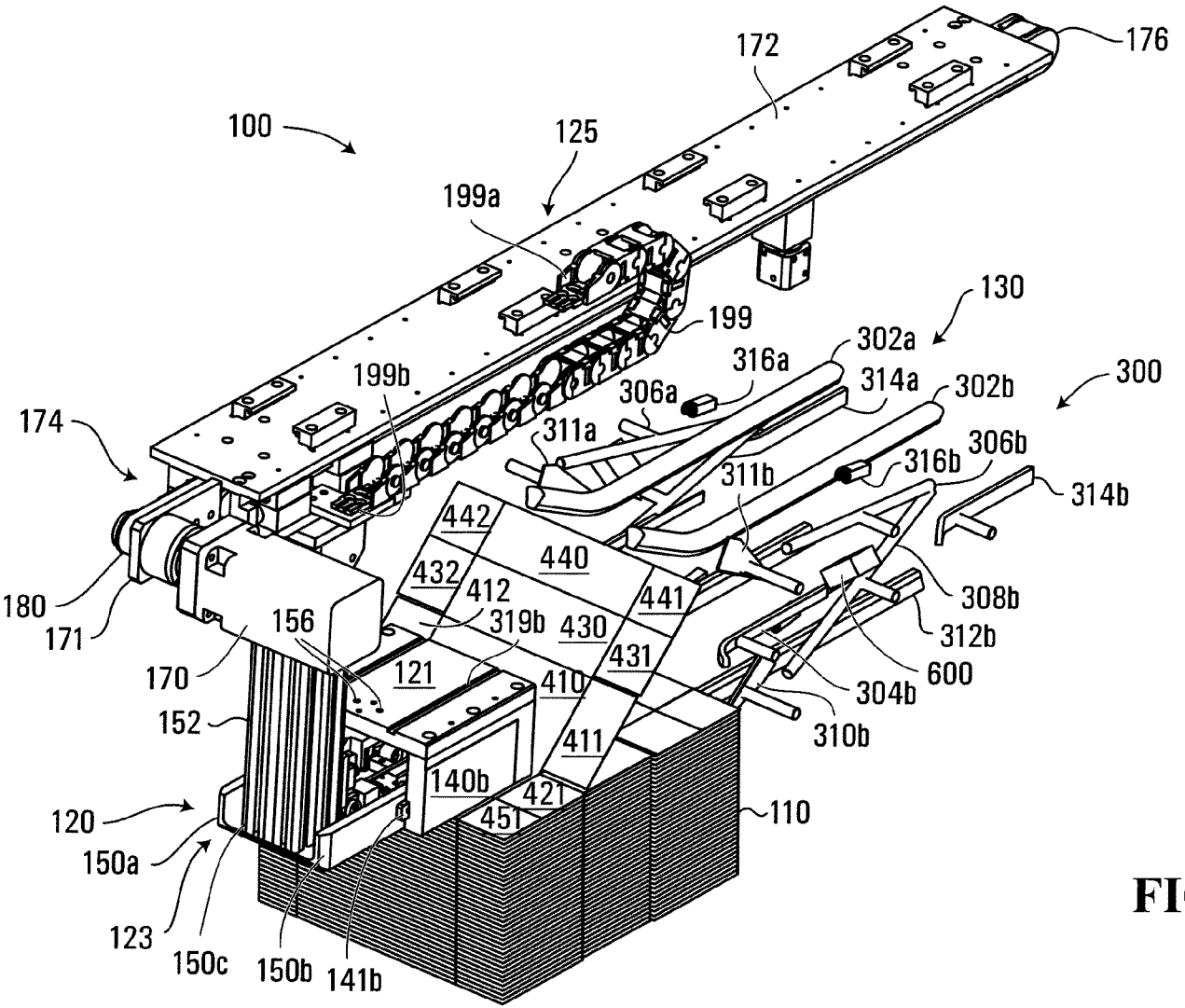
FIG. 3 is a top, right front perspective view of the system of FIG. 1.
Figure 4:
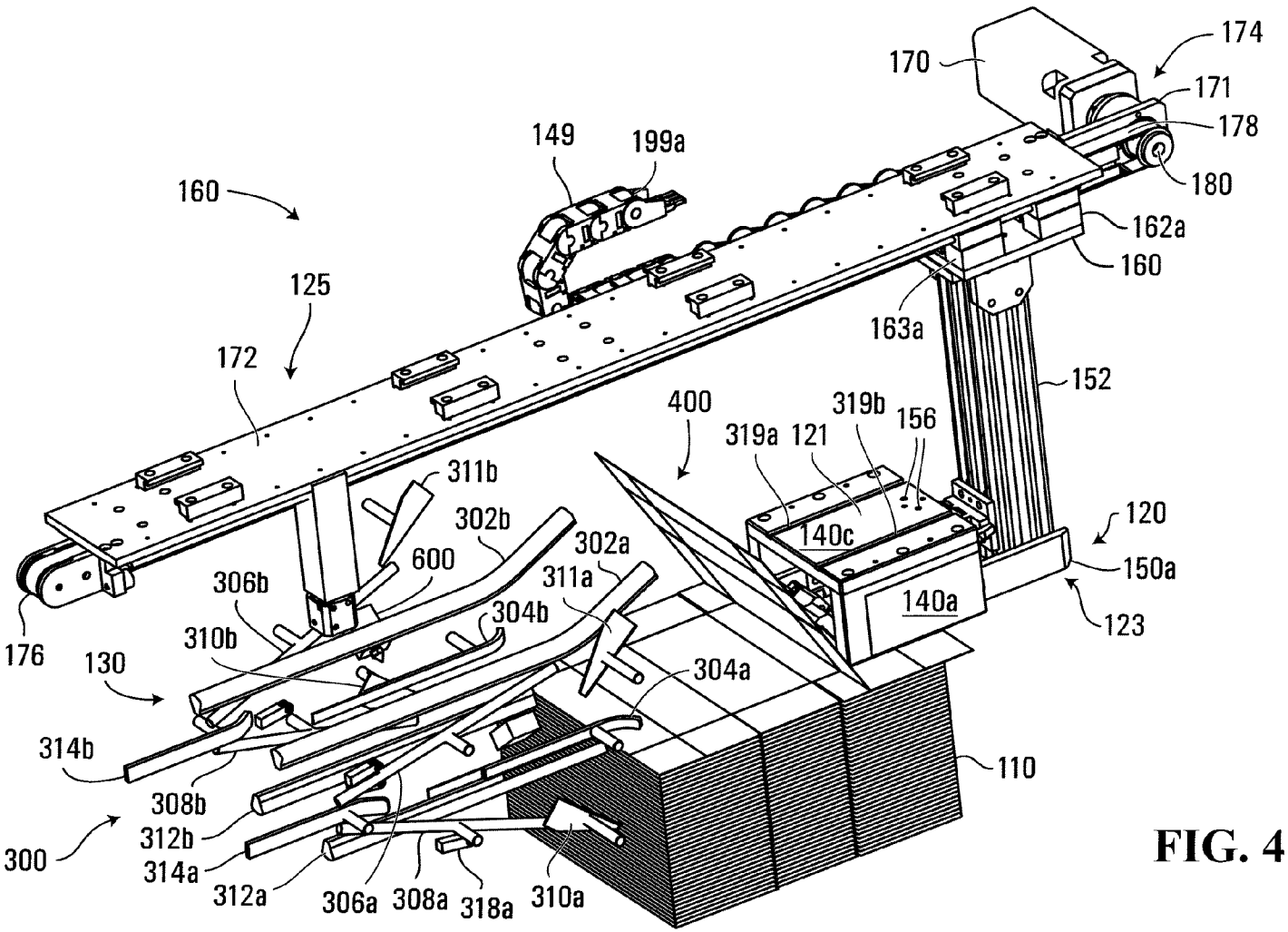
FIG. 4 is a top, left rear perspective view of the system of FIG. 1.
Figure 5:
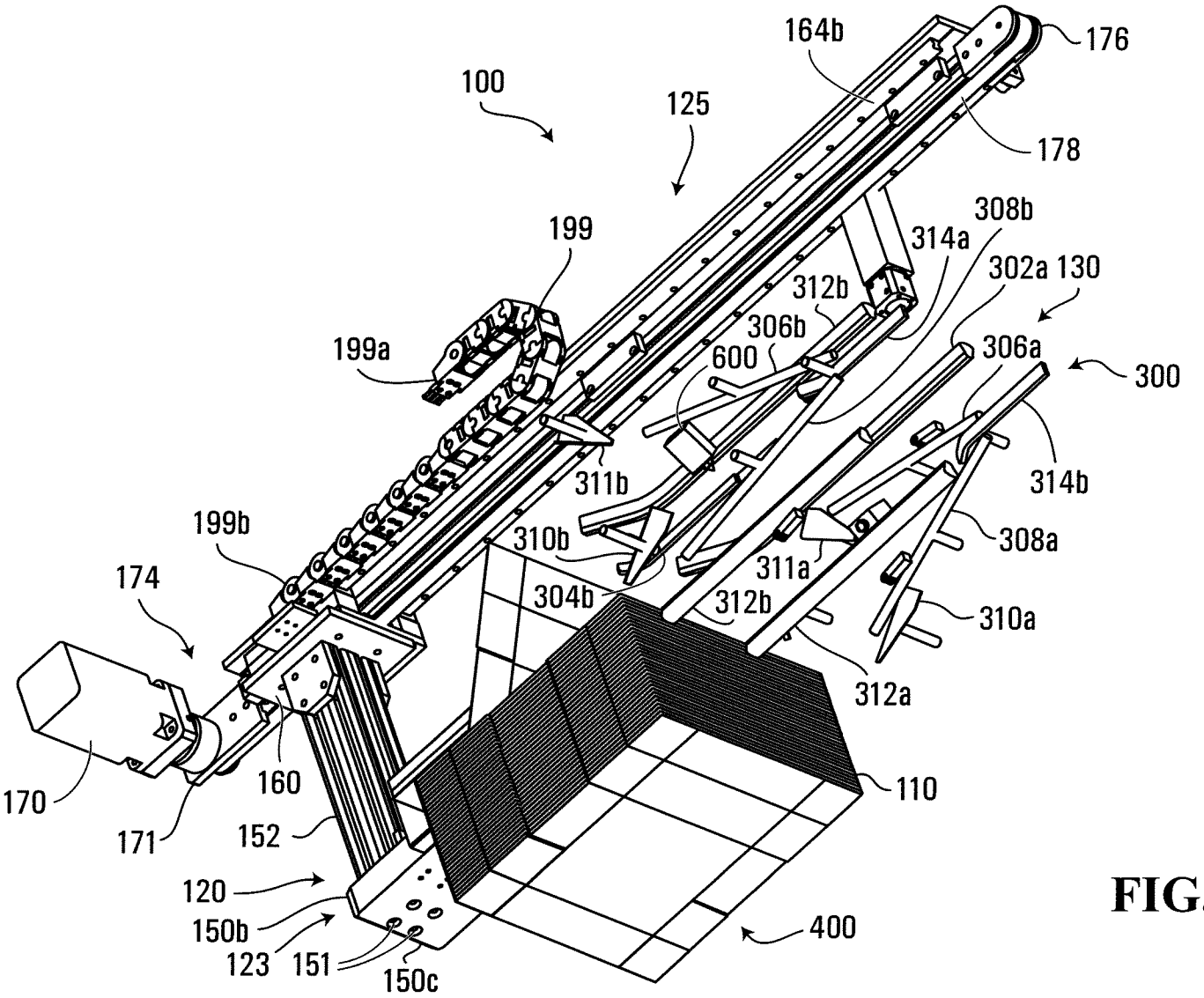
FIG. 5 is a bottom, right rear perspective view of the system of FIG. 1.
Figure 6:
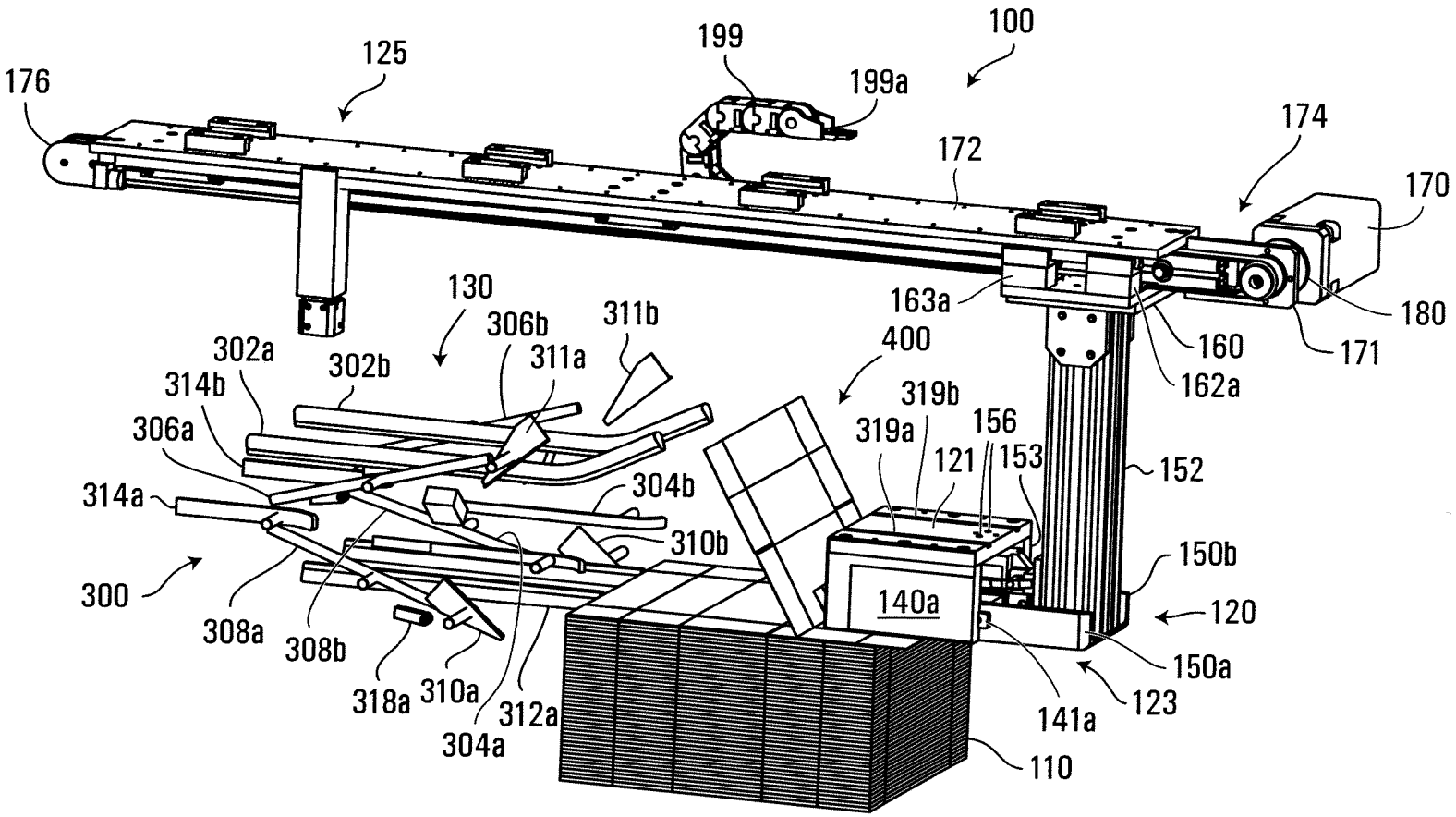
FIGS. 6 to 18 are various additional perspective views of the system of FIG. 1, illustrating the sequential forming of a case from a blank using the system of FIGS. 1 to 5.
Figure 7:
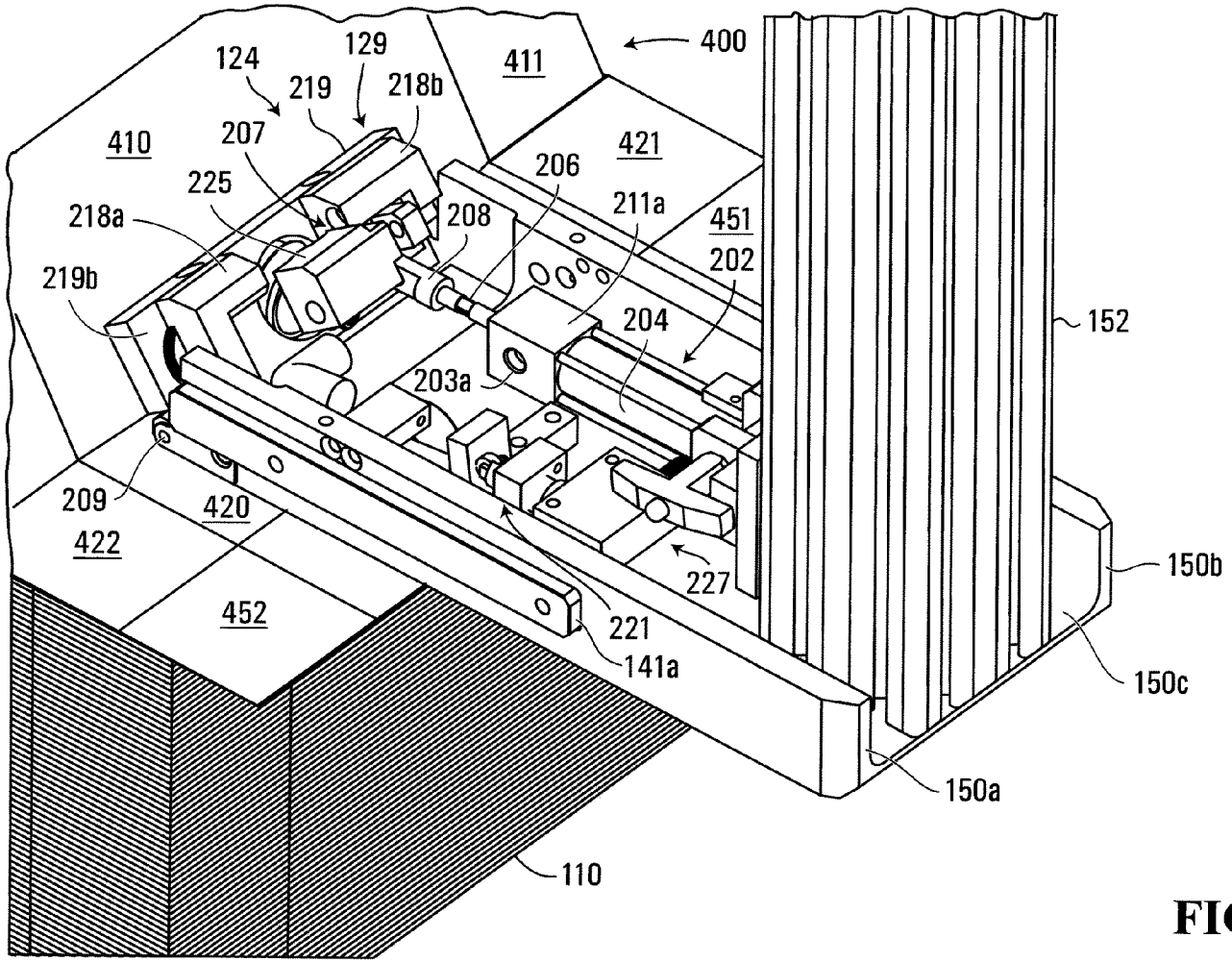

With brief reference to FIGS. 1-2, a case forming system 100 is disclosed that may be used in the processes illustrated in FIG. 32 or 38. System 100 may include a magazine 110 adapted to hold a plurality of blanks 400—that may equally be blanks 500—in a substantially flat orientation. System 100 may also include a mandrel apparatus 120, a panel rotating apparatus 124, and a panel folding and guide apparatus 130. The operation of case forming system 100 may be controlled by a programmable logic controller ("PLC") 132 (only shown schematically in FIG. 1). PLC 132 may for example be a model from the Micrologix family made by Allen-Bradley.

Referring again to FIG. 30, illustrating a top view of the dual side seam-regular slotted container ("DSS-RSC") blank 400, the blank is scored and cut to form the bottom 410, side walls 420 and 430, and major cover panels 440 and 450. Each of the bottom and side walls is provided with a panel extending from each side of the bottom and side walls. The side panels 421, 422, 431 and 432 extend out from each side wall to a distance equal to slightly more than ½ of the width of the bottom 410. The bottom panels 411 and 412 extend out from the bottom such that when the case is erected, these bottom panels may reinforce the end walls at the bottom. Each of the side panels 421, 422, 431 and 432 have a minor top panel extending from the top of the side panel. These minor top panels are numbered 441, 442, 451, and 452 in FIG. 30. However, in other embodiments, containers having other side panel configurations can be formed.

The panels are connected/joined to adjacent panels/panels by predetermined fold/crease lines. The effect of the fold line is such that when one panel such as for example panel 410 is folded relative to an adjacent panel such as 420 or 430, the panels may tend to rotate relative to each other along the fold lines separating the two panels.

In the alternative DSS-RSC blank 500 of FIG. 36, bottom panels 511 and 512 extending from the bottom of the case are cut into a triangular-shaped "wedge" instead of remaining in a rectangular shape as in FIG. 30. Side panels 531 and 532 have a portion cut out (a "notch") extending from the bottom of the panel up a distance at least equal to the length that the bottom panels 511 and 512 extend from the bottom panel 510.

As will be described hereinafter, the DSS-RSC blank 400 or 500 may be folded to form the desired case configuration for a top loading case that can be delivered to a case loading conveyor. The various walls and panels provide material that can, in conjunction with a connection mechanism (such as for example with application of an adhesive or a mechanical connection) join or otherwise interconnect walls/panels to adjacent walls/panels, to hold the case in its desired configuration.

In a preferred embodiment, the DSS-RSC blank may be made of a suitable corrugated material such as a corrugated fibreboard. In order to maximize the stacking strength of the DSS-RSC design, the blank may be oriented on the fiberboard such that the internal columns in the corrugation run vertically up the walls of the case. This orientation of the corrugation can be seen in FIG. 30.

Referring back to FIG. 28, while there may be other apparatus or systems that may be able to erect a DSS-RSC blank, such as a blank 400 or blank 500, into an erected DSS-RSC case pursuant to step 1030, the systems illustrated in FIGS. 1-26 are well suited for such a purpose.

Returning to system 100 of FIGS. 1-2, magazine 110 may be configured to hold a plurality of case blanks 400 (or blanks 500) in a vertically stacked, flat configuration, and be operable to move the stack of case blanks 400 sequentially upwards under the control of PLC 132, so that single case blanks 400 may be retrieved from the stack for processing by a panel retrieval and rotating apparatus generally designated as 124 that forms part of mandrel apparatus 120. Various specific constructions of a suitable magazine that might be employed in system 100 would be evident to a person skilled in the art. The magazine may comprise a large number of case blanks 400 held in a vertical stack by aluminium rails (the rails are not shown in the drawings). In this configuration where blanks are retrieved from the top of a stack, the stack of blanks in the magazine is moved upwards from the bottom by a PLC controlled motor (not shown in drawings). The purpose of moving the stack of blanks upwards as cases are formed is so that the top case is always close against the bottom of the mandrel. The front panels of the top blank are then rotated around the mandrel by the panel rotation apparatus 124. As cases are taken and formed, the PLC may move the entire stack up sequentially so that the top case is always maintained close to the mandrel 121.

Figure 10:
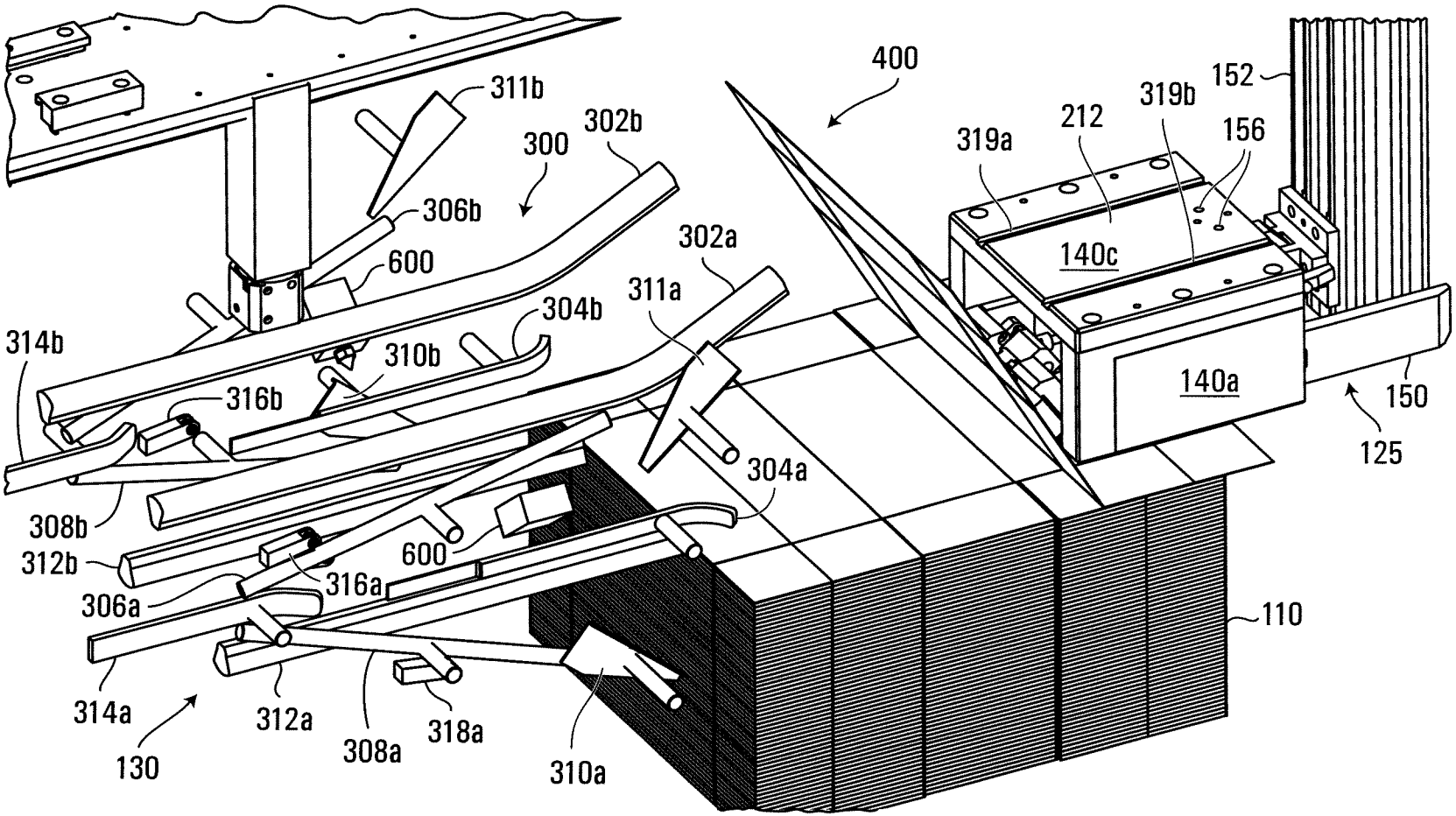
Figure 11:
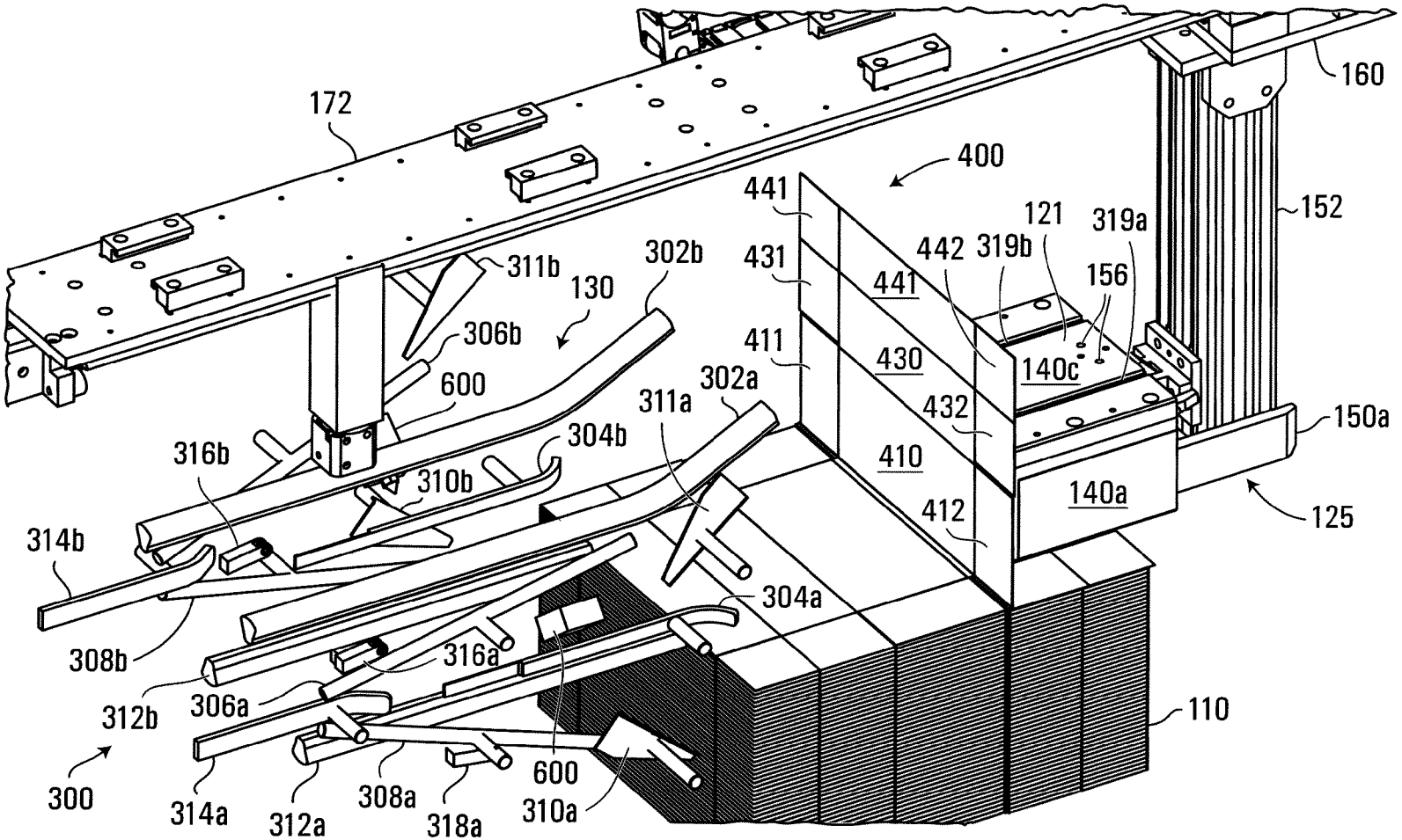
Figure 12:
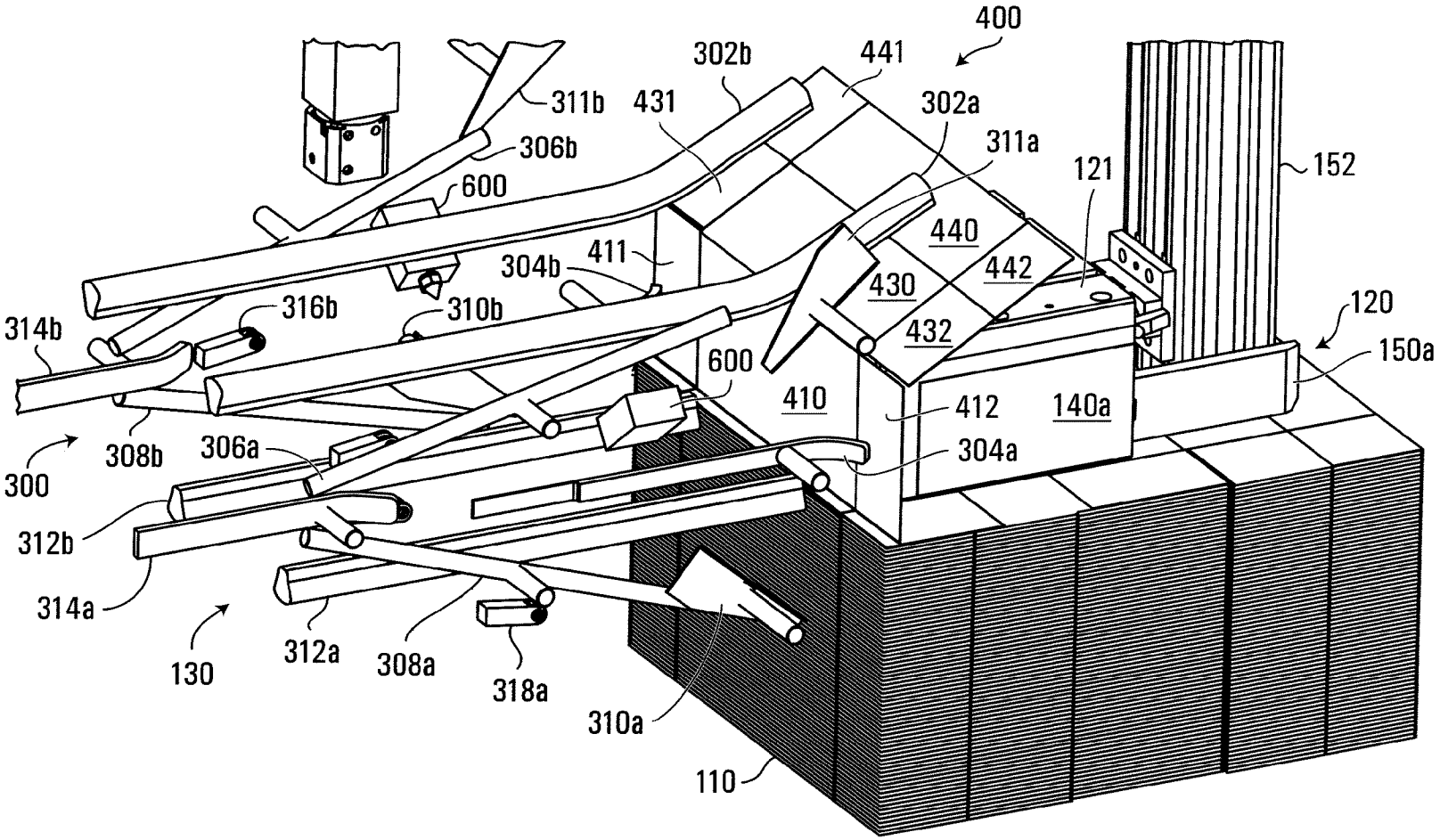

The mandrel apparatus 120 may have several additional components including a mandrel 121, a mandrel support frame 123 and a mandrel movement and support apparatus generally designated 125. With particular reference to FIGS. 1, 10 and 11, mandrel 121 comprises a pair of opposed, spaced, vertically and longitudinally oriented side plates 140*a*, 140*b* interconnected to and joined by a horizontally oriented top plate 140*c*. A mandrel 121 may be generally configured in a variety of different sizes and shapes, each selected for the particular case blank 400 that is being formed into a case. The dimensions of the outer surfaces of mandrel 121 may be selected so that the specific case blank that it is desired to fold has during the forming process, fold/crease lines that are located substantially at or along the opposite side edges and the upper and lower front edges of mandrel 121. Such a selection may improve the performance of system 100 in creating a formed case that is ready for loading with items. System 100 may be configured to permit for the easy interchange of mandrels 121 so that the system can be readily adapted to forming differently sized/shaped cases from differently configured blanks.

Figure 8:
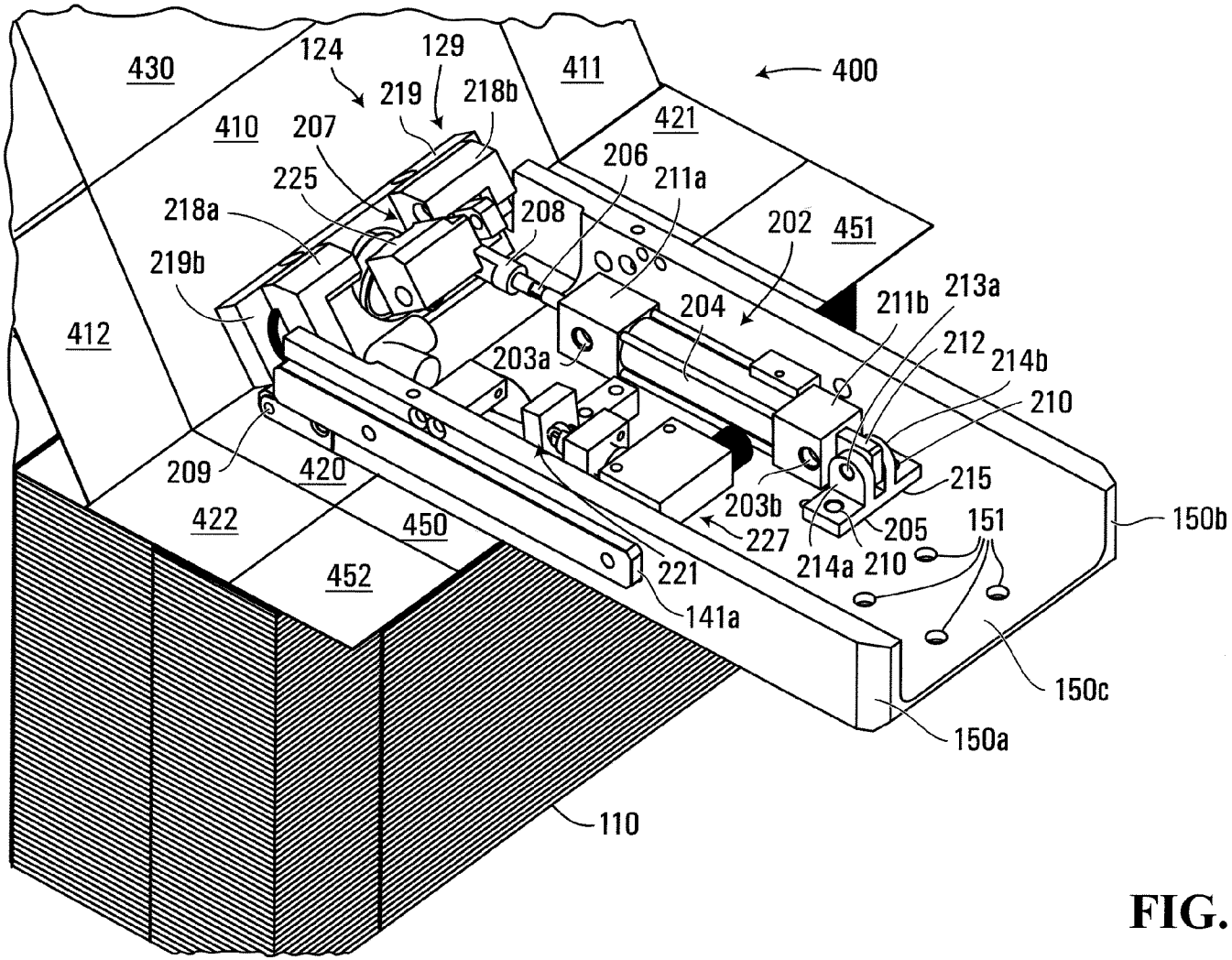
Figure 9:
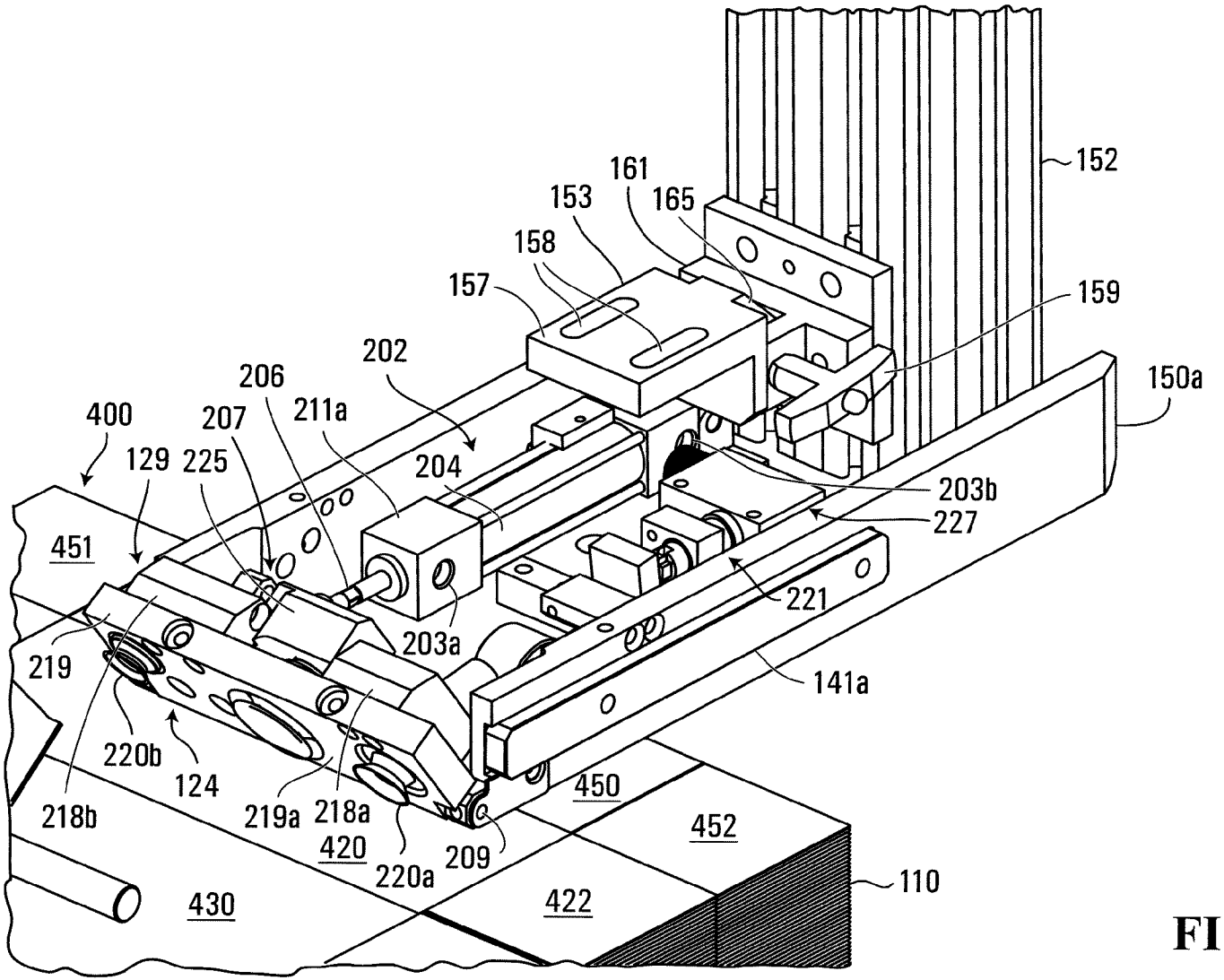

With particular reference to FIGS. 1, 8 and 9, mandrel 121 may be supported by mandrel support frame 123, which may include a pair of spaced opposed elongated and longitudinally extending side plate members 150*a* and 150*b*. Side plates 150*a*, 150*b* may be interconnected by and joined to a lower horizontally oriented plate 150*c*. Side plates 150*a*, 150*b* and lower plate 150*c* may be integrally formed together. Side plates 150*a*, 150*b* may be interconnected to respective side plates 140*a*, 140*b* of mandrel 121, with mandrel mounting brackets 141*a* and 141*b*, thus providing support for mandrel 121. Mandrel side plates 140*a* and 140*b* may for example contain a groove or channel on their inner surface for receiving mandrel support brackets or rails 141*a*, 141*b* respectively (see for example FIG. 18) so that the mandrel 121 can be supported by the mandrel support frame 123 and may be generally restrained from vertical and transverse motion. To assist in securing the vertical and transverse movement, as well as to select the appropriate longitudinal position and restrain the mandrel 121 from longitudinal movement, mandrel top plate 140*c* may be mounted to and above a mandrel support base 153.

Mandrel support frame 123 may be interconnected and supported by a vertical frame support member 152 (see for example FIGS. 1 and 9). For example, with reference to FIG. 8, lower support plate 150*c*, may have screw holes 151 which may enable screws (not shown) to pass upwards through plate 150*c* into threaded holes (not shown) in a lower horizontal surface of vertical support member 152. Vertical support member 152 may be conveniently formed from a light but relatively strong material that can be readily formed into a tube, such as for example aluminium. Vertical support member 152 may be formed as a hollow channel member that has a longitudinally extending cavity that allows for electrical and communication cables and pressurized/vacuum air hoses to pass through from an upper end to a lower end. In this way, electrical power/communication cable and air hoses can deliver power, electrical signals and air to the mandrel support frame 123 and the panel rotating apparatus 124.

For example, with reference to FIG. 9, mandrel support base 153 may also be interconnected and supported by vertical frame support member 152, with support base 153 being mounted to a lower, forward facing surface area of support member 152 by for example bolts/screws.

Vertical member 152 also has an upper end portion that is interconnected to a horizontal connector member 154 for interconnecting the vertical member 152 (and the mandrel apparatus attached thereto) to the mandrel moving apparatus 125. Connector member 154 may be configured as a plate that interconnects to a corresponding slider plate 160 on mandrel moving apparatus 125. Connector member 154 may be bolted to plate 160 and may be interconnected to vertical member 152 with bracket support member (see for example FIGS. 1, 4 and 6).

With particular reference to FIG. 9, mandrel support base 153 is generally L-shaped and has an upper horizontal support member plate 157 and a vertical attachment leg portion 165. A quick release key bolt member 159 is provided for securing leg portion 165 to a generally U-shaped bracket member 161 that is secured to attachment plate 155 located on a forward facing surface of vertical support member 152. Key bolt 159 may pass through apertures in bracket member 161 and leg portion 165 of support base 153. Mandrel top plate 140*c* may be connected to support plate 157 using bolts or screws (not shown) that may pass through apertures 156 in mandrel top plate 140*c* (see FIG. 2), into longitudinally oriented slots 158 that pass through support plate 157. Thus, the longitudinal position of mandrel 121 relative to support frame 123 and rotating apparatus 124 can be selected by the appropriate setting of the screws in slots 158. Quick release key bolt device 159 may be used to provide for the rapid and tool free attachment and release of mandrel 121 to and from vertical frame support member 152.

Attachment of the mandrel 121 to vertical support 152 via mandrel support base 153 generally restrains mandrel 121 from movement in the longitudinal direction relative to support frame 123 and rotating apparatus 124.

Mandrel support and moving apparatus 125 may be used to support and move in reciprocating forward and rearward longitudinal movement, mandrel 121, rotating apparatus 124, vertical support member 152 and mandrel support frame 123. The mandrel moving apparatus 125 may be mounted to a support frame (not shown) with a plurality of mounting blocks 166 that are connected to a longitudinally extending guide rail support member 172 of moving apparatus 125. Also comprising part of moving apparatus 125, guide slide rails 164*a*, 164*b* may be mounted to opposite side edge faces 172*a*, 172*b* respectively of support member 172. Slider plate 160 may have mounted thereto, opposed sets of slide blocks 162*a*, 163*a*, and 162*b*, 163*b* (see FIGS. 1 and 2). Each of the slide blocks 162*a*, 163*a*, and 162*b*, 163*b* may have inwardly facing arcuate surfaces which may engage portions of their respective guide rails 164*a*, 164*b*. Slide blocks 162*a* and 163*a* may be supported by and slide along guide rail 164*a*. Slide blocks 162*b* and 163*b* may be supported and slide along guide rail 164*b*. The slide blocks and guide rails may be made of complimentary materials that allow for smooth and easy sliding of the blocks along the guide rails. For example, slide blocks may be made of aluminium and guide rails 164*a*, 164*b* may be made of stainless steel.

Moving apparatus 125 also includes a mandrel drive device 174 which may include a continuous horizontally oriented drive belt 178 that extends between and rotates around a pulley 176 and a drive wheel 180. Drive wheel 180 may be driven in both rotational directions and at varying speeds by the drive shaft of a servo drive motor 170. The operation of drive motor 170 may be controlled by PLC 132 in combination with a position sensing apparatus (not shown) so that PLC 132 can determine when and how to operate drive motor 170 to appropriately position the drive belt 178 and thus moving apparatus 125. Drive motor 170 may be mounted at an end portion of support member 172 with a vertically oriented connector plate 171.

To interconnect the drive belt 178 to slider plate 160 and/or sliding blocks 162*a-b*, 163 *a-b* known attachment apparatus or mechanisms can be provided. For example, a clamp can be mounted to plate 160 and the belt 178 can be secured between clamp arms of the clamp. Thus, when the drive belt moves longitudinally, in parallel longitudinal, vertical and horizontal alignment with the guide rails 164*a*, 164*b*, the slide plate 160 and sliding blocks 162*a-b*, 163*a-b* can also move in the same direction. The result is that the mandrel support frame 152 and thus mandrel 121 can also be moved longitudinally, in parallel longitudinal, vertical and horizontal alignment with rails 164*a*, 164*b*.

Also associated with moving apparatus 125 is a caterpillar device 199. Caterpillar 199 has a hollow cavity extending along its length. Within the cavity of caterpillar 199 hoses carrying pressurized air/vacuum and electrical/communication wires can be housed. Caterpillar 199 allows such hoses and wires to move longitudinally as the mandrel support member 152 and thus mandrel 121 and mandrel support frame 123 are moved longitudinally by moving apparatus 125. The hoses and wires may extend from external sources to enter at an inlet 199*a* of caterpillar 199 and emerging at an outlet 199*b*. Once leaving outlet 199*b*, the hoses and wires may pass into the internal cavity of vertical member 152 (see FIG. 2). An example of a suitable caterpillar device that could be employed is the E-Chain Cable Carrier System made by Ignus Inc.

The next component of system 100 to be described in detail is the panel rotating apparatus 124. Panel rotating apparatus 124 may engage one blank 400 and may be employed to rotate one or more panels of blank 400 relative to one or more other panels. For example, as illustrated in FIGS. 9-11, panels 410, 411, 412, 430, 431, 432, 440, 441 and 442 of a blank 400 are rotated approximately 90 degrees relative to panels 420, 421, 422, 450, 451 and 452 from a generally flat orientation to a generally vertical orientation. Panel rotating apparatus 124 may include a panel rotation unit 129. The movement of unit 129 can be controlled by PLC 132 in such a manner that it can rotate so as to move a panel 410 (and attached panels 411, 412, 430, 431, 432, 440, 441 and 442) of a case blank 400 through a rotation of approximately 90 degrees, in an aligned manner, at an appropriate time, as is illustrated for example in FIGS. 9, 10 and 11.

Unit 129 will be described in detail, and with particular reference to FIGS. 8 and 9 which for simplicity depict system 100 without mandrel 121. The unit 129 may include a longitudinally oriented piston device 202 which has piston blocks 211*a*, 211*b* that rest on bottom plate 150*c*. Piston block 211*b* has a vertical attachment leg portion 212. A mounting block 205 with opposed generally vertical longitudinally oriented plates 214*a*, 214*b* and generally horizontal transversely oriented plate 215 is positioned at and connected to a rear end of reciprocating piston 202 with a screw (not shown) that passes through an aperture in leg portion 212 (not shown) and apertures 213*a*, 213*b* in vertical plates 214*a*, 214*b* respectively. Mounting block 205 is also mounted to plate 150*c* with screws (not shown) that pass through apertures 210 in horizontal plate 215 into the plate 150*c*.

Piston 202 may be a conventional pneumatic reciprocating cylinder 204 and is operable to move in a reciprocal movement between a fully extended position (not shown) and a retracted position (not shown). This reciprocating motion can be achieved in known ways such as for example, by using a double acting cylinder, which can for example, channel compressed air to two different chambers which in turn provides interchanging forward and backward acting forces on the piston 202. Piston 202 may for example be a DSNU made by Festo. Compressed air may be delivered to piston 202 by hoses (not shown) passing from vertical support member 152 out to connect with apertures 203*a*, 203*b*.

To channel the compressed air appropriately, valves (not shown) can be driven between open and closed positions by solenoids responsive to signals from PLC 132 (FIG. 1). The valves could be located proximate the piston 202 or be disposed elsewhere. Electrical lines carrying signals from PLC 132 could also pass through vertical member 152 to operate the valves.

A piston rod 206 of piston 202 is provided with an extended arm portion 208 that provides for a hinge connection 207 for pivoting the panel rotating apparatus 124 between a generally horizontal position and a generally vertical position.

Panel rotation apparatus 124 also comprises panel rotating plate 219 with outer and inner face 219*a* and 219*b* respectively. Panel rotating plate 219 may be attached by way of piano hinge 209 to forward lower extension of lower support plate 150*c* of mandrel support frame 123. As a result of the movement of piston 202 the cylinder rod 206, may extend or retract allowing the arm 208 to pivot relative to rotating apparatus 124. The movement of piston rod 206 thus causes the panel rotating plate 219 to rotate through a certain angular distance relative to mandrel 121 around piano hinge 209.

Air suction cups 220*a* and 220*b* may be fixedly mounted to outer or forward facing face 219*a* of panel rotating apparatus plate 219 with mounting block units 218*a*, 218*b* respectively. Air suction cups 220*a* and 220*b* may be interconnected through block units 218*a*, 218*b* to a source of vacuum by providing for an air channel linked to a manifold unit 225. The manifold unit 225 may in turn may be interconnected by air vacuum supply hose (not shown) to a pressurized air distribution unit generally designated 227. Unit 227 may include a plurality of valves that may be operated by PLC 132 and may also include a vacuum generator apparatus 221. If a vacuum generator is utilized, pressurized air may be delivered from an external source through vertical support member 152 to unit 227. The vacuum generator may then convert the pressurized air to a vacuum that can then be delivered to suction cups 220*a*, 220*b*.

The air suction force that may be developed at the outer surfaces of suction cups 220*a* and 220*b* of unit 124 may be sufficient so that when activated they can engage, hold and rotate panel 410 of a blank 400 from a generally horizontal position to the position shown in FIG. 11. The vacuum generated at suctions cups 220*a* and 220*b* can also be de-activated by PLC 132.

The suction cups 220*a* and 220*b* of unit 124 may engage the surface of panel 410. In other embodiments suction cups of rotation units may alternatively, or in combination also, engage panel 430. The particular arrangement of suction cups on rotating plate 219 can be designed based upon the configuration of the case blank and the particular panels that need to be rotated. It may also be appreciated that in the panel rotation apparatus 124, suction cups are used to apply a force to hold and/or move a panel of a case blank. However alternative engagement mechanisms to suction cups could be employed. It should also be noted that a second set of suction cup/suction plates mounted for movement, including pivoting movement, could be deployed to perform additional panel folding or movement and/or holding of the panel and blank.

More generally, other types of apparatus may be employed to transfer a blank 400 to the mandrel apparatus 120, such that one portion of the blank may be rotated, preferably about ninety degrees, relative to another portion of the panel, to set-up the folding process using a folding apparatus.

With particular reference to FIGS. 12-18, system 100 may also include a panel folding and guide apparatus 130, that may be a rail and plough apparatus generally designated 300. Rail and plough apparatus 300 is configured to cause the appropriate panel and sealing panels of a blank 400 to be appropriately folded and sealed to produce a case configuration that is suitable for delivery to a case conveyor (not shown). Apparatus 300 may, as shown in the figures, include a plurality of rails and plough devices. Each of the rails and plough devices of apparatus 300 may be supported by rods or bars interconnected to a support frame (not shown for simplicity in the figures).

Apparatus 300 may include a pair of spaced, longitudinally extending overhead rails 302*a*, 302*b* configured and positioned so that as blank 400 is moved longitudinally forward by mandrel apparatus 120, rails 302*a*, 302*b* may fold panel 430 and attached panels 431, 432, 440, 441 and 442, from a generally vertical orientation to a generally horizontal orientation.

A pair of opposed inner side rails 304*a*, 304*b* are configured and positioned to engage bottom panels 411 and 412 respectively and may fold and maintain the panels 411 and 412 in a rearward longitudinal direction, until side end panels 421, 422, 431 and 432 and attached panels 451, 452, 441 and 442 have been brought into an upward vertical and overlapping relationship.

Apparatus 300 may also include a pair of opposed wedge plough devices 311*a*, 311*b* that may be configured and positioned so that as blank 400 is moved longitudinally forward by mandrel apparatus 120, plough devices 311*a*, 311*b* can commence the generally inward folding of side end panels 431 and 432 and attached panels 441 and 442 respectively from a generally horizontal orientation towards a generally vertical orientation. Likewise, apparatus 300 may also include a pair of opposed wedge plough devices 310*a*, 310*b* that may be configured and positioned so that as blank 400 is moved longitudinally forward by mandrel apparatus 120, plough devices 310*a*, 310*b* can commence the generally inward folding of side end panels 421 and 422 and attached panels 451 and 452 respectively from a generally horizontal orientation towards a generally vertical orientation.

Also part of apparatus 300 are a pair of opposed, downwardly and inwardly oriented guide rails 306*a*, 306*b*, that are configured and positioned to take over from plough devices 311*a*, 311*b*, to engage the upper surfaces of panels 431 and 432 and to complete the inward folding of side panels 431 and 432 respectively to a vertical position. Likewise, also part of apparatus 300 are a pair of opposed, upwardly and inwardly oriented guide rails 308*a*, 308*b*, that are configured and positioned to take over from plough devices 310*a*, 310*b*, to engage the lower surfaces of panels 421 and 422 and to complete the inward folding of side panels 421 and 422 respectively to a vertical position.

A pair of lower support rails 312*a* and 312*b* are positioned to assist in supporting blank 400 once it has been removed from the support of the stack of blanks 400 in the magazine 110. It should also be noted that during the forward longitudinal movement of blank 400 as it is pushed by mandrel apparatus 120 through the positions illustrated in FIGS. 15-18, opposed adhesive compression rails 314*a*, 314*b* which are configured and positioned to apply pressure to the end panels of the formed case, to ensure appropriate sealing of the panels and panels with the adhesive.

Adhesive (i.e. glue) applicators such as applicators 600 can be appropriately positioned and their operation may be controlled by PLC 132. Applicators 600 can apply a suitable adhesive such as a hot melt adhesive to various panels so that when the panels are folded as described herein, the panels can be held in the desired case configuration. An example of a suitable applicator that can be employed is the model ProBlue 4 applicator made by Nordson Inc. An example of a suitable adhesive that could be employed with on a case blank 400 made of cardboard is Cool-Lok adhesive made by Nacan Products Limited.

Figure 14:
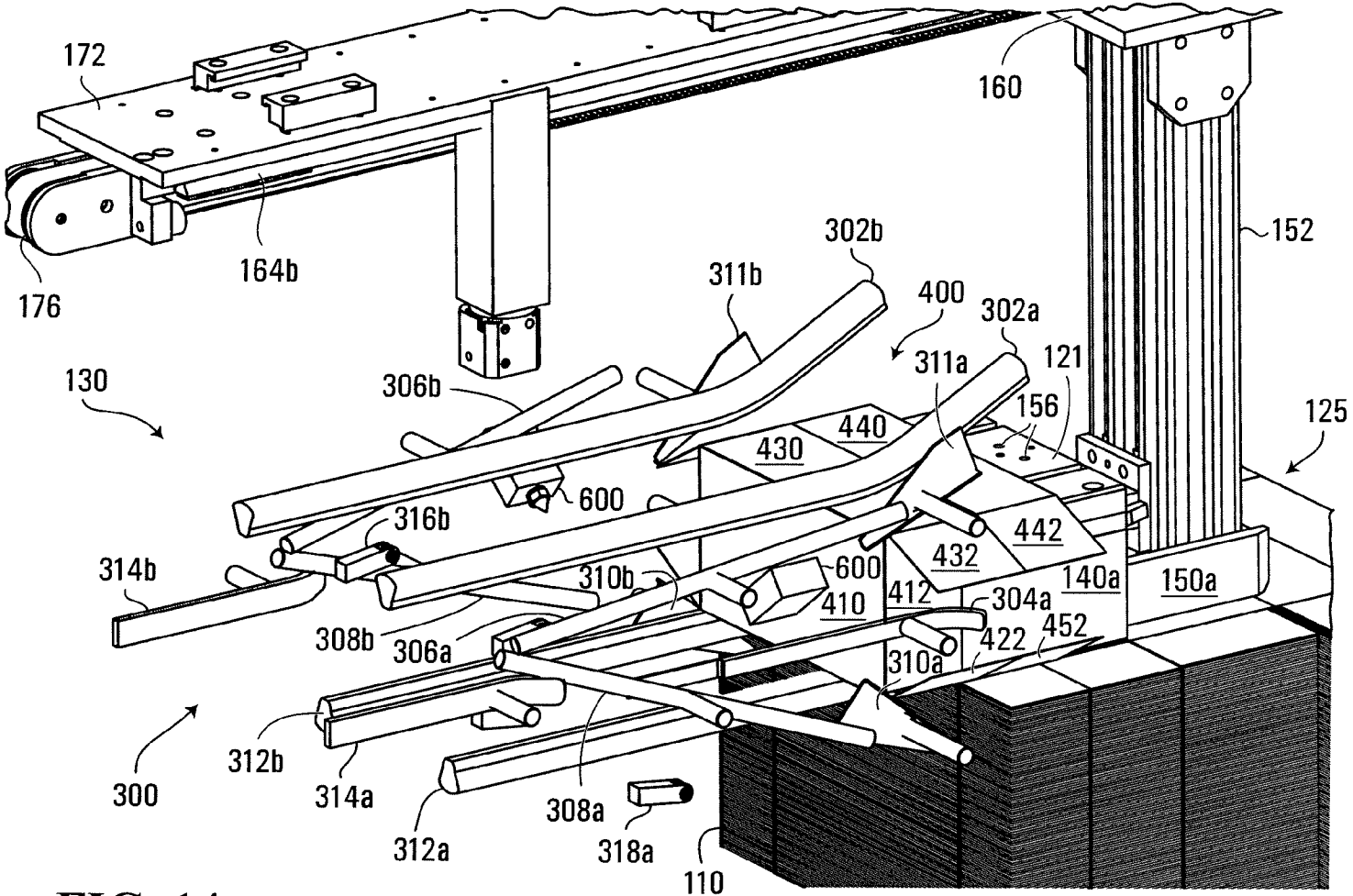
Figure 15:
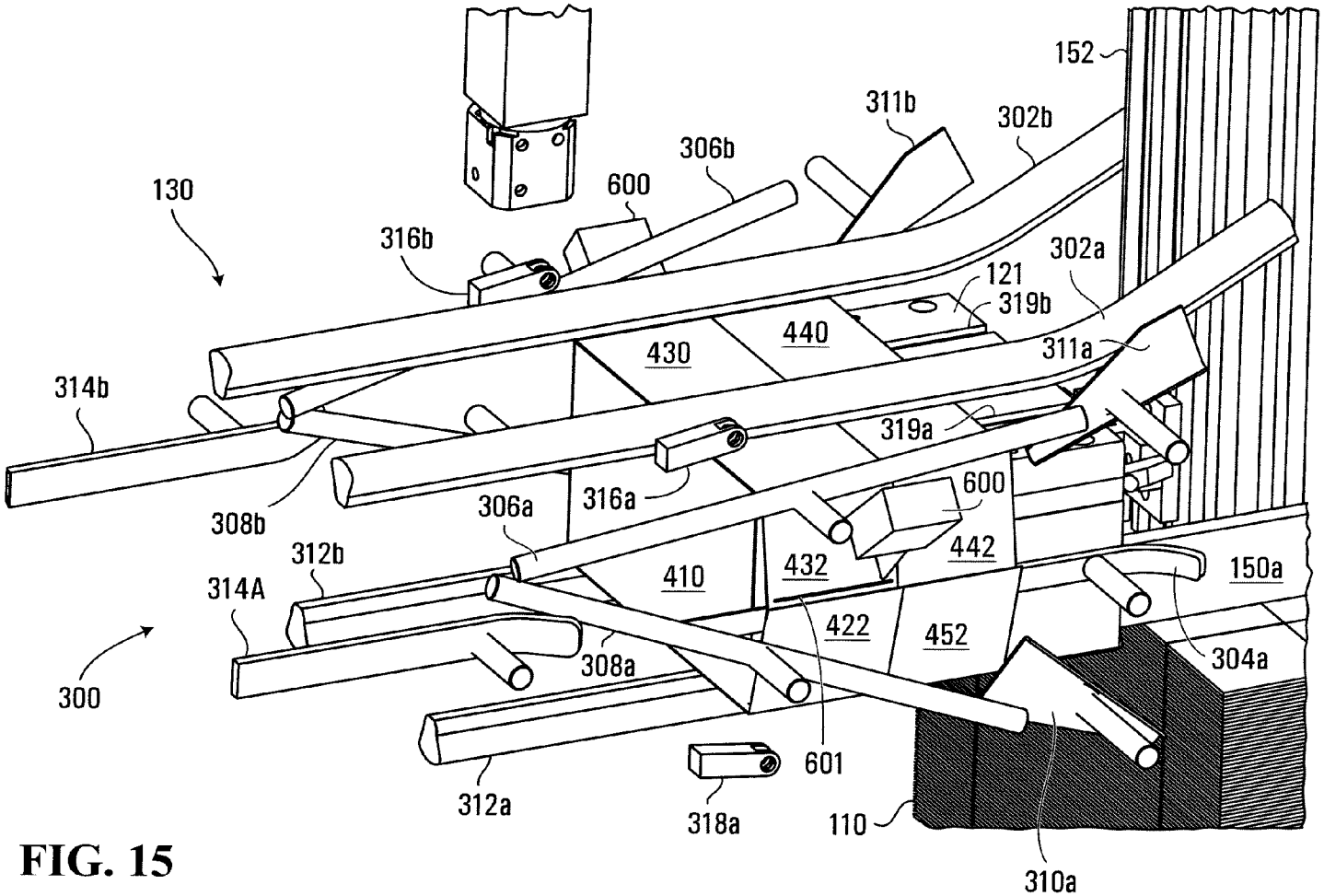

As shown in FIGS. 14 and 15, one adhesive applicator 600 may be positioned and configured so it can apply adhesive as described above including to an outer surface of panel 432 and inner surface of panel 422 so that the desired overlap seam 499*a* depicted in FIG. 35 can be created. Applicator 600 may also be configured to apply adhesive to the outer surface of panel 412 at a suitable location.

On the opposed side, a second applicator 600 may be positioned and configured so it can apply adhesive as described above including to an outer surface of panel 431 and inner surface of panel 421 so that the desired overlap seam 499*b* depicted in FIG. 35 can be created. Applicator 600 may also be configured to apply adhesive to the outer surface of panel 411 at a suitable location.

Also with particular reference to FIGS. 14 and 15, associated with rail apparatus 300 are opposed pairs of upper latch devices 316*a*, 316*b* and lower latch devices 318*a*, 318*b*. The latch devices 316*a*, 316*b* may be gravity driven or spring loaded finger latches which permit one way movement of configured cases. Top plate 140*c* of mandrel 121 may be inscribed with grooves 319*a* and 319*b*, and similarly the lower facing surface of lower support plate 150*c*, may also be inscribed with corresponding grooves (not shown). As the case blank is pushed forward, the latches are pushed by panels 20 and 30 to positions allowing the case blanks to pass the upper latch devices 316*a*, 316*b* and lower latch devices 318*a*, 318*b*. However, once the rear edges of major cover panels 40 and 50 have passed the upper and lower latches respectively, the latches may fall into the respective grooves. This may then prevent rearward movement of the configured blank 400*a* and allow for retraction of mandrel 121 without physical impairment by upper latch devices 316*a* and 316*b* or lower latch devices 318*a*, 318*b*. It may also be appreciated that other known types of mechanisms could be deployed that would restrain the blank from rearward movement, when the mandrel apparatus is starts to move backwards and disengages from the blank to return to its start position where the next blank can be retrieved from magazine 400. For example, additional suction cups could be used that are controlled by valves and PLC 132 and that are positioned to engage and hold the blank (which has become a formed case) in position during disengagement of the mandrel 121 from the formed case.

Various components of system 100 such as mandrel 121, mandrel moving apparatus 125, panel rotating apparatus 124 and mandrel support frame 123 may be made of suitable materials such as for example mandrel 121 may be made from aluminium. Also a least some of the various components of system 100 such as mandrel 121 and support frame 123 may be integrally formed or interconnected to each other by known techniques. For example if the components are made of a suitable metal or plastic, welding techniques can be employed. Also, the use of screws and/or bolts may be employed.

The operation of system 100 will now be described in detail. First, magazine 110 may be raised so that the upper generally horizontally oriented surface of the upper-most blank 400 (which may be blank 400 from FIG. 30 or may be blank 500 from FIG. 36) is just in contact with, or is a very short distance spaced from (e.g. within ¼ inch) the bottom surfaces of mandrel support frame 123 and mandrel 121. Next, magazine 110 and panel rotating apparatus 124 may co-operate so that the single blank 400 from the top of the stack of case blanks may be retrieved from the magazine 110 and be transferred to the mandrel apparatus 120. Thus, in this way the panel rotating apparatus 124 may also serve as a transfer mechanism for transferring case blanks in series from the magazine 110 to the mandrel 121. In other embodiments, a separate transfer mechanism may be provided to retrieve blanks serially from the magazine and transfer them to the mandrel so that a rotating apparatus may rotate a portion of the blank as hereinafter described.

As shown in FIGS. 9, 10 and 11, under the control of PLC 132, panel rotation unit 124 may extend reciprocating piston rod 206 so that the rotating plate 219 and the suction cups 220*a*, 220*b* thereon are rotated to be in an orientation that is downward facing. Upon coming into close proximity or contact with panel 410, a vacuum may be applied to suction cups 220*a*, 220*b*, whereby they engage the upward facing surface of panel 410 of the top blank 400 in the stack. Panels 420 and 450 of the blank 400 are at the same time are maintained generally in position up against or proximate the lower surface of mandrel support frame 123. Suction cups or another additional holding mechanism (not shown) could also be employed to hold the panels 420 and 450 horizontally against the bottom surfaces of the mandrel. Panels 420 and 450 may also continue to be supported underneath by physical contact with the upper surface of another underlying blank 400 in the stack.

With particular reference now to FIGS. 9, 10 and 11, panel rotating apparatus 124 may be operated by PLC 132 to rotate rotating plate 219 about hinge 209 so that panel 410 may be rotated—preferably approximately ninety (90) degrees—about a pre-determined fold line between panels 410 and 420. Thus panel 410 (and attached panels 411, 412, 430, 431, 432, 440, 441 and 442) is rotated relative to panels 420, 421, 422, 450, 451 and 452 from a generally flat and horizontal orientation to a generally vertical and angled orientation, thus forming a generally L-shaped configuration. It is this step that makes the rest of the case forming process using system 100 possible.

Vacuum may also be applied to suction cups 220*a*, 220*b* through operation of PLC 132 during the rotation of the panel 410. The air suction force that may be developed at the outer surfaces of suction cups 220*a*, 220*b* of panel rotation apparatus 124 may be sufficient so that panel 410 of a blank 400 can be rotated from the position shown in FIG. 9, through the intermediate position shown in FIG. 10, to the position shown in FIG. 11.

Once panel 410 reaches the position shown in FIG. 11, the suction cups 220*a*, 220*b* associated with panel rotating apparatus plate 124 hold panel 410 against the forward facing surfaces of mandrel side plates 140*a*, 140*b* and the outer surface of 219*a* of panel rotating plate 219. The panel 410 with attached panels 411, 412, 430, 431, 432, 440, 441 and 442 generally remain in a vertical orientation. Folding of panel 410 relative to panel 420 takes place about the fold line between panel 410 and panel 420. While there may be a predetermined fold line between the other panels, until one is bent relative to the other, they will tend to remain in the same general plane.

The rotation of panel 410 of the top blank 400 may also tend to pull that blank upwards and perhaps a very small distance forward, the effect of which may be to free the top blank from the blank beneath it that is still on the stack. The result is that the top blank 400 is now capable of being moved forward by the mandrel apparatus 120 towards the rail and plough apparatus 300.

It will be appreciated that in some embodiments, the system could be configured so that magazine 110 may discharge blanks 400 to a mandrel apparatus like apparatus 120 from the top rather than the bottom. However, discharging blanks from the top may require inverting some or all of the aforementioned components.

Next, mandrel support and moving apparatus 125 may be used to move mandrel apparatus 120 and mandrel support frame 123 longitudinally forward towards rail and plough apparatus 300, thus also moving blank 400 that is held to mandrel 121. To create this forward longitudinal movement of the mandrel apparatus 120, PLC 132 can operate servo drive motor 170, to move drive belt 178 longitudinally in a direction that causes slider plate 160 to slide forward on guide rails 172*a*, 172*b*. With the movement of slide plate 160, the vertical support 152, mandrel support frame 123, and mandrel apparatus 120 that is attached to frame 123, also move longitudinally towards rail and plough apparatus 300.

Figure 13:
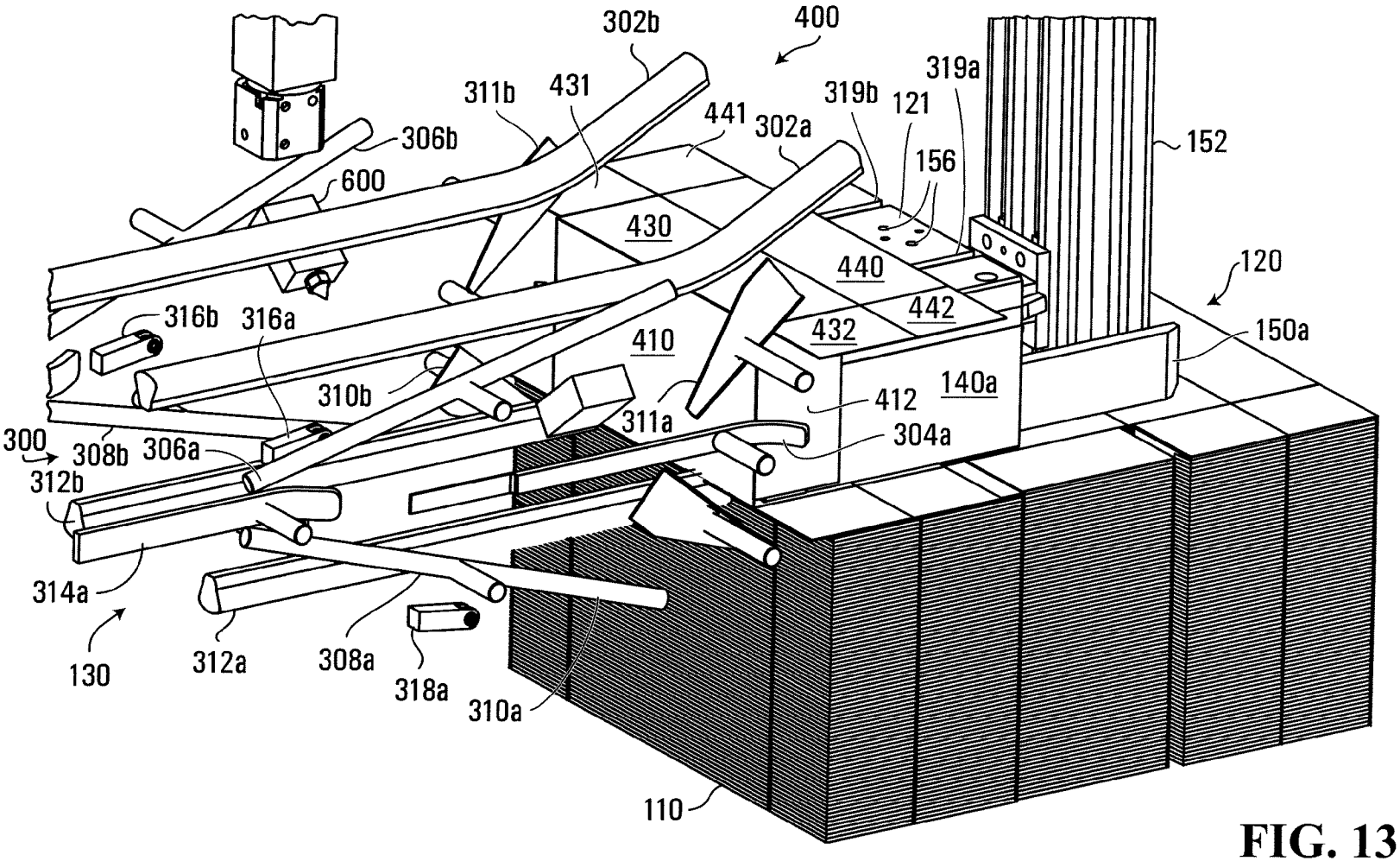

With particular reference now to FIGS. 12-18, mandrel 121 is moved longitudinally forward, and thus blank 400 which may be held thereto by the connection of panel 410 to the front surface of the plate 219*a*, also moves longitudinally with the mandrel 121. As blank 400 is moved longitudinally by mandrel apparatus 120, first rails 302*a*, 302*b* may engage a portion of panel 430, so that panel 430 and attached panels 431, 432, 440, 441 and 442, are folded along a fold line between panel 410 and panel 430 downward from a generally vertical orientation to a generally horizontal orientation as shown in FIG. 13 whereby panel 430 is held against the upper surface of mandrel plate 140*c*.

With continued longitudinal movement of blank 400, opposed inner side rails 304*a*, 304*b* may engage panels 411 and 412 respectively and may fold and maintain the panels 411 and 412 in a generally rearwardly extending orientation. At about the same time, a pair of wedge plough devices 311*a*, 311*b* may commence the generally inward and downward folding of side end panels 431 and 432 and attached panels 441 and 442 respectively from a generally horizontal orientation towards a generally vertical orientation. Likewise, slightly after the wedge plough devices 311*a*, 311*b* engage side end panels 431 and 432, a pair of wedge plough devices 310*a*, 310*b* may commence the generally inward and upward folding of side panels 421 and 422 and attached panels 451 and 452 respectively from a generally horizontal orientation towards a generally vertical orientation.

As shown in FIGS. 14 and 15, with continued longitudinal movement of mandrel 121 with blank 400 held thereto, next opposed, downwardly and inwardly oriented guide rails 306*a*, 306*b*, may take over from plough devices 311*a*, 311*b*, to engage the upper surfaces of panels 431 and 432 and attached panels 441 and 442 and to complete the inward and downward folding of outer panels 431 and 432 respectively to a vertical position as shown in FIG. 15. Likewise, slightly after guide rails 306*a*, 306*b*, take over from plough devices 311*a*, 311*b*, opposed, upwardly and inwardly oriented guide rails 308*a*, 308*b*, may take over from plough devices 310*a*, 310*b*, to engage the lower surfaces of panels 421 and 422 and attached panels 451 and 452 and to complete the inward and upward folding of outer panels 421 and 422 respectively to a vertical position as shown in FIG. 15. At an appropriate time during which the foregoing folding process takes place, the adhesive applicators 600 can apply appropriate amounts of adhesive in locations as described above.

Lower support rails 312*a*, 312*b* may assist in supporting blank 400 once it has been removed from the support of the stack of blanks 400 in the magazine 110.

Figure 16:
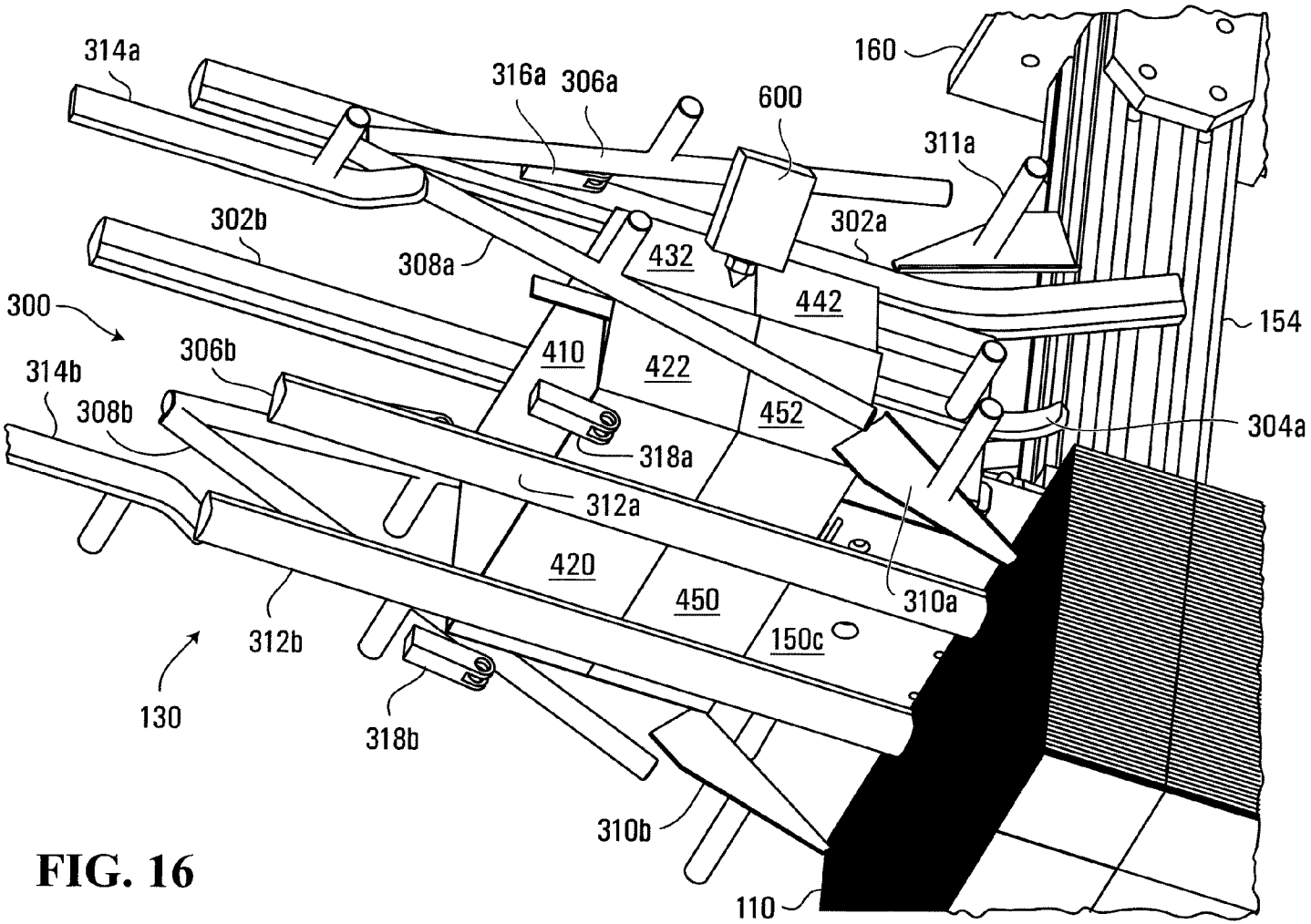
Figure 17:
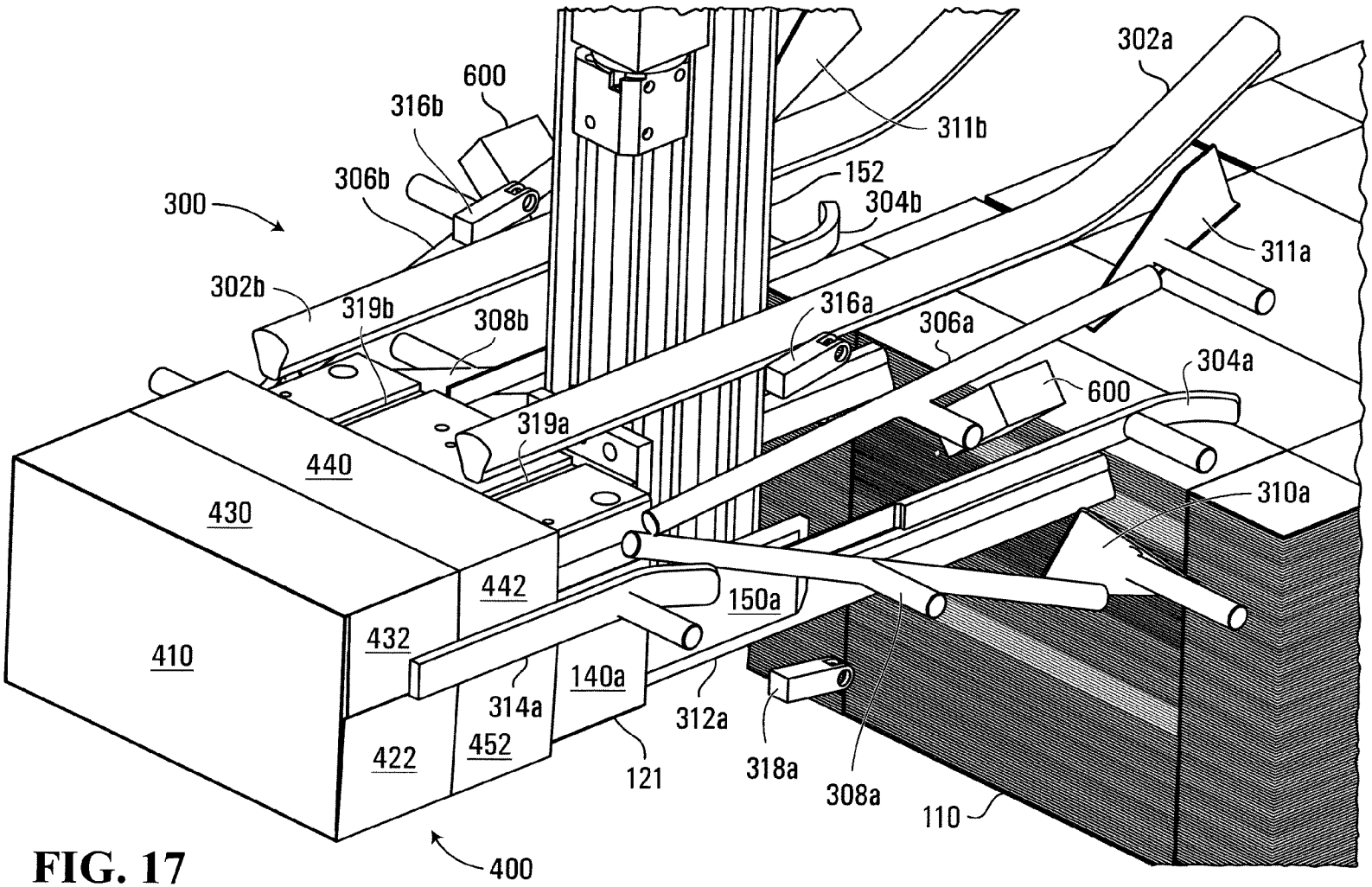
Figure 18:
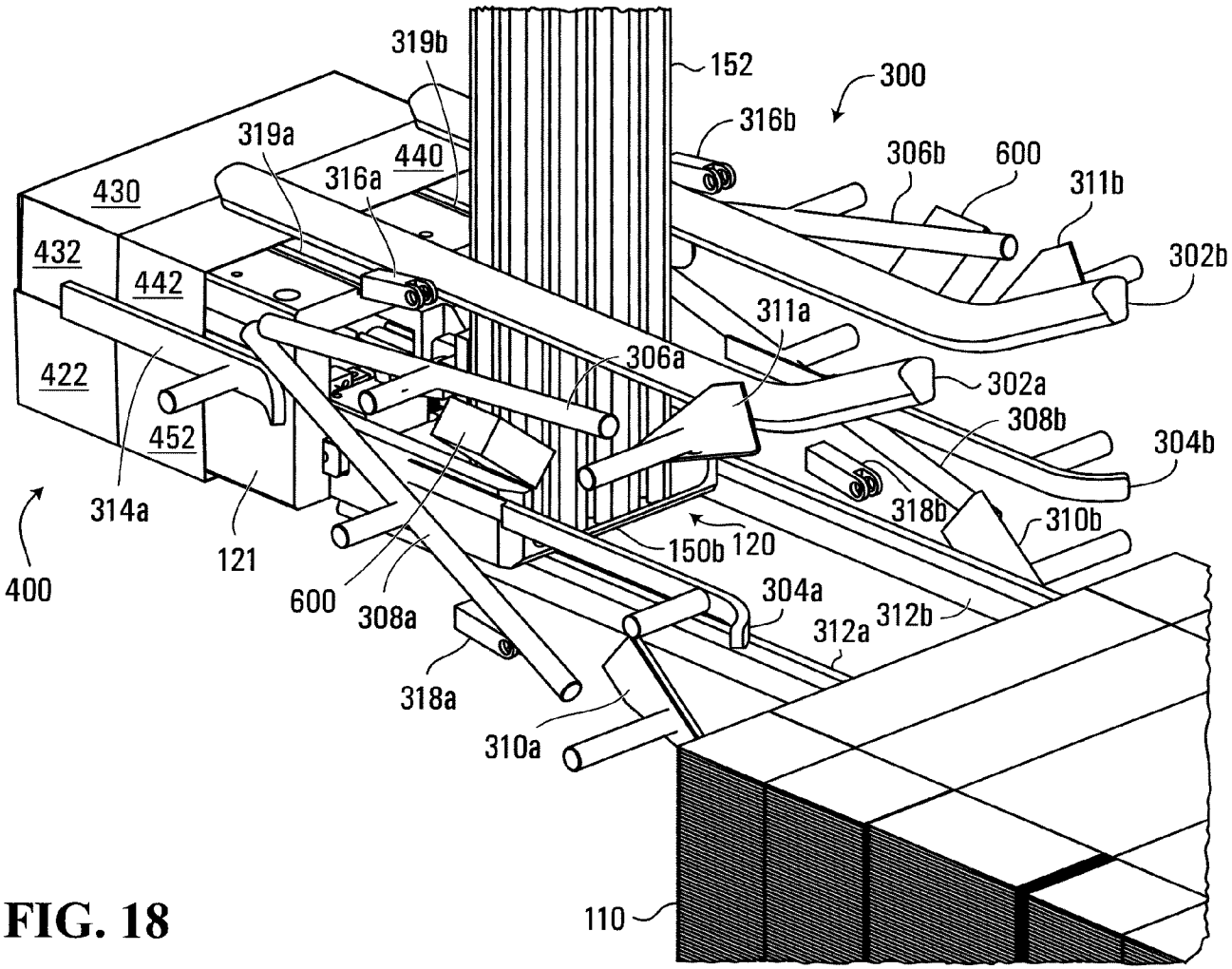

Also as shown in FIGS. 16, 17 and 18, as blank 400 moves longitudinally, the side end panels 431 and 432 are compressed in such a manner that inside portions of side end panel 431 engage outer surfaces of bottom panel 411 and inside portions of side end panel 432 engage outer surfaces of panel 412. Likewise, the side end panels 421 and 422 are compressed in such a manner that inside portions of side end panel 421 engage outer surfaces of bottom panel 411 and side end panel 431 and inside portions of side end panel 422 engage outer surfaces of bottom panel 412 and side end panel 432. With the assistance of adhesive positioned between the respective surfaces, compression rails 314*a*, 314*b* may help ensure appropriate sealing of the panels together.

Under the control of PLC 132, or pursuant to another control or trigger, adhesive applicators 600 can apply a suitable adhesive at appropriate positions on the panels and/or panels just prior to the folding of the panels, so that when the panels and panels are folded as just described, the panels can be held in the desired case configuration. This approach of folding and pressing together two panels immediately after applying adhesive at least one of the panels can reduce the amount of adhesive required. By way of example, under the control of PLC 132, or pursuant to another control or trigger, adhesive applicators 600 can apply a suitable adhesive at appropriate positions on the panels just prior to or during the process of folding of the panels, so that when the panels and panels are folded as just described, the panels can be held in the desired case configuration. With reference to FIG. 1, in the preferred embodiment, lines or beads of glue may be applied by stationary glue applicators 600 to the blank 400 as the blank is being moved by mandrel 121 through the rail and plough apparatus 300. Thus, the glue can be applied at a particular time during the folding process just prior to engaging two panels with each other to interconnect them. In this manner, the gluing and folding can be completed in a single in-line process while the blank is being moved longitudinally through the rail and plough apparatus 300, without the need to have a separate gluing stage prior to commencing the folding by the rail and plough apparatus 300.

In particular, with reference to FIG. 15, glue may be applied to the outward facing surface of panels 432 and 442 in a bead 601 extending up the walls of the case along the portion of panels 432 and 442 that will overlap with panels 422 and 452. Thus when panels 422 and 452 are folded and compressed against the outside surface of panels 432 and 442, a seam may be formed by the bond between panels 422 and 432, and 452 and 442. In a similar method, a bead may be applied extending up the walls of the case along the portion of panels 422 and 452 that will overlap with panels 421 and 451. Thus when panels 421 and 451 are folded and compressed against the outside surface of panels 431 and 441 another seam may created on the opposite side of the case as panel 421 is bonded to panel 431 and panel 441 is bonded to panel 451.

This approach of folding and adhesively connecting two panels together immediately after applying adhesive to at least one of the panels may reduce the amount of adhesive required. As stated above, in the preferred embodiment, the adhesive may be "hot-melt"-type glue such as Cool-Lok adhesive made by Nacan Products Limited. A bead of hot-melt glue may be applied by applicators 600 to the surfaces of the appropriate panels at a temperature appreciably higher than the ambient room temperature. The bead of glue may be approximately cylindrical in shape and as the second panel is folded over the first panel and compressed by the rail and plough apparatus 300, the bead of glue becomes flattened and spreads out over the seam. As the glue is spread out, it cools down, forming an instant adhesive bond between the panels. When gluing and folding is done in a single in-line process, as in the preferred embodiment, the glue has little time to cool down between glue application and panel compression. Because there is little time between glue application and compression, the bead of glue is not required to retain heat for a significant amount of time and a bead with a smaller radius (and consequently a reduced amount of glue) may be used as compared to a system where the glue is applied in a separate process prior to folding.

As is shown in FIGS. 16, 17 and 18, as blank 400 moves further in a longitudinal direction, the folded blank, with panels secured appropriately with for example adhesive, may move past the end of overhead rails 302*a*, 302*b* and upward rails 308*a*, 308*b*. Also, as shown in FIG. 17, the rear edge of rear panel 450 may pass lower latch devices 318*a*, 318*b*, and the rearward edge of panel 440 may pass upper latch devices 316*a*, 316*b*. This longitudinal positioning of blank 400 may cause latch devices 316*a*, 316*b*, 318*a*, 318*b* to be activated.

Once activated, the latch devices may restrict the case from moving longitudinally backwards, when the mandrel apparatus 120 is withdrawn.

Additionally, upon receiving the signal from the position sensor that the blank has reached the release position as shown in FIG. 18 (i.e. the mandrel has reached the end of its stroke cycle), PLC 132 may send a signal to servo motor 170 causing it to reverse its rotational direction, which in turn causes drive belt 178 to move in the opposite direction. This movement of belt 178 causes slider plate 160 and thus mandrel support frame 123 and mandrel apparatus 120 to also move in a reverse or rearward direction (not shown). Additionally, PLC 132 may send appropriate signals to deactivate the vacuum force provided at suction cups 220*a* and 220*b* in panel rotating apparatus plate 219 so that the container is no longer held on the mandrel by the suction cup forces.

Once the mandrel 121 has been withdrawn from the blank (which has now been formed into a container—case—400*a*), the container 400*a* may no longer be supported, except possibly at least to some extent by compression rails 314*a*, 314*b*. Thus, container 400*a* may be transferred to a case conveyor (not shown) that is configured to receive the container and the container is then carried away by the case conveyor to be loaded and/or processed further. Case conveyors are well known in the art and any suitable known case conveyor may be utilized.

A device may be employed to push the container 400*a* (e.g. the formed DSS-RSC case) out from between rails 314*a*, 314*b*. For example, a simple push down cylinder device that may also be controlled by PLC 132 may be used. Other examples of transfer devices that might be employed to transfer the case from the end of guide apparatus 130 to a case conveyor include a "blow-off" system that may use one or more jets of compressed air, a suction cup system, the use of pushing arm or simply allowing for freefall of the formed case.

While the container 400*a* is being transferred to the case conveyor, the mandrel apparatus 120 can be returned to its start position (not shown), ready to recommence the process that has just been described above to form another case.

It is anticipated that cases may be formed at a rate of in the range of about 1 to about 60 cases per minute.

Many variations of the embodiments described above are possible. By way of example only, one portion of the blank may not have to be rotated from a generally flat configuration with the rest of the case blank, ninety degrees relative to remaining portions of the panel, to set-up the folding process. In some other embodiments, the initial rotation of one portion of the blank from a generally flat configuration of the entire blank, may for example be only in the range of from forty-five degrees to ninety degrees. Once the first portion has been rotated from the flat configuration to the angled position, the blank is then more readily capable of being engaged by other mechanisms such that a further rotation of the first portion and other portions of the blank can be carried out to bring the first portion to a vertical position against the front face of the mandrel. Alternatively, in some applications a mandrel might be employed which has outer surfaces that are not completely at right angles to each other. A case blank could then be utilized in the system such that when folded, the blank may not form a cuboid shape.

The system could, with some other modifications, be provided in other spatial orientations such as in a vertically inverted configuration. In such a vertically inverted configuration, a magazine may hold blanks in a stack but be configured to dispense the blanks from the bottom of the stack. A blank could then be retrieved from the bottom of the stack and the front panels could be rotated ninety degrees downwards (instead of upwards) to engage a mandrel, so that like in the embodiment described above, an L-shaped configuration is formed around the mandrel. In some such embodiments, a separate rotation device may not be required to rotate the front panels ninety degrees to engage the mandrel. Once released from the magazine, the front panels may rotate and pivot downwards. Suction cups or another holding mechanism could then be employed to hold the front panels vertically against the front surface of the mandrel. An additional holding mechanism could also be employed at a top plate of the mandrel so that the L-shaped blank is held to the mandrel before and during its passage through a holding apparatus. Such a holding apparatus may be simply the inverted configuration to the holding apparatus described above. An example of such an embodiment is illustrated in FIGS. 19 and 20.

Figure 19:
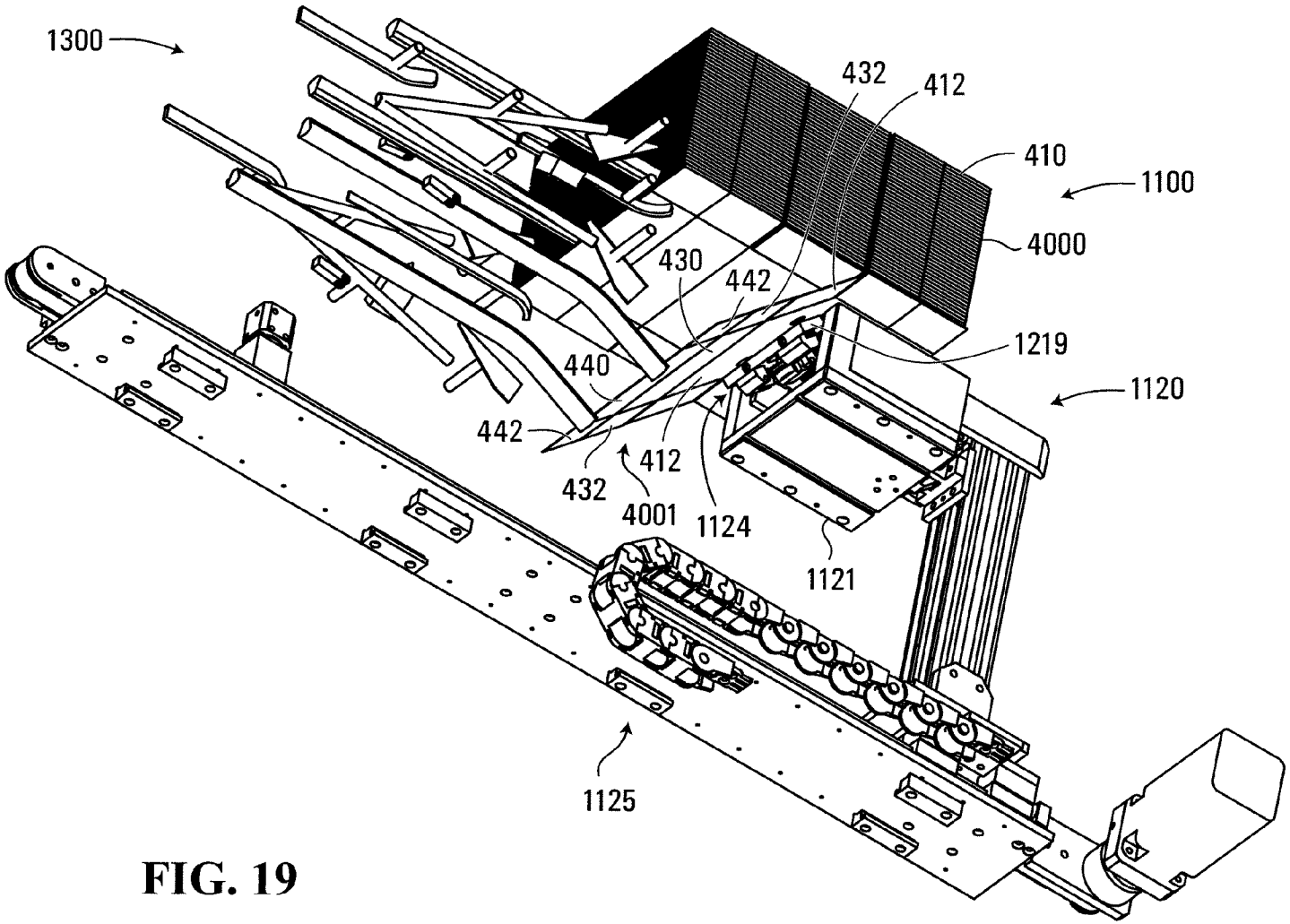
FIGS. 19 to 20 are perspective views of a first alternate system.
Figure 20:
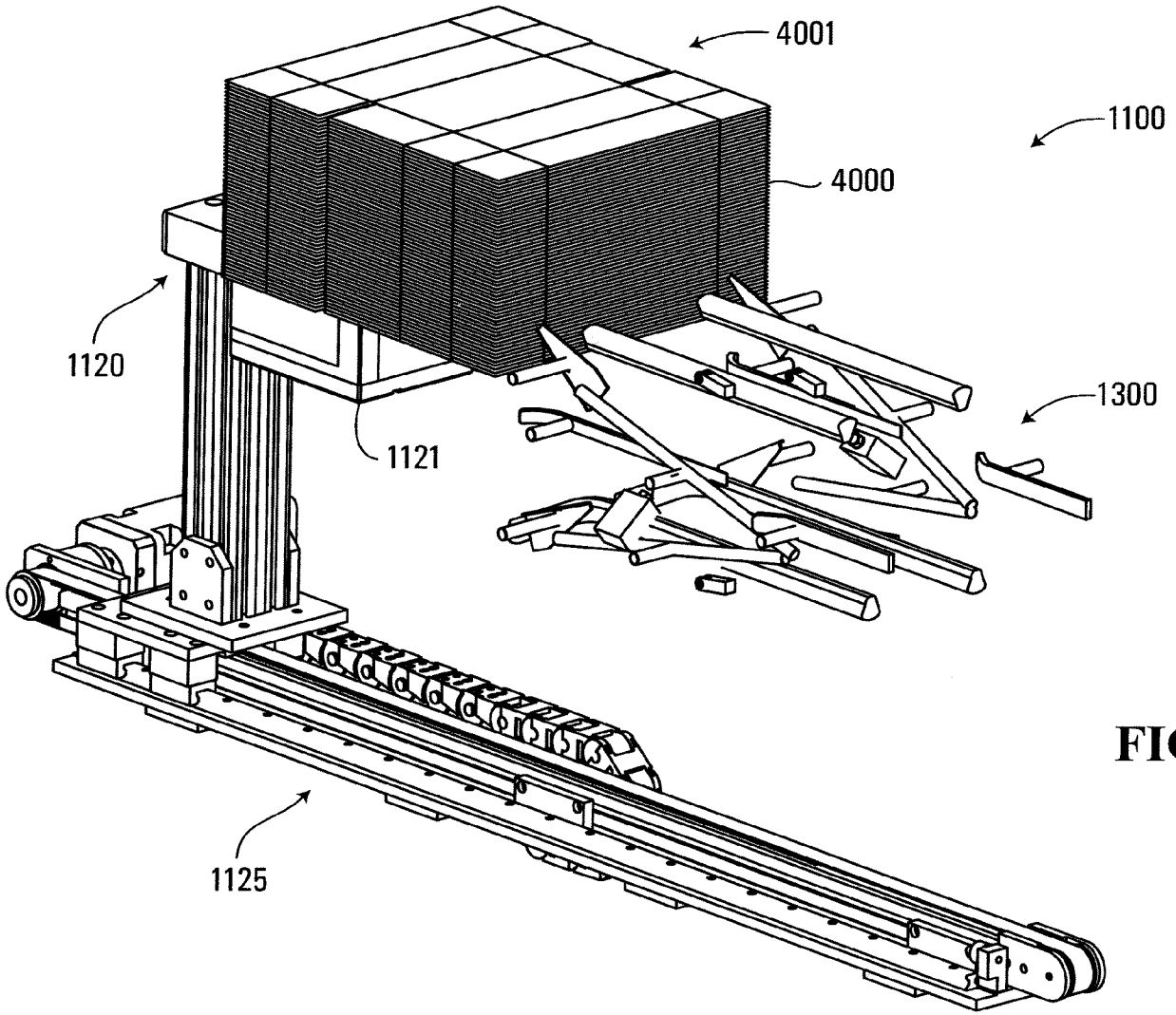

With reference to FIGS. 19 and 20, system 1100 is constructed substantially the same way as system 100 as illustrated in FIGS. 1 to 18 with generally all the same components. However, the orientation of system 1100 is vertically inverted in its orientation compared to system 100. Therefore, while each blank 4001 of system 1100 (each of which may be like blank 400) is moved longitudinally in a generally horizontal direction, the process and components are vertically inverted about a horizontal longitudinal axis.

System 1100 therefore may have a magazine 4000 holding blanks 4001 (which may be of the type blank 400 of FIG. 30 or blank 500 of FIG. 36) vertically above mandrel apparatus 1120, panel rotating apparatus 1124 and mandrel movement and support apparatus 1125. Mandrel apparatus 1120 may be constructed like mandrel apparatus 120 with a mandrel 1121, but may be oriented in a vertically inverted configuration compared to apparatus 120. Likewise panel rotating apparatus 1124 and mandrel movement and support apparatus 1125 may be constructed like panel rotating apparatus 124 and mandrel movement and support apparatus 125 respectively, but each is also oriented, vertically inverted. System 1100 may also include a panel folding and guide apparatus 1300 that may be a rail and plough constructed like apparatus 300, but again it may be vertically inverted.

In operation of system 1100, magazine 4000 may provide blanks 4001 in a stack such that there is a downwardly facing, but generally horizontally oriented surface of panel 20 in the bottom-most blank in the stack that is just in contact with, or is a very short distance spaced from the bottom surfaces of mandrel 1121. Next, magazine 4000 and panel rotating apparatus 1124 may co-operate so that the single blank 4001 from the "bottom" of the stack of blanks may be retrieved from the magazine 4000 and be transferred to the mandrel apparatus 1120. It should be noted that in this embodiment, gravity may assist in releasing a blank 4001 from magazine 4000 and securing it to mandrel 1121.

As with the embodiment of FIGS. 1-18 described above, a PLC like PLC 132 may cause panel rotation unit 1124 to extend so that a rotating plate 1219 and the suction cups thereon are rotated to be in an orientation that is upward facing. Upon coming into close proximity or contact with a panel 410, suction cups may engage the downward facing surface of panel 410 of the bottom blank 4001 in the stack. The blank 4001 may also at the same time be supported proximate the upper surface of the mandrel support frame 1123.

Thereafter panel rotating apparatus 1124 may be operated to rotate plate 1219 so that panel 410 may be rotated—preferably approximately ninety (90) degrees—downwards, but otherwise generally as described above, to form a generally L-shaped configuration. Vacuum may also be applied to suction cups through operation of the PLC during the rotation of the panel 410. The air suction force that may be developed at the outer surfaces of suction cups of panel rotation apparatus 1124 may be sufficient so that panel 410 of a blank 4001 can be rotated from the position shown in FIG. 19 to a vertical position.

Once panel 410 reaches the vertical downward position, the suction cups associated with panel rotating apparatus plate 1124 hold panel 410 against the forward facing surfaces of mandrel 1121 with attached panels 411, 412, 430, 431, 432, 440, 441 and 442 also generally remaining in a vertically downward orientation.

The rotation of panel 410 may also tend to pull that blank downwards and perhaps a very small distance forward direction, the effect of which may be to free the blank from magazine 4000. The result is that the "bottom" blank is now capable of being moved forward by the mandrel apparatus 1120 towards the panel folding and guide apparatus 1300. The magazine may again comprise a stack of blanks held in position by vertical rails (not shown). Here, where the case former takes blanks from the bottom of the stack, gravity may bring the cases to the bottom of the magazine. At the bottom of the stack, there may be small metal tabs attached to the rails (not shown) that protrude out into the plane of the stack such that the stack may rest on the tabs. In essence, the stack is held up by the tabs against or closely proximate to the top of the mandrel. When the panel rotation device 1124 engages the bottom case blank and rotates the front panel downwards, the bottom case blank may be pulled through the tabs and out of the magazine. The tabs themselves may remain stationary, but because the case blank may be flexible, so that the case blank may bend from the force of the rotation device and pull out of the magazine. In this way, the system may prevent more than one blank at a time from being taken. Of course various other embodiments of how a magazine can be set up and how a case can be taken from a magazine.

Thereafter, the panel folding and guide apparatus 1300 may cause the blank to be folded in the same manner as described above in relation to rail and plough apparatus 300, but in an orientation that is vertically inverted.

Figure 21:
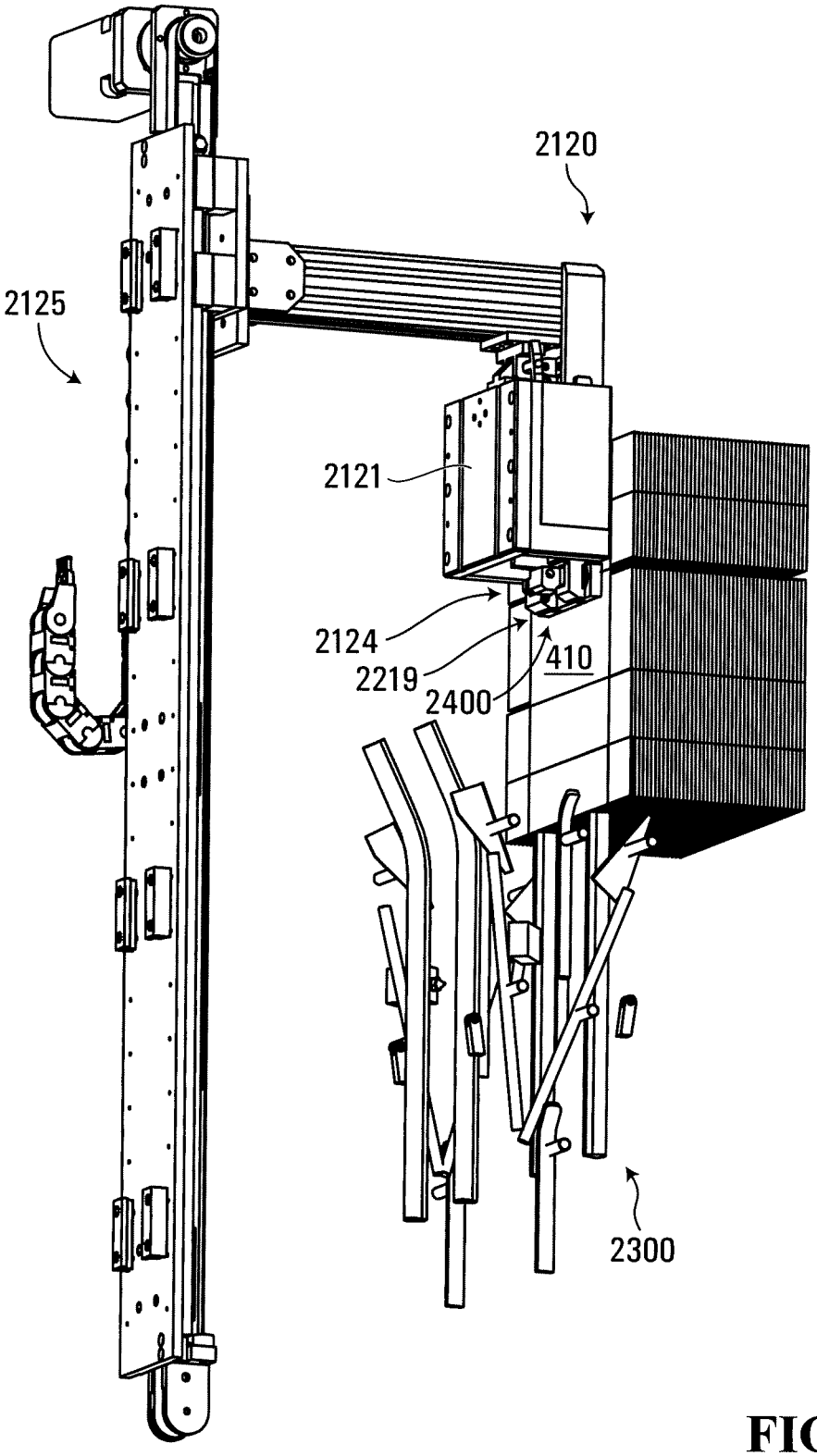
FIGS. 21 to 22 are perspective views of a second alternate system.
Figure 22:
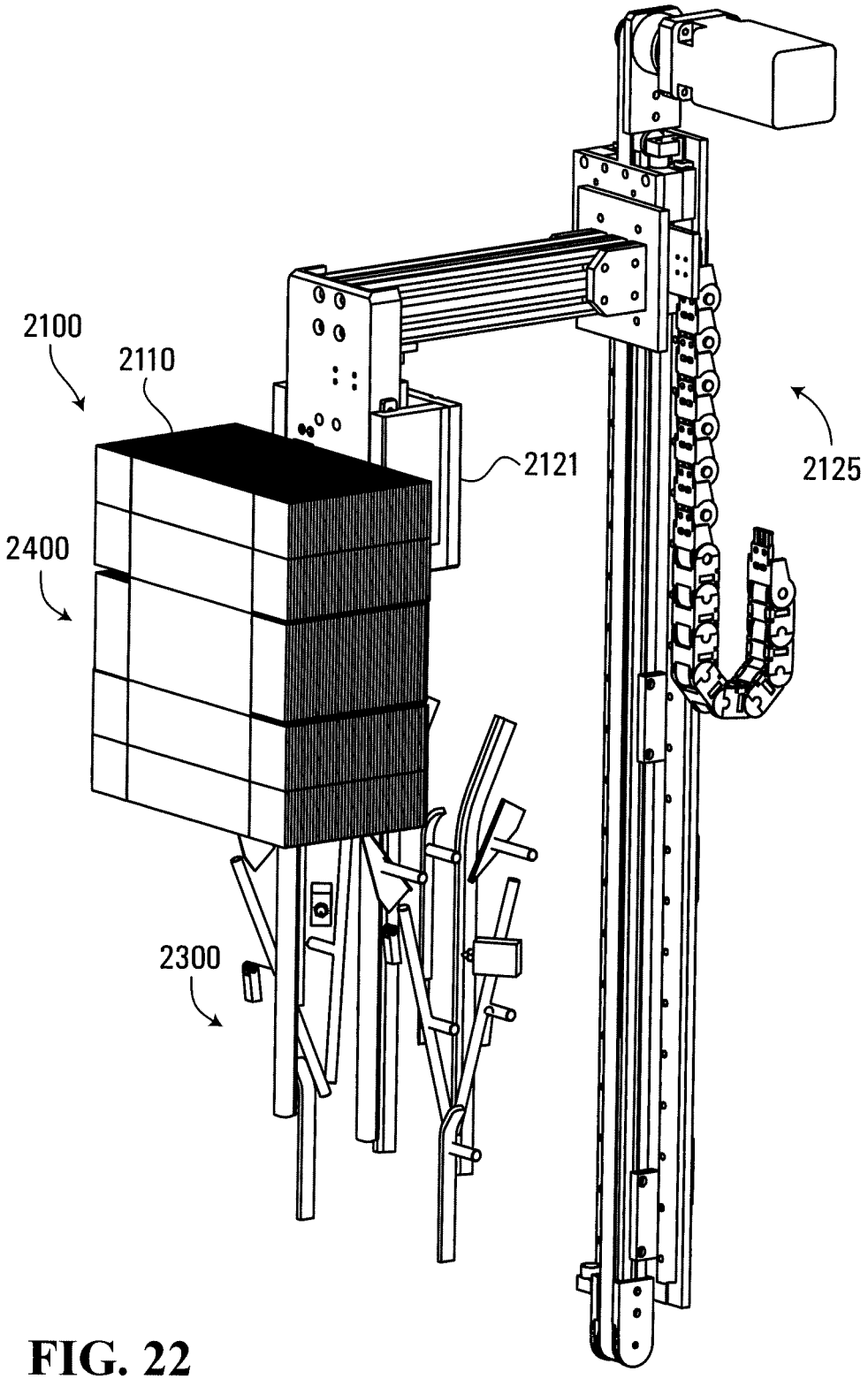
Figure 23:
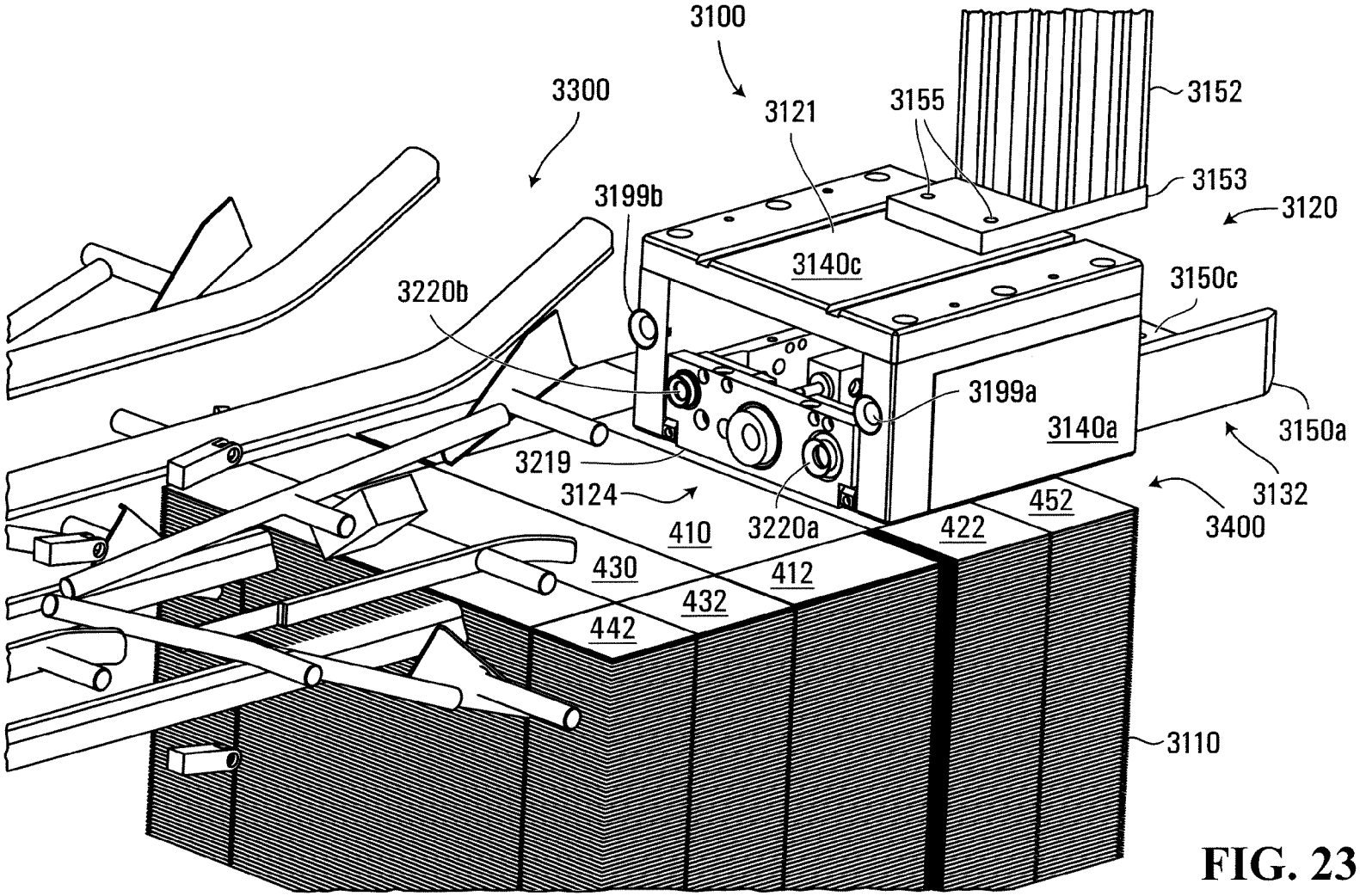
FIGS. 23 to 26 are perspective views of a third alternate system.

It may be appreciated that in some embodiments, the system could be also configured so that a magazine may discharge blanks to a mandrel apparatus from the side rather than the top or bottom whereby the general orientation of the movement of the blank and the mandrel apparatus through a rail and plough apparatus is generally vertically upwards or downwards. One example of such a configuration is illustrated in FIGS. 21 and 22. System 2100 is also constructed substantially the same way as system 100 with generally all the same components. However, the orientation of system 2100 rotated by about 90 degrees to generally vertically orientation compared to system 100. Therefore, each blank 2400 of system 2100 (each of which may be like blank 400 of FIG. 30 or blank 500 of FIG. 36) is moved generally longitudinally in a generally vertically downwards direction.

System 2100 therefore may have a magazine 2110 holding blanks 2400 that is positioned to hold blanks 2400 in a generally vertical orientation and horizontally spaced from mandrel apparatus 2120, panel rotating apparatus 2124 and mandrel movement and support apparatus 2125. Mandrel apparatus 2120 may thus be constructed like mandrel apparatus 120 with a mandrel 121, but may be oriented in a generally 90 degree rotated configuration compared to mandrel apparatus 120. Likewise panel rotating apparatus 2124 and mandrel movement and support apparatus 2125 may be constructed like panel rotating apparatus 124 and mandrel movement and support apparatus 125 respectively, but each is also oriented in a generally 90 degree rotated configuration. System 2100 may also include a panel folding and guide apparatus 2300 that may be a rail and plough constructed like apparatus 300, but again can be oriented in a generally 90 degree rotated position compared to apparatus 300.

In operation of system 2100, magazine 2110 may provide blanks in a stack such that there is a vertically oriented outward facing, surface of the "bottom" blank in the stack that is just in contact with, or is a very short distance spaced from, the outward facing surfaces of mandrel 2121. Next, magazine 2110 and panel rotating apparatus 2124 may co-operate so that the single blank 2400 from the "bottom" of the stack of blanks may be retrieved from the magazine 2110 and be transferred to the mandrel apparatus 2120.

As with the embodiment of FIGS. 1-18 described above, a PLC like PLC 132 may cause panel rotation apparatus 2124 to extend so that a rotating plate 2219 and suction cups thereon are rotated to be in an orientation that is generally vertical. Upon coming into close proximity or contact with a panel 410, suction cups may engage the vertically oriented and outward facing surface of panel 410 of the bottom blank 2400 in the stack. The blank 2400 may also at the same time be supported proximate the vertical surface of the mandrel support frame by the magazine until the blank has been engaged by the panel rotation apparatus 2124.

Thereafter panel rotating apparatus 2124 may be operated by rotating plate 2219 so that panel 410 may be rotated—preferably approximately ninety (90) degrees to a generally horizontal position, but otherwise generally as describe above, to form a generally L-shaped configuration. Vacuum may also be applied to suction cups through operation of the PLC during the rotation of the panel 410. The air suction force that may be developed at the outer surfaces of suction cups of panel rotation apparatus 2124 may be sufficient so that panel 410 of a blank can be rotated approximately 90 degrees.

Once panel 410 reaches the horizontal position, the suction cups associated with panel rotating apparatus plate 2219 hold panel 410 against the forward facing surfaces of mandrel 2121 with attached panels 411, 412, 430, 431, 432, 440, 441 and 442 also generally remaining in a horizontal orientation.

The rotation of panel 410 may also tend to pull that blank horizontally and perhaps a very small distance downward direction, the effect of which may be to free the top blank from magazine 2110. The result is that the bottom blank is now capable of being moved forward by the mandrel apparatus 2120 towards the panel folding and guide apparatus 2300. As in the other two systems 100 and 1100 described above, the magazine employed in system 2100 may be just a stack of case blanks held in position by horizontal rails (not shown). The magazine may operate using a combination of the other two types of magazines described above (e.g. the orientations in FIGS. 1 and 19). Because gravity would not pull the case blanks to the "bottom" of the stack, it may utilize a PLC controlled motor to push the whole stack sequentially towards the mandrel as case blanks are taken from the bottom of the stack and formed. In addition, to prevent the case blanks from tipping over and falling out of the magazine 2110, at the bottom of the stack, there may be small metal tabs attached to the rails (not shown in the drawings) that may protrude out into the plane of the stack such that the stack may rest on the tabs after being advanced by the PLC controlled motor. In general, the stack may be held up by the tabs against or closely proximate to the top of the mandrel. When the panel rotation apparatus 2124 engages the bottom case blank and rotates the front panel towards the horizontal, the bottom case blank may be pulled through the tabs and out of the magazine 2110. The tabs themselves may remain stationary, but because the case blank is slightly flexible, the case blank may bend from the force of the rotation device and pull out of the magazine. In this way, the system 2100 prevents more than one blank at a time from being taken. Of course other embodiments for a magazine set-up could be employed in system 2100.

Thereafter, the panel folding and guide apparatus 2300 may cause the blank to be folded in the same manner as described above in relation to rail and plough apparatus 300, but in an orientation that is vertically inverted.

In yet another embodiment as depicted in FIGS. 23 to 26, a system 3100 is illustrated in which the mandrel may be decoupled from the panel rotating apparatus and support frame. In such a configuration, the panel rotation apparatus and support frame may remain in a fixed position and not move with the mandrel and partially folded blank in a longitudinal direction towards the rail and plough apparatus.

System 3100 may for the most part be constructed substantially the same way as system 100 with generally most of the same components. System 3100 therefore may have a magazine 3110 holding blanks 3400 (which may be of the type of blank 400 or FIG. 30 or blank 500 of FIG. 36) below a mandrel apparatus 3120, a panel rotating apparatus 3124 and a mandrel movement and support apparatus (not shown). Mandrel apparatus 3120 may be constructed in a similar manner to mandrel apparatus 120 with a mandrel 3121. Likewise panel rotating apparatus 3124 and mandrel movement and support apparatus may be constructed like panel rotating apparatus 124 and mandrel movement and support apparatus 125 respectively. However, panel rotating apparatus 3124 is decoupled from mandrel movement and support apparatus. System 3100 may also include a panel folding and guide apparatus 3300 that may be a rail and plough constructed like apparatus 300.

Mandrel 3121 may include a pair of spaced opposed elongated and longitudinally extending side plate members 3140*a* and 3140*b*. Side plates 3140*a*, 3140*b* may be interconnected by and joined to an upper horizontally oriented plate 3140*c*. Side plates 3140*a*, 3140*b* and upper plate 3140*c* may be integrally formed together. Mandrel side plates 3140*a* and 3140*b* may contain a groove or channel (not shown) on their inner surfaces for receiving mandrel support rails 3141*a*, 3141*b* respectively so that the during extraction of a blank 3400 from magazine 3110, mandrel 3121 can be supported by the support frame 3123 and may be generally restrained from vertical and transverse motion. However, it should be noted that during longitudinal movement of mandrel 3121 caused by movement and support apparatus (not shown), mandrel side plates 3140*a* and 3140*b* may slide longitudinally relative to rails 3141*a*, 3141*b* respectively. The result may be that after extraction of a blank 3400 from magazine 3110, and the initial folding of the blank 3400 on mandrel 3121, mandrel 3121 can move away with the extracted blank 3400 longitudinally from rotating apparatus 3124 and support frame 3123.

Mandrel 3121 may be interconnected to and supported by a vertical frame support member 3152 having a connection plate 3153 extending horizontally at the lower surface of vertical member 3152. Plate 3153 may have screw holes 3155 which may enable screws (not shown) to pass down into threaded holes (not shown) in an upper horizontal surface of mandrel plate 3140*c*. Vertical support member 3152 may be conveniently formed from a light but relatively strong material that can be readily formed into a tube, such as for example aluminium. Vertical support member 3152 may be formed as a hollow channel member that has a longitudinally extending cavity that allows for electrical and communication cables and pressurized/vacuum air hoses to pass through from an upper end to a lower end. In this way, electrical power/communication cable and air hoses can deliver power, electrical signals and air to the suction cups 3199*a*, 3199*b* that are positioned to face outwards in a generally horizontal orientation. Suction cups can be mounted in the end faces of side plates 3140*a*, 3140*b* respectively. The supply of vacuum to suction cups 3199*a*, 3199*b* may be controlled by a PLC like PLC 32.

Vertical member 3152 also has an upper end portion that is interconnected to the mandrel moving apparatus (not shown). Mandrel support and moving apparatus may be used to support and move in reciprocating forward and rearward longitudinal movement mandrel 3121.

Panel rotating apparatus 3124 may engage one blank 3400 and may be employed to rotate a blank 3400 panel 410 relative to one or more other panels. The movement of unit 3124 can be controlled by the PLC in such a manner that it can rotate so as to move a panel 410 (and attached panels 411, 412, 430, 431, 422, 440, 441 and 442) of a case blank 3400 through a rotation of approximately 90 degrees, in an aligned manner, at an appropriate time.

Figure 24:
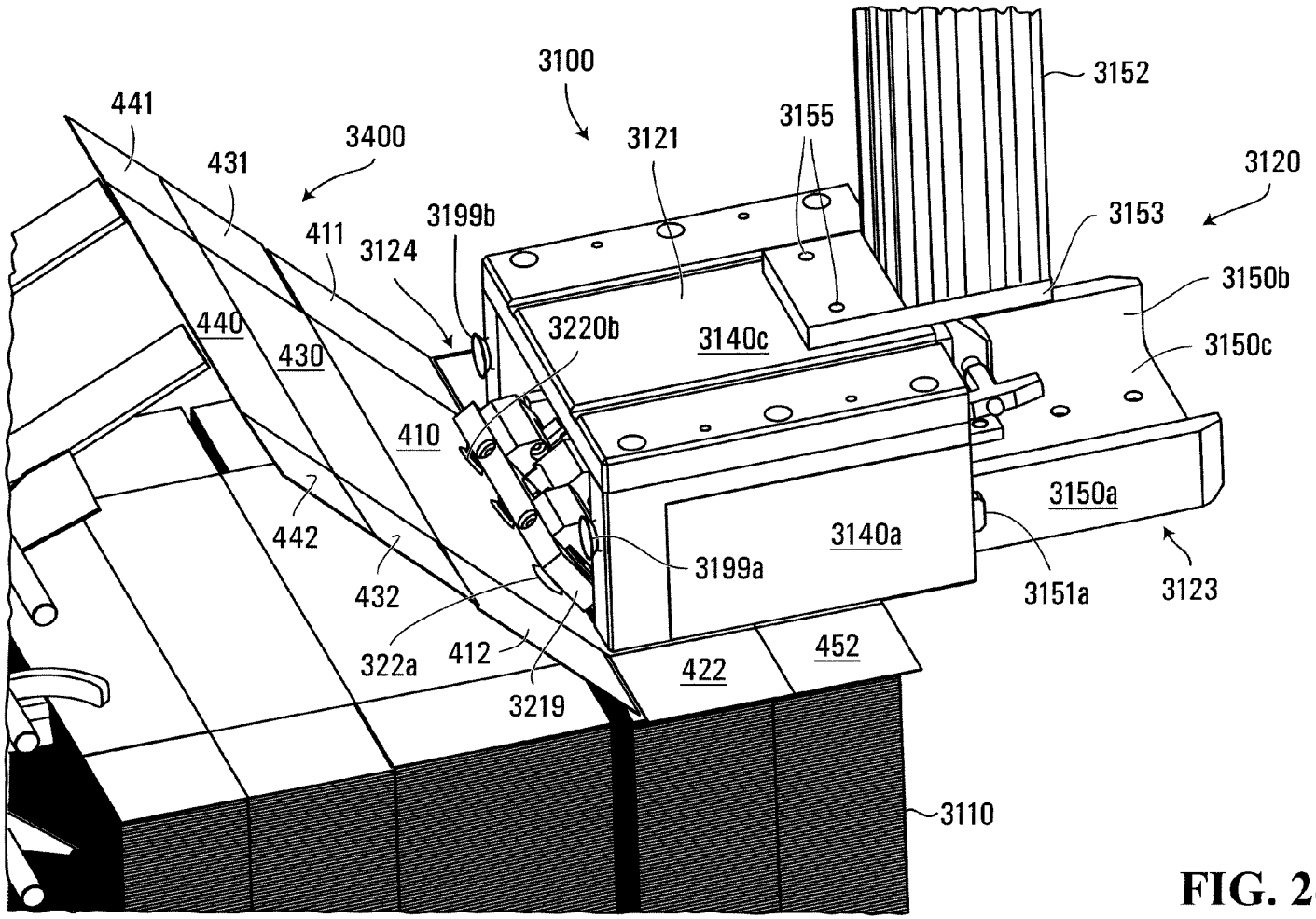
Figure 25:
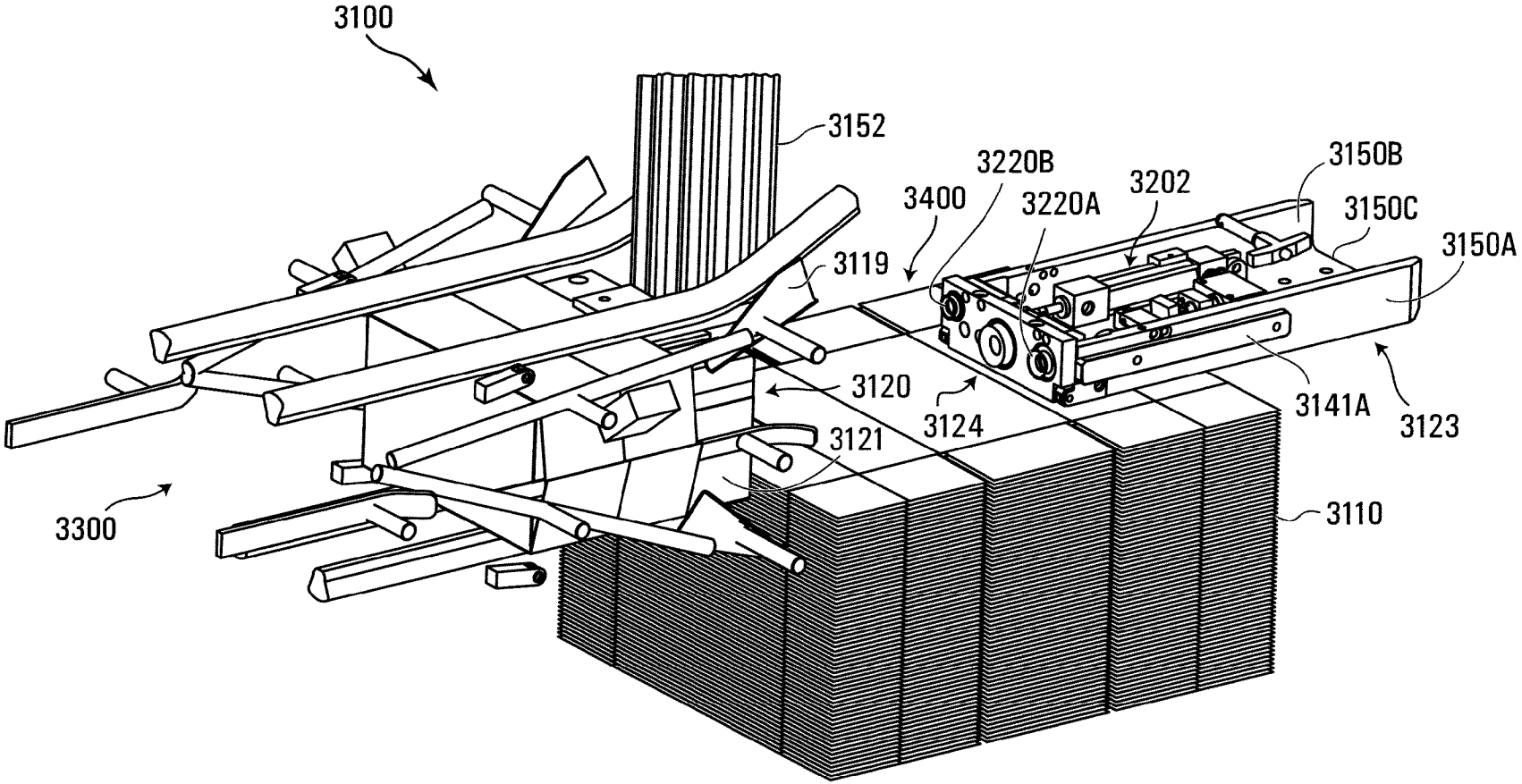
Figure 26:
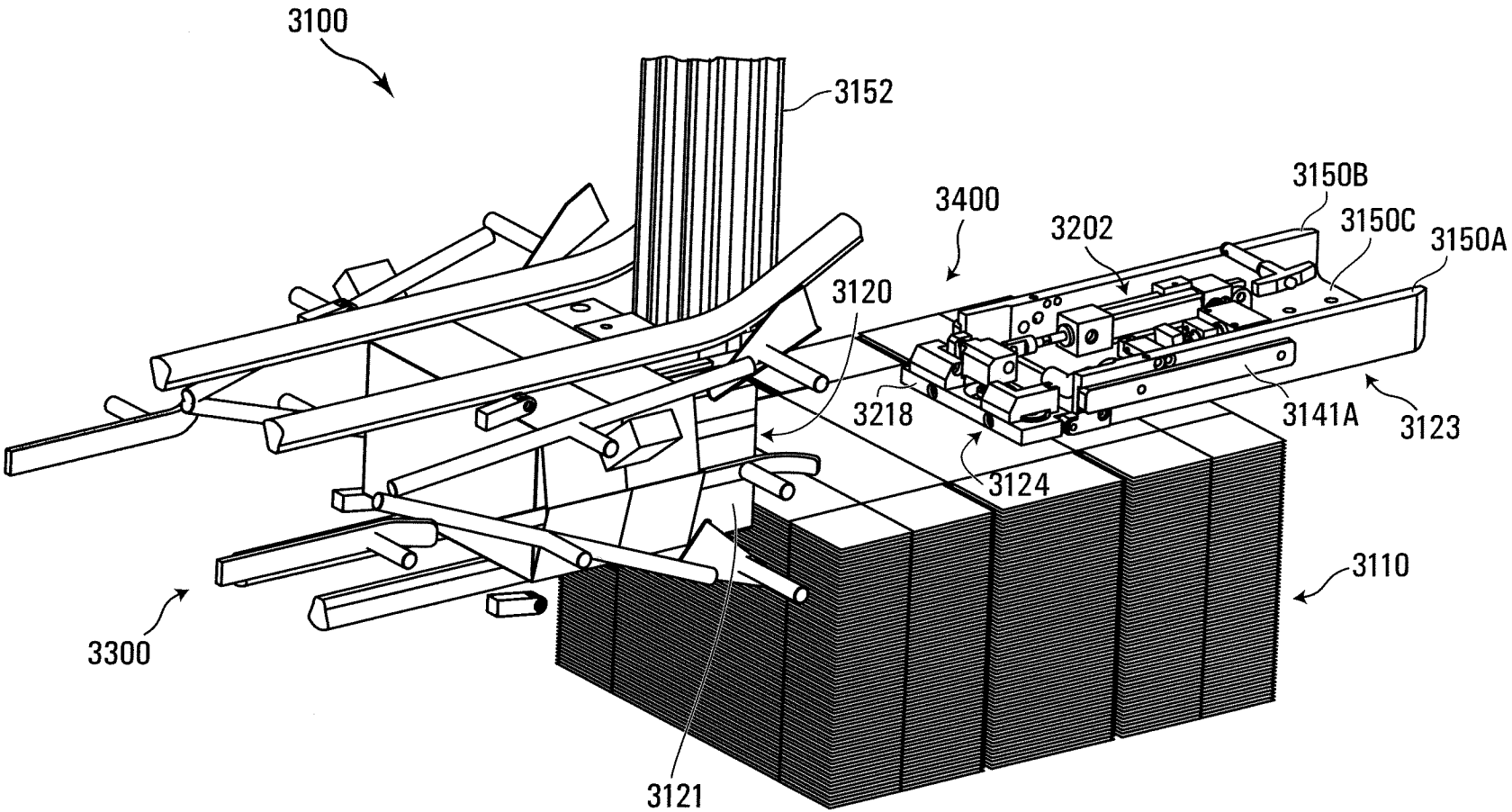
Figure 27:
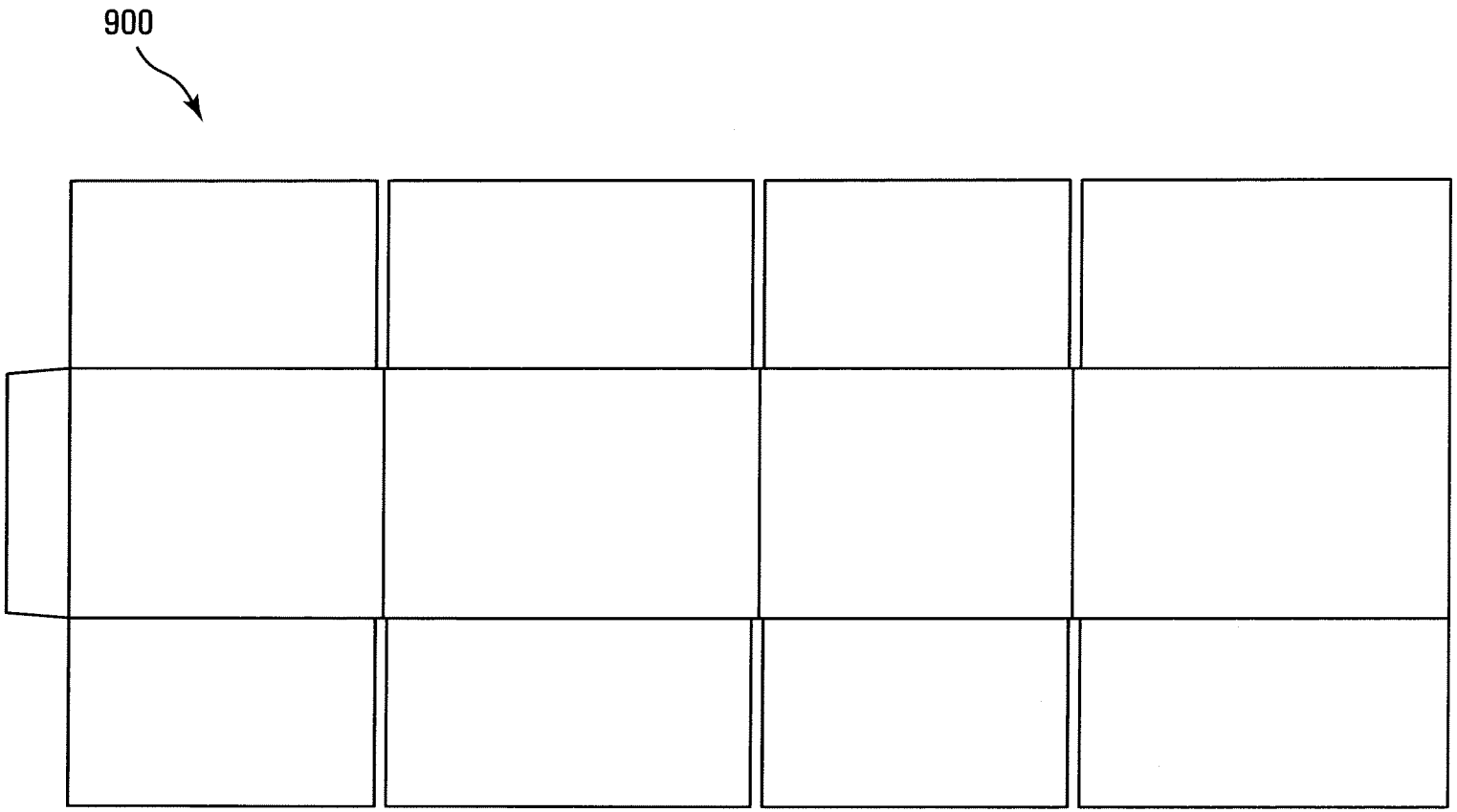
FIG. 27 Prior Art
FIG. 27 is a plan view of a known type of blank that may be used to form a known type of Regular Slotted Case.

Unit 3124 may be described in overview and with particular reference to FIGS. 24 and 25. Like unit 124 in the previous system 100, unit 3124 may include a longitudinally oriented piston device 3202 which has piston blocks that rest on bottom plate 3150*c* of support frame 3123. Piston 3202 may be a conventional pneumatic reciprocating cylinder and is operable to move in a reciprocal movement between a fully extended position (not shown) and a retracted position. To channel the compressed air appropriately, valves (not shown) can be driven between open and closed positions by solenoids responsive to signals from PLC 132. The valves could be located proximate the piston 3202 or be disposed elsewhere. Electrical lines carrying signals from PLC could also pass through vertical member 3152 to operate the valves.

A piston rod of piston 3202 is provided with an extended arm portion that provides for a hinge connection for pivoting the panel rotating apparatus 3124 between a generally horizontal position and a generally vertical position.

Panel rotation apparatus 3124 also comprises panel rotating plate 3219 Panel rotating plate 3219 may be attached by way of piano hinge to forward lower extension of bottom plate 3150*c* of support frame 3123. As a result of the movement of piston the cylinder rod may extend or retract allowing the arm to pivot relative to rotating apparatus 3124. The movement of piston rod thus causes the panel rotating plate 3219 to rotate through a certain angular distance relative to mandrel 3121.

Air suction cups 3220*a* and 3220*b* may be interconnected through block units to a source of vacuum. A plurality of valves that may be operated by the PLC and may also include a vacuum generator apparatus such as apparatus 221 in the previous system 100. If a vacuum generator is utilized, pressurized air may be delivered from an external source through vertical support member 3152. The vacuum generator may then convert the pressurized air to a vacuum that can then be delivered to suction cups 3220*a*, 3220*b*.

In operation of system 3100, magazine 3110 may be raised so that the upper generally horizontally oriented surface of the upper-most blank 3400 is just in contact with, or is a very short distance spaced from (e.g. within ¼ inch) the bottom surfaces of frame 3123 and mandrel 3121. Next, magazine 3110 and panel rotating apparatus 3124 may co-operate so that the single blank 3400 from the top of the stack of case blanks may be retrieved from the magazine 3110 and be transferred to the mandrel apparatus 3120. Thus, in this way the panel rotating apparatus 3124 may also serve as a transfer mechanism for transferring case blanks in series from the magazine 3110 to the mandrel 3121.

Under the control of the PLC, panel rotation apparatus 3124 may extend reciprocating piston rod so that the rotating plate 3219 and the suction cups 3220*a*, 3220*b* thereon are rotated to be in an orientation that is downward facing. Upon coming into close proximity or contact with panel 410, suction cups 3220*a*, 3220*b*, may engage the upward facing surface of panel 410 of the top blank 3400 in the stack. Panels 420 and 450 of the blank 3400 are at the same time are maintained generally in position up against or proximate the lower surface of support frame 3123 and mandrel side plates 3140*a*, 3140*b*. Blank 3400 continues to be supported underneath by physical contact with the upper surface of another underlying blank 400 in the stack.

Panel rotating apparatus 3124 may be operated by the PLC to rotate rotating plate 3219 about hinge so that panel 410 may be rotated—preferably approximately ninety (90) degrees—about a pre-determined fold line between panels 410 and 420. Thus panel 410 is rotated relative to panels 420 and 450 from a generally flat and horizontal orientation to a generally vertical and angled orientation, thus forming a generally L-shaped configuration.

Vacuum may also be applied to suction cups 3220*a*, 3220*b* through operation of PLC 132 during the rotation of the panel 410. The air suction force that may be developed at the outer surfaces of suction cups 3220*a*, 3220*b* of panel rotation apparatus 3124 may be sufficient so that panel 410 of a blank 3400 can be rotated from the flat position shown in FIG. 23 to an angled configuration.

Once panel 410 reaches the vertical position, the suction cups 3220*a*, 3220*b* associated with panel rotating apparatus plate 3129 may hold panel 410 against the forward facing surfaces of mandrel side plates 3140*a*, 3140*b* and the outer surface of 3219*a* of panel rotating plate 3219 with attached panels 411, 412, 430, 431, 432, 440, 441 and 442 also generally remaining in a vertical orientation until suction cups 3199*a*, 3199*b* of mandrel 3121 are activated by PLC and can then engage panel 410 of blank 3400. Once suction cups 3199*a*, 3199*b* of mandrel 3121 are activated and engage panel 410 of blank 3400, cups 3220*a* and 3220*b* of rotation apparatus 3124 can be de-activated. The rotation of panel 410 may also tend to pull that blank upwards and perhaps a very small distance forward, the effect of which may be to free the top blank from the blank beneath it that is still on the stack. The result is that the blank 3400 now held by suction cups 3199*a* and 3199*b*, is now capable of being moved forward by the mandrel apparatus 3120 towards the panel folding and guide apparatus 3300.

Next, mandrel support and moving apparatus (not shown) may be used to move mandrel apparatus 3120 longitudinally forward towards panel folding and guide apparatus 3300, thus also moving blank 3400 that is held to mandrel 3121.

System 3100 may have the advantage of allowing for faster operation of the case former relative to system 100 shown in FIG. 1. This is because as the mandrel apparatus 3120 is being moved longitudinally forward with a first blank to form a case, the panel rotation apparatus 3124 can be rotated to engage the surface of a second blank from the magazine. Once the mandrel apparatus 3120 has moved the first blank through the panel folding and guide apparatus 3300 to form a case and the mandrel apparatus 3120 is reversed to its original position, the panel rotation apparatus 3124 may rotate the front panels of the second blank in an L-shaped configuration around the mandrel 3121. The mandrel 3121 can now move forward longitudinally with the second blank to repeat the process.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements.

The invention claimed is:

1. A method of forming and loading a case, said case made from a corrugated material and comprising:

i. a generally flat transversely extending base panel;

ii. first and second transversely extending, generally parallel, side wall panels upstanding from, and being oriented generally orthogonal to, said base panel, each of said first and second side wall panels having respective first transverse edges extending along and joined with respective opposite transverse edges of said base panel;

iii. first and second upstanding end panels positioned at opposed ends of said first side wall panel and oriented generally orthogonal to both said first side wall panel and said base panel, each said first and second ends panel having edges joined with and extending from opposed end edges of said first side wall panel;

iv. third and fourth upstanding end panels positioned at opposed ends of second side wall panel and oriented generally orthogonal to said second side wall panel and said base panel, each of said third and fourth end panels joined with and extending from opposed end edges of said second side wall panel; and v. fifth and sixth upstanding end panels, said fifth and sixth upstanding end panels positioned at opposed ends of said base panel, said fifth and sixth end panels oriented generally orthogonal to both said first and second side wall panels and said base panel, each said fifth and sixth ends panel having edges joined with opposed end edges of said base panel;

wherein said first and third end wall panels meet at a first vertically extending seam extending upwards from one end of said base panel and said second and fourth end wall panels meet at a second vertically extending seam extending upwards from an opposite end of said base panel; and wherein said fifth end panel is attached to first and third end wall panels and said sixth end panel is attached to said second and fourth end wall panel, to thereby form completed first and second end walls;

said method comprising:

i. forming a sheet of corrugated fiberboard;

ii. operating a die cutting apparatus to form a generally flat case blank from said sheet of corrugated fiberboard at a first location;

iii. transporting said flat case blank to a second location;

iv. operating a case forming apparatus at said second location to fold said case blank to form said case, including forming said completed first and second end walls, v. after the case has been formed by the case forming apparatus, operating a loading apparatus to load at least one item into said case;

vi. sealing the opposed top panels of said case with the at least one item held in said case.

2. A method as claimed in claim 1 wherein said case forming apparatus comprises:

(a) a mandrel having a first surface oriented generally at a first orientation and a second surface oriented at a second orientation that is at an angle to said first orientation, wherein said case blank has a first portion that can be positioned proximate said first surface of said mandrel;

(b) a first rotating apparatus;

wherein said method further comprises said first rotating apparatus engaging a second portion of said case blank and rotating said second portion of said blank from said first orientation while said first portion is maintained in a position proximate said first surface of said mandrel such that said second portion of said case blank is oriented in said second orientation that is generally at said angle to said first portion of said case blank and said second portion of said case blank being positioned proximate said second surface of said mandrel.

3. A method as claimed in claim 2 wherein said angle is approximately 90 degrees.

4. A method as claimed in claim 2 or 3 further comprising rotating a third portion of said case blank relative to said first and second portions to a third orientation.

5. A method as claimed in claim 4 wherein said second rotating apparatus is a portion folding and guide apparatus.

6. A method as claimed in claim 2 further comprising moving said mandrel towards said folding and guide apparatus while said first portion of said case blank is positioned proximate said first surface of said mandrel and said second portion of said case blank is positioned proximate said second surface of said mandrel, such said third portion of said case blank is rotated relative to said first and second portions.

7. A method as claimed in claim 1 wherein said case forming apparatus comprises:

(a) a mandrel having a first surface and wherein said case blank has a first portion that can be positioned proximate said first surface of said mandrel;

(b) a movement apparatus;

said method further comprising said moving apparatus moving said mandrel through a folding and guide apparatus while said first portion of said case blank is positioned proximate said first surface of said mandrel whereby a second portion of said case blank is folded relative to said first portion by co-operation of said movement apparatus and said folding and guide apparatus.

8. A method as claimed in claim 7 further comprising applying adhesive to said case blank during movement of said mandrel through said folding and guide apparatus.

9. A system for forming and loading a case, said case made from corrugated fibreboard, said case comprising:

i. a generally flat transversely extending base panel;

ii. first and second transversely extending, generally parallel, side wall panels upstanding from, and being oriented generally orthogonal to, said base panel, each of said first and second side wall panels having respective first transverse edges extending along and joined with respective opposite transverse edges of said base panel;

iii. first and second upstanding end panels positioned at opposed ends of said first side wall panel and oriented generally orthogonal to both said first side wall panel and said base panel, each said first and second ends panel having edges joined with and extending from opposed end edges of said first side wall panel;

iv. third and fourth upstanding end panels positioned at opposed ends of second side wall panel and oriented generally orthogonal to said second side wall panel and said base panel, each of said third and fourth end panels joined with and extending from opposed end edges of said second side wall panel; and v. fifth and sixth upstanding end panels, said fifth and sixth upstanding end panels positioned at opposed ends of said base panel, said fifth and sixth end panels oriented generally orthogonal to both said first and second side wall panels and said base panel, each said fifth and sixth ends panel having edges joined with opposed end edges of said base panel;

wherein said first and third end wall panels meet at a first vertically extending seam extending upwards from one end of said base panel and said second and fourth end wall panels meet at a second vertically extending seam extending upwards from an opposite end of said base panel;

wherein said fifth end panel is joined to first and third end wall panels and said sixth end panel is joined with said second and fourth end wall panel, to thereby form first and second end walls;

and wherein said system comprises:

i. a corrugator operable to form a sheet of corrugated fiberboard;

ii. a die cutting apparatus located at a first location operable to form a generally flat case blank from said sheet of corrugated fiberboard at a first location;

iii. a case forming apparatus located at a second location operable to fold said generally flat case blank to form said case with completed first and second end walls;

iv. a loading apparatus operable to load at least one item into said case after said case has been formed with said completed first and second end walls;

v. a sealing apparatus operable to seal the opposed top panels of said case with said at least one item held in said case.

10. A system as claimed in claim 9 further comprising a transporter for transporting said case blank from said first location to said second location.

11. A system as claimed in claim 10 wherein said case forming apparatus comprises:

(a) a mandrel having a first surface oriented generally at a first orientation and a second surface oriented at a second orientation that is at an angle to said first orientation, wherein said case blank has a first portion that can be positioned proximate said first surface of said mandrel;

(b) a first rotating apparatus operable to engage a second portion of said case blank and rotate said second portion of said blank from said first orientation while said first portion is maintained in a position proximate said first surface of said mandrel such that said second portion of said case blank is oriented in said second orientation that is generally at said angle to said first portion of said case blank and said second portion of said case blank being positioned proximate said second surface of said mandrel.

12. A system as claimed in claim 11 wherein said angle is approximately 90 degrees.

13. A system as claimed in claim 11 or 12 further comprising a second rotating apparatus operable to rotate a third portion of said case blank relative to said first and second portions to a third orientation.

14. A system as claimed in claim 13 wherein said third orientation is generally parallel to said first orientation.

15. A system as claimed in claim 10 wherein said second rotating apparatus is a folding and guide apparatus.

16. A system as claimed in claim 15 further comprising a movement apparatus, said movement apparatus operable for moving said mandrel towards said folding and guide apparatus while said first portion of said case blank is positioned proximate said first surface of said mandrel and said second portion of said case blank is positioned proximate said second surface of said mandrel, such said third portion of said case blank can be rotated relative to said first and second portions by co-operation of said movement apparatus and said folding apparatus.

17. A system as claimed in claim 9 wherein said case forming apparatus comprises:

(a) a mandrel having a first surface and wherein said case blank has a first portion that can be positioned proximate said first surface of said mandrel;

(b) a movement apparatus operable for moving said mandrel through a folding and guide apparatus while said first portion of said case blank is positioned proximate said first surface of said mandrel such that a second portion of said case blank can be folded relative to said first portion by co-operation of said movement apparatus and said folding and guide apparatus.

18. A system as claimed in claim 17 further comprising at least one adhesive applicator to apply adhesive to said case blank during movement of said mandrel through said folding and guide apparatus.

19. A system as claimed in claim 9 wherein said case forming apparatus comprises:

(a) a magazine for storing a plurality of case blanks in a generally flat configuration, each said case blank comprising a first portion and a second portion;

(b) a mandrel having a first surface oriented at a first orientation and a second surface oriented at a second orientation that is generally orthogonal to said first orientation;

(c) a panel rotation apparatus operable to engage said second portion of said case blank and rotate said second panel to proximate to, and generally in the same orientation as, said second surface of said mandrel such that said second portion is oriented in a second orientation generally orthogonal to said first portion.

20. A system as claimed in claim 19 further comprising a movement apparatus and a folding apparatus, said movement apparatus for moving said mandrel, while said mandrel is engaged with said blank, towards said folding apparatus, so that a third portion of said blank can be rotated relative to said first and second panels by co-operation of said movement of said mandrel by said movement apparatus and said folding apparatus.

21. A system a claimed in claim 20 wherein said mandrel is movable by said movement apparatus from a first position to a second position, such that during said movement of said mandrel from said first position to said second position, said folding apparatus folds at least said third portion to produce at least part of said case.

22. A system a claimed in claim 20 wherein said mandrel is movable from said second position to a third position wherein said mandrel has disengaged from said case.

23. A system as claimed in claim 19 wherein said first, second and third panels of said case blank are arranged longitudinally in series, such that when said first, second and third portions have been oriented in said first, second and third positions, said first panel forms a base wall, said second panel forms an end wall and said third panel forms a forms a top wall of a case.

24. A system as claimed in claim 19 further comprising a PLC to control the operation of said panel rotation apparatus and said movement apparatus.

25. A system as claimed in claim 19 further comprising a transfer mechanism for transferring a plurality of said case blanks in series from said magazine to said mandrel.

26. A method for forming a case from a case blank, said case blank comprising:

i. a base panel;

ii. first and second side wall panels meeting either side of said base panel meeting either side of said base panel along respective opposite fold lines;

iii. first and second end panels meeting at opposed ends of said first side wall panel along respective opposite fold lines;

iv. third and fourth side end panels meeting at opposed ends of second side wall panel along respective opposite fold lines;

a width of said base and a length of said first and third side end wall panels being selected such that when blank is erected to form said case, said first and third side end walls will meet at a first vertically extending seam at one end of said base panel and said second and fourth side end wall panels meet at a second vertically extending seam at an opposite end of said base panel;

said method comprising:

(a) orienting a case blank in a generally flat first orientation;

(b) rotating a first portion of said blank from said first orientation to a second orientation that is generally orthogonal to a second portion of said case blank, while said second portion is stationary.

27. A method as claimed in claim 26 further comprising after (b), (c) rotating at least a third portion of said case blank relative to said first and second portions to a third orientation.

28. A method as claimed in claim 27 herein said third orientation is generally parallel to said first orientation.

29. A method as claimed in claim 27 wherein said rotating of at least a third portion of said case blank comprises moving said case blank longitudinally while said first portion of said blank is at said second orientation and said second portion is at said first orientation, and so that said third portion of said case blank is rotated relative to said first and second portions by co-operation of said movement and engagement with a folding apparatus.

30. A method as claimed in claim 29 wherein during said moving of said case longitudinally, adhesive is applied to a portion of said case blank.

31. A method of forming a case from a case blank, said case blank comprising:

i. a base panel;

ii. first and second side wall panels meeting either side of said base panel meeting either side of said base panel along respective opposite fold lines;

iii. first and second end panels meeting at opposed ends of said first side wall panel along respective opposite fold lines;

iv. third and fourth side end panels meeting at opposed ends of second side wall panel along respective opposite fold lines a width of said base and a length of said first and third side end wall panels being selected such that when blank is erected to form said case, said first and third side end walls will meet at a first vertically extending seam at one end of said base panel and said second and fourth side end wall panels meet at a second vertically extending seam at an opposite end of said base panel;

said method comprising:

(a) providing a case blank in a first generally flat orientation, said case blank having first and second portions, said first portion of blank being generally adjacent and parallel to a first portion of a mandrel;

(b) while said mandrel is stationary, rotating said second portion of said case blank about said mandrel so said second portion is positioned at a second orientation that is generally orthogonal to said first portion.

32. A method as claimed in claim 31 further comprising moving said mandrel and said case blank longitudinally while said first portion of said blank is at said first orientation and said second portion is at said second orientation, and so that a third portion of said case blank is rotated relative to said first and second portions by co-operation of said movement and engagement with a folding and guide apparatus.

33. A system for forming a case, said case made from a case blank made from a corrugated material, said case comprising:

i. a generally flat transversely extending base panel;

ii. first and second transversely extending, generally parallel, side wall panels upstanding from, and being oriented generally orthogonal to, said base panel, each of said first and second side wall panels having respective first transverse edges extending along and joined with respective opposite transverse edges of said base panel;

iii. first and second upstanding end panels positioned at opposed ends of said first side wall panel and oriented generally orthogonal to both said first side wall panel and said base panel, each said first and second ends panel having edges joined with and extending from opposed end edges of said first side wall panel;

iv. third and fourth upstanding end panels positioned at opposed ends of second side wall panel and oriented generally orthogonal to said second side wall panel and said base panel, each of said third and fourth end panels joined with and extending from opposed end edges of said second side wall panel;

wherein said first and third end wall panels meet at a first vertically extending seam extending upwards from one end of said base panel and said second and fourth end wall panels meet at a second vertically extending seam extending upwards from an opposite end of said base panel;

and wherein said system comprises a case forming apparatus to fold and glue said generally flat case blank to form said case, and wherein said case forming apparatus comprises:

(a) a mandrel, and wherein said case blank has a first portion that can be positioned proximate a first surface of said mandrel;

(b) a folding and guide apparatus;

(c) a movement apparatus operable for moving said mandrel towards and through said folding and guide apparatus while said first portion of said case blank is positioned proximate said first surface of said mandrel;

(d) an adhesive applicator positioned to apply an amount of adhesive to at least one portion of said case blank;

said system operable such that while said mandrel is moved towards and through said folding and guide apparatus by said moving apparatus, said adhesive applicator applies adhesive to said at least one portion of said blank.

34. A system as claimed in claim 33 wherein said adhesive is applied while said mandrel is moving said case blank through said folding and guide apparatus after folding of said case blank has commenced.

* * * * *